US007298992B2

(12) United States Patent
Nishimura et al.

(10) Patent No.: US 7,298,992 B2
(45) Date of Patent: Nov. 20, 2007

(54) PROCESS CARTRIDGE THAT ACCURATELY DISPOSES BRUSH WITH RESPECT TO IMAGE BEARING MEMBER

(75) Inventors: Soichiro Nishimura, Handa (JP); Fumikazu Sato, Inuyama (JP); Tsutomu Suzuki, Nagoya (JP); Yoshinori Ito, Toyokawa (JP); Takashi Shimizu, Kakamigahara (JP); Satoru Ishikawa, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/044,468

(22) Filed: Jan. 28, 2005

(65) Prior Publication Data

US 2005/0169669 A1 Aug. 4, 2005

(30) Foreign Application Priority Data

Jan. 30, 2004 (JP) ..... 2004-024776
Jan. 30, 2004 (JP) ..... 2004-024778

(51) Int. Cl.
*G03G 15/30* (2006.01)

(52) U.S. Cl. ..... 399/149

(58) Field of Classification Search ..... 399/149, 399/150, 353, 354
See application file for complete search history.

(56) References Cited

U.S. PATENT DOCUMENTS 5,060,016 A * 10/1991 Wanou et al. ..... 399/175
5,245,386 A * 9/1993 Asano et al. ..... 399/175
5,826,153 A 10/1998 Hazama et al.
6,577,831 B1 * 6/2003 Kojima et al. ..... 399/111

FOREIGN PATENT DOCUMENTS

| | | |
|---|---|---|
| JP | A 61-055682 | 3/1986 |
| JP | U 61-076451 | 5/1986 |
| JP | A 09-244497 | 9/1997 |
| JP | A 09-244503 | 9/1997 |
| JP | A 09-244504 | 9/1997 |
| JP | A 09-244515 | 9/1997 |
| JP | B2 3292978 | 4/2002 |
| JP | B2 3401135 | 2/2003 |
| JP | B2 3429626 | 5/2003 |

* cited by examiner

*Primary Examiner*—Quana Grainger
(74) *Attorney, Agent, or Firm*—Oliff & Berridge PLC

(57) ABSTRACT

A process cartridge includes an image bearing member, a brush, and a supporting portion. The brush includes a base member having an elongated plate shape that extends in the longitudinal direction, a brush member including bristles provided on the front surface of the base member, and mounting portions formed at both latitudinal ends of the base member. The supporting portion includes holding portions that hold the mounting portions formed at the both latitudinal ends of the base member, thereby supporting the brush with respect to the image bearing member.

57 Claims, 26 Drawing Sheets

PROCESS CARTRIDGE THAT ACCURATELY DISPOSES BRUSH WITH RESPECT TO IMAGE BEARING MEMBER

BACKGROUND OF THE INVENTION

1. Field of the Invention

The present invention relates to an image forming device such as a laser printer, and particularly to a process cartridge provided in the image forming device.

2. Description of Related Art

Laser printers and other image forming devices equipped with a detachably mounted process cartridge are well known in the art. The process cartridge includes a developing roller for carrying a toner; a photosensitive drum disposed in confrontation with the developing roller, on the surface of which electrostatic latent images are formed; and a transfer roller disposed in opposition to the photosensitive drum, to which a transfer bias is applied.

When the toner carried on the developing roller comes into opposition with and contacts the photosensitive drum, the latent images on the drum are developed into a toner image that is carried on the surface of the photosensitive drum. Subsequently, by applying a transfer bias to the transfer roller, the toner image is transferred onto paper as the paper passes between the photosensitive drum and the transfer roller.

In this type of laser printer, toner remaining on the surface of the photosensitive drum after the toner image has been transferred to the paper by the transfer roller is recovered by the developing roller in what is known as a cleanerless system. In the cleanerless system, a paper dust collecting brush is disposed downstream of the transfer roller with respect to the rotational direction of the photosensitive drum for recovering paper dust deposited from paper onto the surface of the photosensitive drum.

One such paper dust collecting brush has been proposed in Japanese patent-application publication (kokai) No. HEI-9-244503. The brush includes a planar part having an implantation surface with a flat rectangular shape; a brush material of a predetermined height that is thickly implanted in the implantation surface; protruding parts disposed on one of the longer side edges on the implantation surface, rising nearly perpendicular to the implantation surface up to a predetermined position lower than the height of the brush material and then folding back and downward from this predetermined position; and a mounting plate part extending from the lower end of the protruding parts in a direction intersecting the same.

SUMMARY OF THE INVENTION

However, the paper dust collecting brush disclosed in Japanese patent-application publication No. HEI-9-244503 is mounted such that the mounting plate part extending from one side of the planar part in which the brush material is implanted is inserted into a brush retaining part provided on a frame of the image forming device. Hence, the mounting plate part must be large due to the arrangement of the components, thereby increasing the overall size of the paper dust collecting brush, leading to such problems as an increase in the device size and an inconvenience in replacing the paper dust collecting brush.

Further, when the mounting plate part is inserted into the brush retaining part, the planar part is supported on only one side. Hence, it is not possible to achieve precise positioning of the brush, making it difficult to position the brush material appropriately with respect to the photosensitive member.

In view of the foregoing, it is an object of the present invention to provide a compact process cartridge that can accurately dispose the brush material in relation to an image bearing member. It is another object of the present invention to provide an image forming device equipped with the process cartridge.

In order to attain the above and other objects, the present invention provides a process cartridge. The process cartridge includes an image bearing member, a brush, and a supporting portion. The image bearing member has a surface that extends in a longitudinal direction for bearing a developer image on the surface. The brush removes foreign matter deposited on the surface of the image bearing member. The brush includes a base member having an elongated plate shape that extends in the longitudinal direction, the base member having a front surface that extends in the longitudinal direction and confronts the image bearing member, a brush member including bristles provided on the front surface of the base member, the bristles extending in another direction substantially perpendicular to the front surface, and mounting portions formed at both latitudinal ends of the base member, the both latitudinal ends being both ends in a latitudinal direction perpendicular both to the longitudinal direction and to the another direction. The supporting portion includes holding portions that hold the mounting portions formed at the both latitudinal ends of the base member, thereby supporting the brush with respect to the image bearing member.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction, a supporting portion supporting the brush with respect to the image bearing member, and an electrode that contacts the brush when the brush is supported by the supporting portion for applying a bias to the brush. The brush is electrically conductive. The supporting portion includes a support plate supporting the brush from an opposite side of the image bearing member with the brush interposed therebetween, the support plate having a front surface that confronts the rear surface of the brush, a rear surface opposite to the front surface of the support plate, and a latitudinal end which is an end in a latitudinal direction perpendicular to the longitudinal direction, and an confronting wall confronting the longitudinal end surface of the brush. The electrode is formed in a plate shape and includes a fixing part fixed to the confronting wall, a relay part formed continuously from the fixing part and disposed on the rear surface of the support plate, a bridge part formed continuously from the relay part and spanning the latitudinal end of the support plate, and a contact part formed continuously from the bridge part and disposed on the front surface of the support plate.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, a supporting portion supporting the brush with respect to the image bearing member, and an electrode having a mounting part for mounting the electrode onto the brush for applying a bias to the brush.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, a supporting portion supporting the brush with respect to the image bearing member, an electrode applying a bias to the brush, and a frame accommodating the image bearing member, the brush, and the supporting portion. The frame includes a first frame, and a second frame formed separately from the first frame and assembled with the first frame. The brush is electrically conductive. The electrode is disposed in the second frame and contacts the brush when the first frame and the second frame are assembled together.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction, a supporting portion supporting the brush with respect to the image bearing member, and an electrode that contacts the brush when the brush is supported by the supporting portion for applying a bias to the brush. The brush is electrically conductive. The supporting portion includes a support plate supporting the brush from an opposite side of the image bearing member with the brush interposed therebetween, the support plate having a front surface that confronts the rear surface of the brush, a rear surface opposite to the front surface of the support plate, and latitudinal ends with regard to a latitudinal direction perpendicular to the longitudinal direction, a side wall erected in a direction toward the image bearing member and erecting from at least one latitudinal end of the support plate, the side wall having an engaging part. The electrode is disposed on the front surface of the support plate for contacting the rear surface of the brush, the electrode having an engaging part engaging with the engaging part of the side wall.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction, a supporting portion supporting the brush with respect to the image bearing member, and an electrode that contacts the brush when the brush is supported by the supporting portion for applying a bias to the brush. The brush is electrically conductive. The supporting portion includes a support plate supporting the brush from the rear surface of the brush, the support plate having a front surface that confronts the rear surface of the brush and a rear surface opposite to the front surface of the support plate, a contact wall contacting the longitudinal end surface of the brush, and an open part penetrating the support plate in a thickness direction. The electrode is configured of a wire and includes a first end fixed to the contact wall, a relay part formed continuously from the first end and disposed on the rear surface of the support plate, and a second end formed continuously from the relay part and disposed from the rear surface to the front surface of the support plate through the open part.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, the brush having a front surface confronting the image bearing member, a rear surface opposite to the front surface, a longitudinal end surface at an end in the longitudinal direction, and a latitudinal end at an end in a latitudinal direction perpendicular to the longitudinal direction, a supporting portion supporting the brush with respect to the image bearing member, and an electrode that contacts the brush when the brush is supported by the supporting portion for applying a bias to the brush. The brush is electrically conductive. The supporting portion includes a support plate supporting the brush from the rear surface of the brush, the support plate having a front surface that confronts the rear surface of the brush and a rear surface opposite to the front surface of the support plate, the support plate further having a latitudinal end at an end in the latitudinal direction, and an confronting wall confronting the longitudinal end surface of the brush. The electrode is formed in a plate shape and includes a first end fixed to the confronting wall, a relay part formed continuously from the first end and disposed on the rear surface of the support plate, and a second end formed continuously from the relay part and disposed from the rear surface of the support plate across both the latitudinal end of the support plate and the latitudinal end of the brush to the front surface of the brush.

The present invention also provides a process cartridge. The process cartridge includes an image bearing member having a surface that extends in a longitudinal direction for bearing a developer image on the surface, a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction, a supporting portion supporting the brush with respect to the image bearing member, and an electrode that contacts the brush when the brush is supported by the supporting portion for applying a bias to the brush. The brush is electrically conductive. The supporting portion includes a contact wall contacting the longitudinal end surface of the brush. The electrode includes an engaging part engaging with the contact wall, and a contact part formed continuously from the engaging part for elastically contacting the longitudinal end surface of the brush.

The present invention also provides an image forming device. The image forming device includes a main casing and a process cartridge detachably mounted on the main casing. The process cartridge includes an image bearing member, a brush, and a supporting portion. The image bearing member has a surface that extends in a longitudinal direction for bearing a developer image on the surface. The brush removes foreign matter deposited on the surface of the image bearing member. The brush includes a base member having an elongated plate shape that extends in the longitudinal direction, the base member having a front surface that extends in the longitudinal direction and confronts the image bearing member, a brush member including bristles provided on the front surface of the base member, the bristles extending in another direction substantially perpendicular to the front surface, and mounting portions formed at both latitudinal ends of the base member, the both latitudinal ends being both ends in a latitudinal direction perpendicular both to the longitudinal direction and to the another direction. The supporting portion includes holding portions that hold the mounting portions formed at the both latitudinal ends of the base member, thereby supporting the brush with respect to the image bearing member.

BRIEF DESCRIPTION OF THE DRAWINGS

The above and other objects, features and advantages of the invention will become more apparent from reading the following description of the preferred embodiments taken in connection with the accompanying drawings in which:

FIG. 5(*b*) is a perspective view showing the electrode mounted on the brush of FIG. 3;

FIG. 9(*b*) is a cross-sectional view of the brush holder shown in FIG. 7 with the brush mounted therein;

FIG. 16(*b*) is a plan view showing the relevant parts of the brush holder and electrode of FIG. 16(*a*);

FIG. 16(*c*) is a front view showing the relevant parts of the brush holder and electrode of FIG. 16(*a*);

FIG. 18(*b*) is a perspective view showing the relevant parts of the brush holder and electrode according to the ninth embodiment;

FIG. 24(*b*) is a cross-sectional view of the brush holder in FIG. 23 indicated by line XXIVB-XXIVB;

FIG. 24(*c*) is a cross-sectional view of the brush holder in FIG. 23 indicated by line XXIVC-XXIVC;

FIG. 25(*b*) is a perspective view showing the brush holder for mounting the electrode thereon;

FIG. 28(*b*) is a cross-sectional view of the brush holder in FIG. 27 indicated by line XXVIIIB-XXVIIIB;

FIG. 28(*c*) is a cross-sectional view of the brush holder in FIG. 27 indicated by line XXVIIIC-XXVIIIC;

FIG. 31(*b*) is a perspective view showing the front side of the brush holder and electrode according to the sixteenth embodiment;

FIG. 33(*b*) is a perspective view showing the relevant parts of the brush holder and electrode according to the eighteenth embodiment.

DETAILED DESCRIPTION OF THE PREFERRED EMBODIMENTS

A process cartridge and an image forming device according to embodiments of the present invention will be described while referring to the accompanying drawings.

Figure 1:
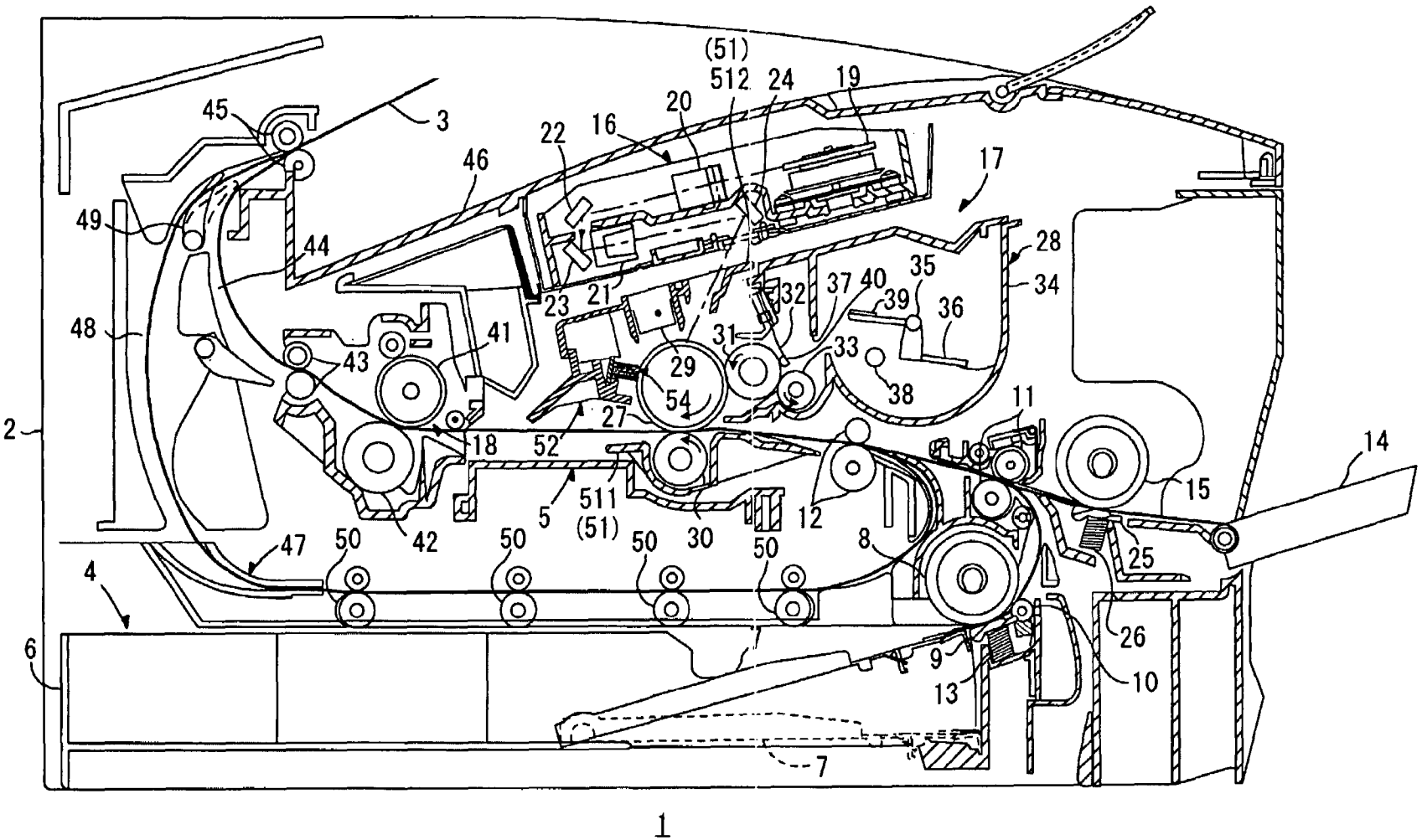
FIG. 1 is a side cross-sectional view showing the relevant parts of a laser printer according to a first embodiment of the present invention.

A process cartridge and laser printer according to a first embodiment of the present invention will be described with reference to FIG. 1. As shown in FIG. 1, the laser printer 1 includes a main casing 2, a feeder unit 4, and an image forming unit 5. The feeder unit 4 and the image forming unit 5 are housed in the main casing 2. The feeder unit 4 supplies sheets 3 to the image forming unit 5. The image forming unit 5 forms desired images on the supplied sheets 3.

The feeder unit 4 is located within the lower section of the main casing 2 and includes a sheet supply tray 6, a sheet pressing plate 7, a sheet supply roller 8, a sheet supply pad 9, paper dust removing rollers 10, 11, and a pair of registration rollers 12. The sheet supply tray 6 is detachably mounted with respect to the main casing 2. The sheet pressing plate 7 is pivotally movably provided within the sheet supply tray 6. The sheet supply roller 8 and the sheet supply pad 9 are provided above one end of the sheet supply tray 6. The paper dust removing rollers 10, 11 are disposed downstream from the sheet supply roller 8 with respect to the direction in which the sheets 3 are transported. The registration rollers 12 are provided downstream from the paper dust removing rollers 10, 11 in the sheet transport direction of the sheets 3.

The sheet pressing plate 7 is capable of supporting a stack of sheets 3. The sheet pressing plate 7 is pivotably supported at its end furthest from the supply roller 8 so that the end of the sheet pressing plate 7 that is nearest the supply roller 8 can move vertically. Although not shown in the drawings, a spring for urging the sheet pressing plate 7 upward is provided to the rear surface of the sheet pressing plate 7. Therefore, the sheet pressing plate 7 pivots downward in accordance with increase in the amount of sheets 3 stacked on the sheet pressing plate 7. At this time, the sheet pressing plate 7 pivots around the end of the sheet pressing plate 7 farthest from the sheet supply roller 8, downward against the urging force of the spring. The sheet supply roller 8 and the sheet supply pad 9 are disposed in confrontation with each other. A spring 13 is provided beneath the sheet supply pad 9 for pressing the sheet supply pad 9 toward the sheet supply roller 8.

Urging force of the spring under the sheet pressing plate 7 presses the uppermost sheet 3 on the sheet pressing plate 7 toward the supply roller 8 so that rotation of the supply roller 8 moves the uppermost sheet 3 between the supply roller 8 and the separation pad 13. In this way, one sheet 3 at a time is separated from the stack and supplied to the paper dust removing rollers 10, 11.

The paper dust removing rollers 10, 11 remove paper dust from the supplied sheets 3 and further convey the same to the registration rollers 12. The pair of registration rollers 12 performs a desired registration operation on the supplied sheets 3. Then the sheets 3 are transported to an image formation position. In the image formation position a photosensitive drum 27 and a transfer roller 30 contact each other. In other words, the image formation position is a transfer position where the visible toner image is transferred from a surface 27S of the photosensitive drum 27 to a sheet 3 as the sheet 3 passes between the photosensitive drum 27 and the transfer roller 30.

The feeder unit 4 further includes a multipurpose tray 14, a multipurpose sheet supply roller 15, and a multipurpose sheet supply pad 25. The multipurpose sheet supply roller 15 and the multipurpose sheet supply pad 25 are disposed in confrontation with each other and are for supplying sheets 3 that are stacked on the multipurpose tray 14. A spring 26 provided beneath the multipurpose sheet supply pad 25 presses the multipurpose sheet supply pad 25 up toward the multipurpose sheet supply roller 15.

Rotation of the multipurpose sheet supply roller 15 moves sheets 3 one at a time from the stack on the multipurpose tray 14 to a position between the multipurpose sheet supply pad 25 and the multipurpose sheet supply roller 15 so that the sheets 3 on the multipurpose tray 14 can be supplied one at a time to the image formation position.

The image forming section 5 includes a scanner section 16, a process cartridge 17, and a fixing section 18. The scanner section 16 is provided at the upper section of the casing 2 and is provided with a laser emitting section (not shown), a rotatingly driven polygon mirror 19, lenses 20, 21, and reflection mirrors 22, 23, 24. The laser emitting section emits a laser beam based on desired image data. As indicated by single-dot chain line in FIG. 1, the laser beam passes through or is reflected by the mirror 19, the lens 20, the reflection mirrors 22 and 23, the lens 21, and the reflection mirror 24 in this order so as to irradiate, in a high speed scanning operation, the surface 27S of the photosensitive drum 27 of the process cartridge 17.

Figure 2:
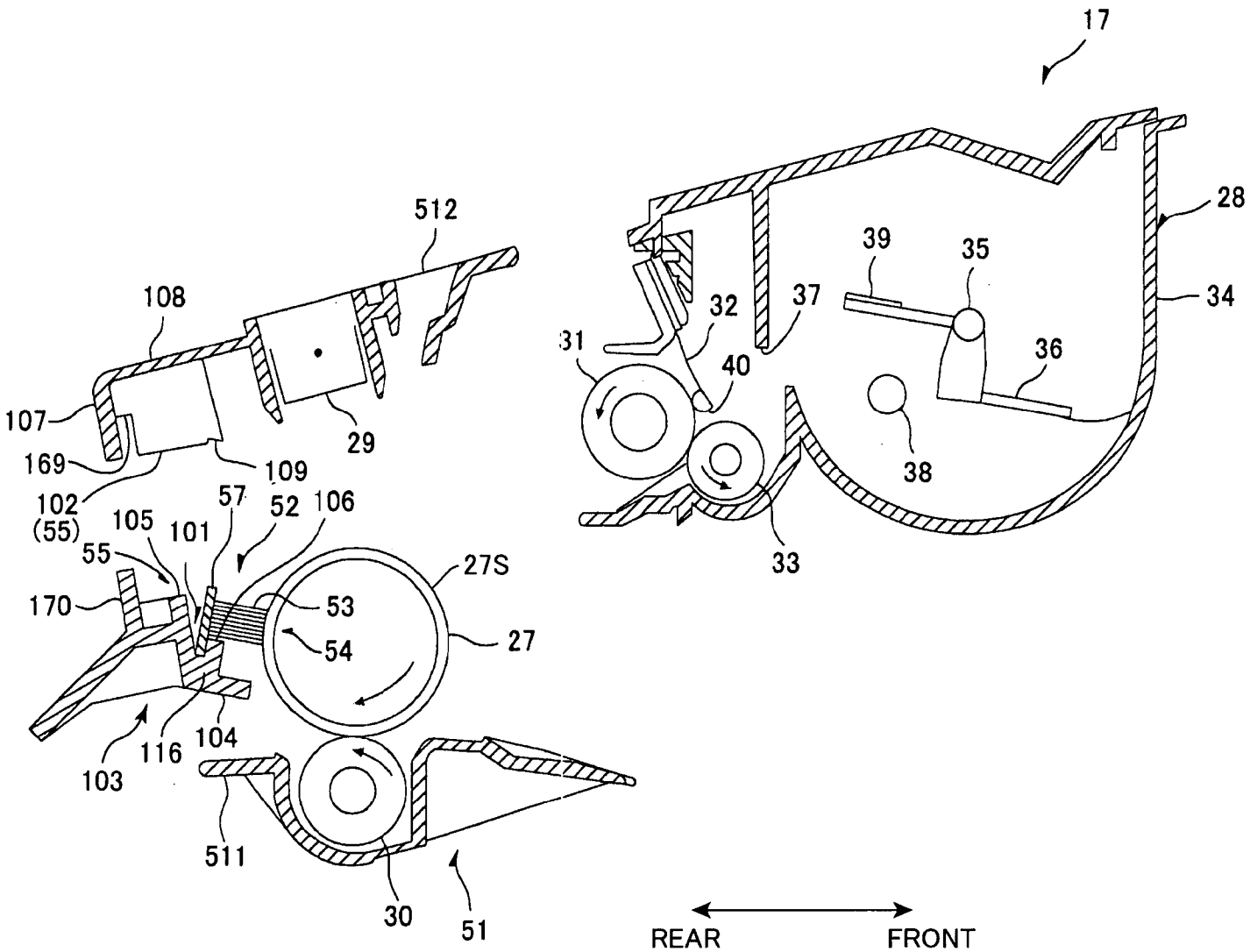
FIG. 2 is a side cross-sectional view showing the relevant parts of a process cartridge in the laser printer of FIG. 1.

The process cartridge 17 is disposed below the scanner section 16. As shown in FIG. 2, the process cartridge 17 includes a frame 51 and a development cartridge 28. The frame 51 is detachably mounted on the main casing 2 and houses the photosensitive drum 27, a scorotron charge unit 29, a transfer roller 30, and a brush unit 52. In other words, the process cartridge 17 is detachably mounted on the laser printer 1.

The frame 51 includes a lower frame 511 and an upper frame 512 formed separately from the lower frame 511 and assembled onto the lower frame 511 from above.

The development cartridge 28 is detachable from the frame 51 and provided with a developing roller 31, a layer thickness regulating blade 32, a supply roller 33 and a toner hopper 34.

The toner hopper 34 is filled with positively charging, non-magnetic, single-component toner. In the present embodiment, polymerization toner is used as the toner. Polymerization toner has substantially spherical particles and so has an excellent fluidity characteristic. To produce polymerization toner, a polymerizing monomer is subjected to well-known copolymerizing processes, such as suspension polymerization. Examples of a polymerizing monomer include a styrene type monomer or an acrylic type monomer. An example of a styrene type monomer is styrene. Examples of acrylic type monomers are acrylic acid, alkyl (C1-C4) acrylate, and alkyl (C1-C4) metaacrylate. Because the polymerization toner has such an excellent fluidity characteristic, image development is reliably performed so that high-quality images can be formed.

Materials such as wax and a coloring agent are distributed in the toner. The coloring agent can be carbon black, for example. In addition, external additive, such as silica, are added in the toner to further improve the fluidity characteristic. The toner has a particle diameter of about 6-10 μm.

The rotation shaft 35 is disposed in the center of the toner hopper 34. An agitator 36 and a cleaner 39 are supported on the rotation shaft 35. The agitator 36 agitates the toner in the toner hopper 34 and discharges the toner through the toner supply opening 37 that is opened through the side wall of the toner hopper 34. Windows 38 are formed in the end walls that define the lengthwise ends of the toner hopper 34. The windows 38 are used to detect the amount of toner remaining in the toner hopper 34. The cleaner 39 cleans the windows 38 as the agitator 36 rotates.

The supply roller 33 is located on the side of the toner supply opening 37. The developing roller 31 is located confronting the supply roller 33. The supply roller 33 and the developing roller 31 are rotatable in the counterclockwise direction. The supply roller 33 and the developing roller 31 are disposed in abutment contact with each other so that both are compressed to a certain extent.

The supply roller 33 includes a metal roller shaft covered with a roller formed from an electrically conductive sponge material.

The developer roller 31 includes a metal roller shaft and a roller portion covered thereon. The roller portion is made from a elastic member formed from a conductive rubber material. In more specific terms, the roller portion of the developing roller 31 is made from conductive silicone rubber or urethane rubber including, for example, carbon particles. The surface of the roller portion is covered with a coating layer of silicone rubber or urethane rubber that contains fluorine. The developing roller 31 is applied with a developing bias.

The layer thickness regulating blade 32 is disposed near the developing roller 31. The layer thickness regulating blade 32 includes a blade made from a metal leaf spring, and has a pressing member 40, that is provided on a free end of the blade. The pressing member 40 has a semi-circular shape when viewed in cross section. The pressing member 40 is formed from silicone rubber with electrically insulating properties. The layer thickness regulating blade 32 is supported by the developing cartridge 28 at a location near the developing roller 31. The resilient force of the blade presses the pressing member 40 against the surface of the developing roller 31.

Then rotation of the supply roller 33 supplies the developing roller 31 with the toner that has been discharged through the toner supply opening 37. At this time, the toner is triboelectrically charged to a positive charge between the supply roller 33 and the developing roller 31. Then, as the developing roller 31 rotates, the toner supplied onto the developing roller 31 moves between the developing roller 31 and the pressing member 40 of the layer thickness regulating blade 32. This reduces thickness of the toner on the surface of the developing roller 31 down to a thin layer of uniform thickness.

The photosensitive drum 27 is disposed to the side of and in confrontation with the developing roller 31. The photosensitive drum 27 is supported on the lower frame 511 and is rotatable in the clockwise direction (direction shown by the arrow). The photosensitive drum 27 includes a drum-shaped member and a surface layer. The surface layer is formed on the drum-shaped member from a photosensitive layer that is made from polycarbonate.

The Scorotron charge unit 29 is supported on the upper frame 512 at a position above the photosensitive drum 27 but separated a predetermined distance therefrom so as not to contact the same. The Scorotron charge unit 29 is also positioned upstream of the developing roller 31 and downstream of the transfer roller 30 described later with respect to the rotating direction of the photosensitive drum 27. The Scorotron charge unit 29 is a positive charging Scorotron charger having a charging wire formed of tungsten or the like from which a corona discharge is generated for applying a uniform charge of positive polarity across the entire surface 27S of the photosensitive drum 27.

As will be described later, the brush unit 52 is supported between the lower frame 511 and upper frame 512 in opposition to the photosensitive drum 27. The brush unit 52 is positioned to the side of the photosensitive drum 27 (the side opposite the developing roller 31) and is upstream of the Scorotron charge unit 29 and downstream of the transfer roller 30 with respect to the rotating direction of the photosensitive drum 27.

The brush unit 52 includes a brush 54 and a brush holder 55 for supporting the brush 54. The brush 54 is provided with a brush member 53 formed of multiple bristles whose tips contact the surface 27S of the photosensitive drum 27. In a cleaning operation, a power source (not shown) disposed in the main casing 2 applies a cleaning bias to the brush member 53 via an electrode 56 described later (see FIG. 5).

The transfer roller 30 is disposed below the photosensitive drum 27 and in opposition thereto and is upstream of the brush unit 52 and downstream of the developing roller 31 in the rotating direction of the photosensitive drum 27. The transfer roller 30 is supported on the lower frame 511 so as to be capable of rotating in the direction of the arrow (counterclockwise direction in FIGS. 1 and 2).

The scorotoron charge unit 29 forms a blanket of positive charge on the surface 27S of the photosensitive drum 27 as the photosensitive drum 27 rotates. Then, the surface 27S of the photosensitive drum 27 is exposed to high speed scan of the laser beam from the scanner section 16. The electric potential of the positively charged surface 27S of the photosensitive drum 27 drops at positions exposed to the laser beam. As a result, an electrostatic latent image is formed on the photosensitive drum 27 based on desired image data used to drive the laser beam.

Next, an inverse developing process is performed. That is, as the developing roller 31 rotates, the positively-charged toner borne on the surface of the developing roller 31 is brought into contact with the photosensitive drum 27. At this time, the toner on the developing roller 31 is supplied to lower-potential areas of the electrostatic latent image on the photosensitive drum 27. As a result, the toner is selectively borne on the photosensitive drum 27 so that the electrostatic latent image is developed into a visible toner image.

Thereafter, the visible toner image borne on the surface 27S of the photosensitive drum 27 is transferred to a sheet 3 according to the transfer bias applied to the transfer roller 30 as the sheet 3 passes between the photosensitive drum 27 and the transfer roller 30.

In the laser printer 1, residual toner which is left on the surface 27S of the photosensitive drum 27 after a transfer to the sheet 3 is recovered by the developing roller 31. That is, the residual toner is recovered using a so-called cleanerless method. By recovering the residual toner using the cleanerless method, a toner cleaning device and a used-toner reservoir become unnecessary, which simplifies the construction of the device.

Paper dust can become deposited on the surface 27S of the photosensitive drum 27 during the transfer operation when the photosensitive drum 27 contacts the paper 3. As the photosensitive drum 27 continues to rotate after transferring an image, the brush member 53 contacting the surface 27S of the photosensitive drum 27 removes the deposited paper dust therefrom. At the same time, a cleaning bias is applied to the brush member 53 to electrically attract the paper dust.

As shown in FIG. 1, the fixing section 18 is disposed downstream from the process cartridge 17 and includes a heat roller 41, a pressing roller 42, and transport rollers 43. The pressing roller 42 presses against the heat roller 41. The transport rollers 43 are provided downstream from the heat roller 41 and the pressing roller 42. The heat roller 41 includes a metal tube and a halogen lamp disposed therein. The halogen lamp heats up the metal tube so that toner that has been transferred onto sheet 3 in the process cartridge 17 is thermally fixed onto the sheet 3 as the sheet 3 passes between the heat roller 41 and the pressing roller 42. Afterward, the sheet 3 is transported to a sheet-discharge path 44 by the transport rollers 43 and discharged onto a sheet-discharge tray 46 by sheet-discharge rollers 45.

The laser printer 1 is further provided with an inverting transport unit 47 for inverting sheets 3 that have been printed on once and for returning the sheets 3 to the image forming unit 5 so that images can be formed on both sides of the sheets 3. The inverting transport unit 47 includes the sheet-discharge rollers 45, an inversion transport path 48, a flapper 49, and a plurality of inversion transport rollers 50.

The sheet-discharge rollers 45 are a pair of rollers that can be rotated selectively forward or in reverse. The sheet-discharge rollers 45 are rotated forward to discharge sheets 3 onto the sheet-discharge tray 46 and rotated in reverse when sheets are to be inverted.

The inversion transport rollers 50 are disposed below the image forming unit 5. The inversion transport path 48 extends vertically between the sheet-discharge rollers 45 and the inversion transport rollers 50. The upstream end of the inversion transport path 48 is located near the sheet-discharge rollers 45 and the downstream end is located near the inversion transport rollers 50 so that sheets 3 can be transported downward from the sheet-discharge rollers 45 to the inversion transport rollers 50.

The flapper 49 is swingably disposed at the junction between the sheet-discharge path 44 and the inversion transport path 48. By activating or deactivating a solenoid (not shown), the flapper 49 can be selectively swung between the orientation shown in broken line and the orientation shown by solid line in FIG. 1. The orientation shown in solid line in FIG. 1 is for transporting sheets 3 that have one side printed to the sheet-discharge rollers 45. The orientation shown in broken line in FIG. 1 is for transporting sheets from the sheet-discharge rollers 45 into the inversion transport path 48, rather than back into the sheet-discharge path 44.

The inversion transport rollers 50 are aligned horizontally at positions above the sheet supply tray 6. The pair of inversion transport rollers 50 that is farthest upstream is disposed near the rear end of the inversion transport path 48. The pair of inversion transport rollers 50 that is located farthest downstream is disposed below the registration rollers 12.

The inverting transport unit 47 operates in the following manner when a sheet 3 is to be formed with images on both sides. A sheet 3 that has been formed on one side with an image is transported by the transport rollers 43 from the sheet-discharge path 44 to the sheet-discharge rollers 45. The sheet-discharge rollers 45 rotate forward with the sheet 3 pinched therebetween until almost all of the sheet 3 is transported out from the laser printer 1 and over the sheet-discharge tray 46. The forward rotation of the sheet-discharge rollers 45 is stopped once the rear-side end of the sheet 3 is located between the sheet-discharge rollers 45. Then, the sheet-discharge rollers 45 are driven to rotate in reverse while at the same time the flapper 49 is switched to change transport direction of the sheet 3 toward the inversion transport path 48. As a result, the sheet 3 is transported into the inversion transport path 48. The flapper 49 reverts to its initial position once transport of the sheet 3 to the inversion transport path 48 is completed. That is, the flapper 49 switches back to the position for transporting sheets from the transport rollers 43 to the sheet-discharge rollers 45.

Next, the inverted sheet 3 is transported through the inversion transport path 48 to the inversion transport rollers 50 and then upward from the inversion transport rollers 50 to the registration rollers 12. The registration rollers 12 align the front edge of the sheet 3. Afterward, the sheet 3 is transported toward the image formation position. At this time, the upper and lower surfaces of the sheet 3 are reversed from the first time that an image has been formed on the sheet 3 so that an image can be formed on the other side as well. In this way, images are formed on both sides of the sheet 3.

In the laser printer 1 having this construction, the brush unit 52 of the process cartridge 17 has the brush 54 for removing paper dust from the surface 27S of the photosensitive drum 27, and the brush holder 55 for supporting the brush 54 against the photosensitive drum 27, as described above. Next, this brush unit 52 provided with the brush 54 and brush holder 55 will be described with reference to FIGS. 3 and 4.

Figure 3:
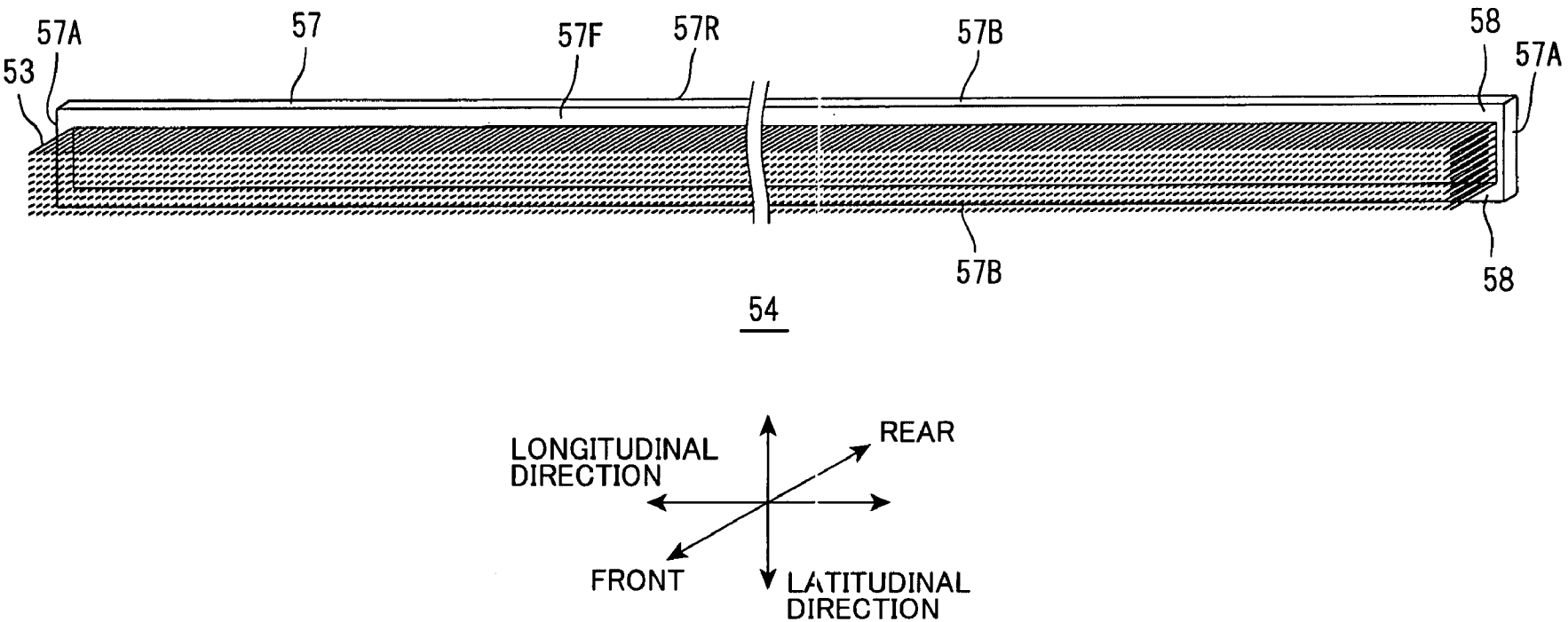
FIG. 3 is a perspective view showing a brush employed in the process cartridge of FIG. 2.

As shown in FIG. 3, the brush 54 includes a base member 57, and the brush member 53 provided on the surface of this base member 57.

The base member 57 is formed of a conductive synthetic resin and is shaped substantially like a long slender rectangle. More specifically, the base member 57 has an elongated plate shape that extends in the longitudinal direction. The base member 57 has: a front surface 57F that extends in the longitudinal direction and confronts the photosensitive drum 27; a rear surface 57R opposite to the front surface 57F; longitudinal end surfaces 57A at both ends in the longitudinal direction; and latitudinal end surfaces 57B at both ends in the latitudinal direction. The multiple bristles are provided on the front surface 57F of the base member 57 and extend in a direction substantially perpendicular to the front surface 57F.

The brush member 53 is formed of numerous conductive bristles implanted in the front surface 57F of the base member 57. The brush member 53 is disposed along the length of the base member 57 separated a predetermined distance in the latitudinal (width) direction from both edges in the latitudinal (width) direction, which is substantially orthogonal to the longitudinal (length) direction of the base member 57 (hereinafter also referred to as latitudinal direction and longitudinal direction, respectively). Accordingly, margins extending longitudinally are formed on the latitudinal edges of the base member 57. These margins are mounting portions 58 for supporting the brush 54 on the brush holder 55. Hence, the two mounting portions 58 are formed longitudinally on the front surface 57F of the base member 57 at the latitudinal edges, while the brush member 53 is formed longitudinally between the two mounting portions 58.

Figure 4:
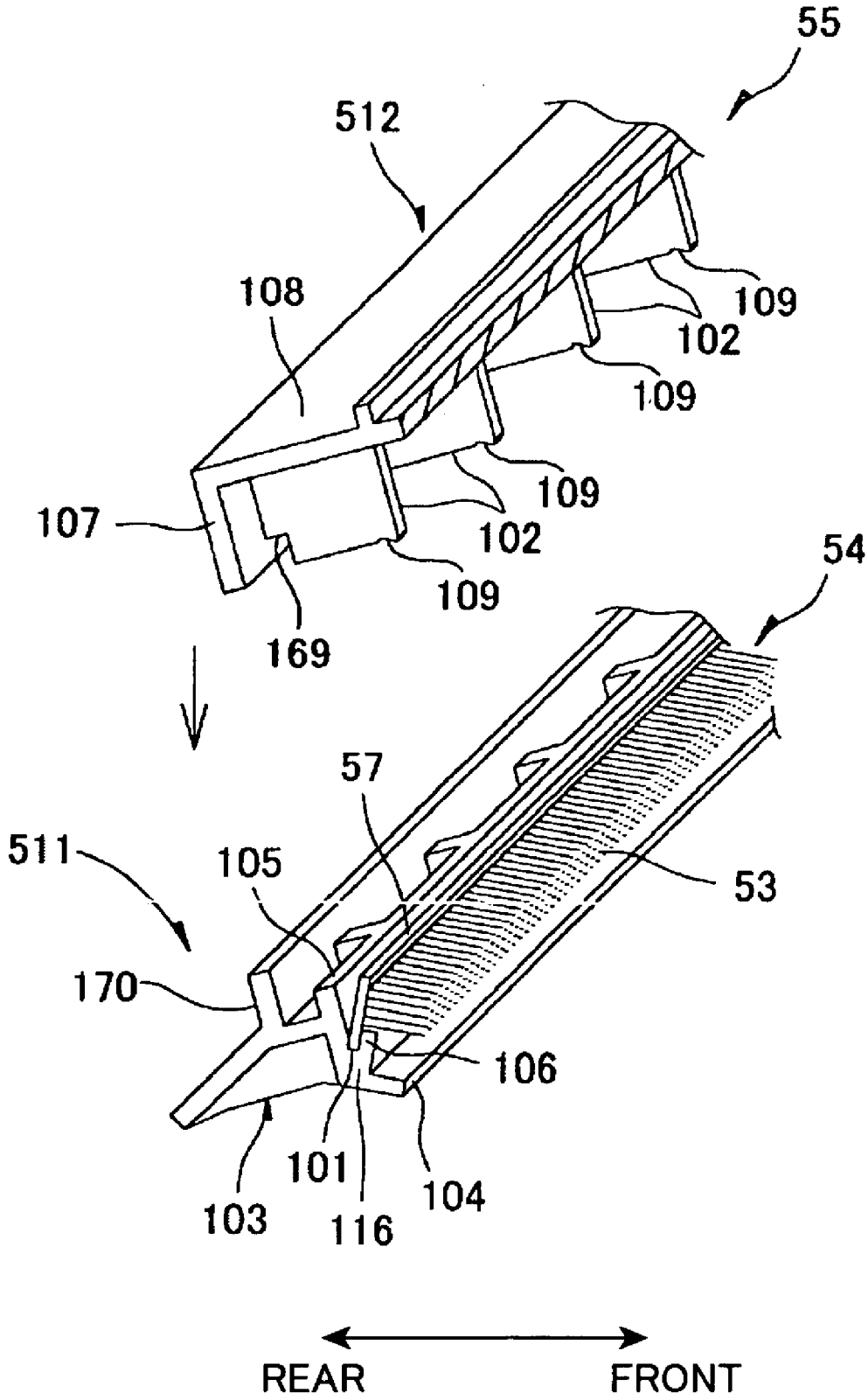
FIG. 4 is a perspective view showing the relevant parts of a brush holder in the process cartridge of FIG. 2.

As shown in FIG. 4, the brush holder 55 is configured of a recessed portion 101 formed in the lower frame 511 as a first holding portion, and a plurality of ribs 102 provided on the upper frame 512 as a second holding portion.

The recessed portion 101 is formed in a frame end 103 of the lower frame 511 at a position to the side of the photosensitive drum 27 (opposite the side of the developing roller 31) and separated a predetermined distance therefrom.

More specifically, the frame end 103 is integrally configured of a tongue part 104 formed in a substantially long rectangular shape extending parallel to the axis of the photosensitive drum 27 and protruding near the surface of the same; and a base part 116 provided along the entire length of the tongue part 104 on the base edge thereof. Here, the base edge of the tongue part 104 is the side edge furthest from the photosensitive drum 27. Here, the side of the brush unit 52 furthest from the photosensitive drum 27 will be referred to as the rear side and the side nearest the photosensitive drum 27 the front side. The base part 116 is integrally formed of a first slanted part 105 and a second slanted part 106 extending along the entire length of the base part 116 and slanting upward to form a V shape in the cross-section. The recessed portion 101 is formed in the gap between the first slanted part 105 and second slanted part 106. The recessed portion 101 receives the mounting portion 58 provided on the bottom side of the base member 57, fitting over and gripping this mounting portion 58 along the entire length of the base member 57.

The second slanted part 106 provided on the front side is formed lower than the first slanted part 105 so as not to contact the brush member 53 when the mounting portion 58 of the base member 57 is received in the recessed portion 101.

Farther behind the first slanted part 105, a protruding wall 170 protrudes upward from the rear side of the lower frame 511 for fitting over a step part 169 described later. The protruding wall 170 is integrally formed with the frame end 103.

In the upper frame 512, the ribs 102 are arranged parallel to one another at predetermined intervals along the axis of the photosensitive drum 27. When the upper frame 512 is assembled on the lower frame 511, the ribs 102 confront the frame end 103 of the lower frame 511.

More specifically, the upper frame 512 is integrally configured of a side wall 107 extending vertically, and a top wall 108 extending from the top edge of the side wall 107 toward the front in a direction substantially orthogonal to the vertical. Each of the ribs 102 has a substantially rectangular shape and is formed integrally with the upper frame 512 in a plane orthogonal to the side wall 107 and top wall 108. Contact parts 109 are formed in the bottom edge of each rib 102 near the front end. When the upper frame 512 is assembled on the lower frame 511, the contact parts 109 contact the edge surface of the mounting portion 58 formed on the upper side of the base member 57 already fitted into the recessed portion 101. Further, the step parts 169 mentioned above are formed in the bottom edge of each rib 102 near the rear side for fitting over the protruding wall 170 of the frame end 103.

The electrode 56 mentioned earlier is also connected to the brush 54 for applying a cleaning bias thereto.

Figure 5A:
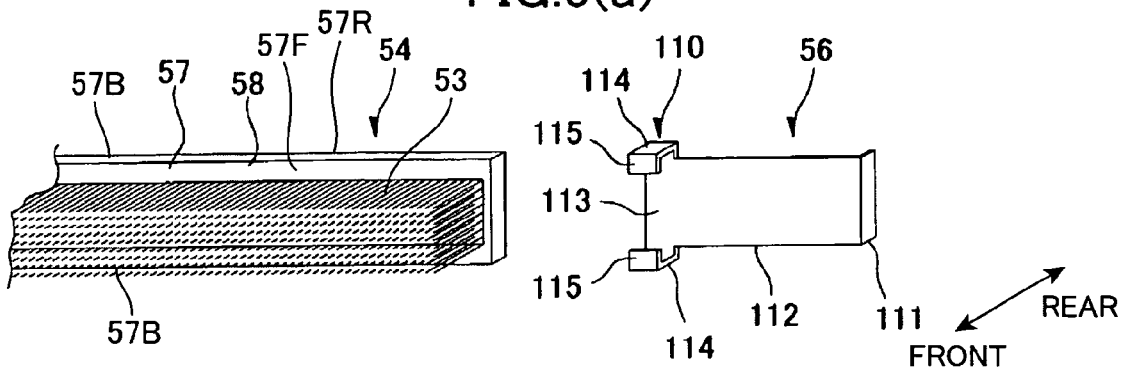
FIG. 5(*a*) is a perspective view showing an electrode prior to being mounted on the brush of FIG. 3.
Figure 5B:
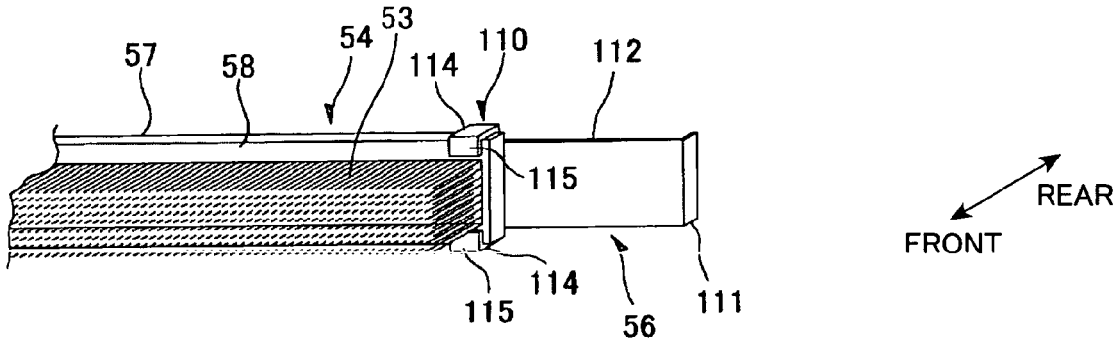

As shown in FIG. 5(*a*), the electrode 56 is formed through a process of bending a substantially T-shaped thin metal plate. The electrode 56 is integrally configured of a mounting part 110 for mounting the electrode 56 onto the base member 57 of the brush 54; a terminal part 111 for connecting to a main casing terminal part (not shown) provided inside the main casing 2; and an elongated connecting part 112 connecting the mounting part 110 and terminal part 111.

The mounting part 110 has a cross-sectional shape similar to the letter C and includes an rear surface contact part 113 for contacting the rear surface 57R of the base member 57 (opposite the front surface 57F on which the brush member 53 is provided); end surface contact parts 114 for contacting both latitudinal end surfaces 57B of the base member 57; and front surface contacting parts 115 for contacting the mounting portions 58 on the front surface 57F of the base member 57.

The rear surface contact part 113 is formed continuously with one longitudinal end of the connecting part 112 and expands slightly farther outward than both latitudinal edges of the connecting part 112.

The end surface contact part 114 is formed continuously with both edges of the rear surface contact part 113 in the latitudinal direction. The end surface contact parts 114 are bent forward from both edges of the rear surface contact part 113 and extend in a direction substantially perpendicular to the rear surface contact part 113 so as to confront one another across the rear surface contact part 113. The distance between the confronting end surface contact parts 114 is set nearly identical to the width (in the latitudinal direction) of the base member 57.

The front surface contacting parts 115 are formed continuously with the front edges of the end surface contact parts 114. The front surface contacting parts 115 are bent inward from the front edges of the end surface contact part 114 along the latitudinal direction of the connecting part 112 and extend at a near right angle to the end surface contact parts 114. The front surface contacting parts 115 confront the rear surface contact part 113 and are separated from the same by a distance nearly equal to the thickness of the base member 57. The front surface contacting parts 115 also confront one another in the latitudinal direction of the connecting part 112 and are separated by a distance slightly larger than the width of the brush member 53 so as to contact the mounting portion 58 of the base member 57.

The terminal part 111 is formed continuously with the opposite end of the connecting part 112 in the longitudinal direction (opposite the end on which the mounting part 110 is provided) and is bent from this end toward the rear direction.

As shown in FIG. 5(*b*), the electrode 56 is mounted on one end of the base member 57 by inserting the end of the base member 57 into the mounting part 110 so that the brush member 53 of the brush 54 passes between the confronting front surface contacting parts 115. In this state, the rear surface contact part 113 contacts the rear surface 57R of the base member 57; the end surface contact parts 114 contact both latitudinal end surfaces 57B of the base member 57; and the front surface contacting parts 115 contact the mounting portions 58 on the front surface 57F of the base member 57.

Through this process, the electrode 56 can be mounted on one longitudinal end of the base member 57 so that the mounting part 110 (rear surface contact part 113, end surface contact parts 114, and front surface contacting parts 115) reliably contact the base member 57. Accordingly, a cleaning bias can reliably be applied to the brush member 53 through a simple construction.

When the process cartridge 17 is mounted in the main casing 2, the main casing terminal unit (not shown) connected to a cleaning bias power source (not shown) contacts the terminal part 111 of the electrode 56. As will be described later, when the upper frame 512 is assembled onto the lower frame 511, the cleaning bias applied from the cleaning bias power source is transferred via the main casing terminal unit, the electrode 56, and the conductive mounting portions 58 and applied to the brush member 53.

The following is a description of how the brush 54 is supported on the brush holder 55 when the electrode 56 is mounted on the brush 54.

Referring to FIG. 2, one of the mounting portions 58 on the base member 57 is fitted into the recessed portion 101 of the lower frame 511 from above. Next, the upper frame 512 is assembled on the lower frame 511, causing the contact parts 109 to contact the other mounting portion 58 of the base member 57 almost simultaneously and press the mounting portion 58 toward the lower frame 511. As a result, the base member 57 is interposed between the recessed portion 101 and the ribs 102, and the brush 54 is supported on the brush holder 55, which is configured of the recessed portion 101 and ribs 102. Further, since the protruding wall 170 of the frame end 103 fits into the step part 169 of the upper frame 512 at this time, the lower frame 511 is reliably positioned with respect to the upper frame 512.

When the brush 54 is supported in the brush holder 55, the mounting portions 58 provided on both latitudinal sides of the base member 57 are held by the recessed portion 101 and the ribs 102. Accordingly, an accurate positioning of the brush 54 can be achieved without increasing the size of the base member 57, thereby disposing the brush 54 suitably in relation to the photosensitive drum 27 to facilitate the brush 54 in efficiently recovering paper dust and the like deposited on the surface 27S of the photosensitive drum 27. Further, by forming a smaller brush 54, it is possible to form a more compact device and to reduce such inconveniences as replacement operations for the brush 54.

Further, by fitting one of the mounting portions 58 in the recessed portion 101, this mounting portion 58 can be reliably held by the recessed portion 101. The other mounting portion 58 can be reliably held by pressure from the ribs 102. Hence, the brush 54 can be reliably supported through a simple construction of the recessed portion 101 and ribs 102.

Further, when the brush 54 is supported on the brush holder 55 in this way, one of the mounting portions 58 is simultaneously held in the recessed portion 101 across the entire length of the brush 54, while the other mounting portion 58 can be held simultaneously by the ribs 102 across the entire length. Accordingly, the brush 54 can easily be supported on the brush holder 55, facilitating replacement operations for the brush 54 and the like.

Moreover, the brush 54 can be reliably supported on the brush holder 55 through the simple operation of assembling the frame 51, entailing mounting the upper frame 512 on the lower frame 511, thereby facilitating replacement operations for the brush 54 and the like and further reducing inconveniences.

Since the laser printer 1 of the present embodiment is provided with the process cartridge 17 that is capable of reducing the size of the device and lightening the user's load in replacement operations for the brush 54 and the like, the present embodiment can produce a more compact device and facilitate maintenance.

Figure 6:
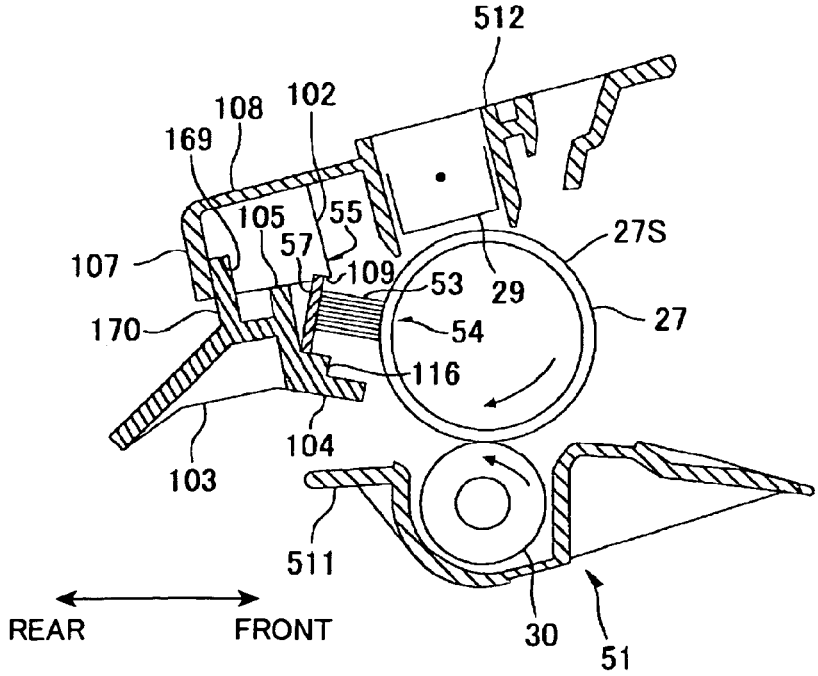
FIG. 6 is a side cross-sectional view showing the relevant parts of a brush holder according to a second embodiment of the present invention, wherein the mounting portion is not retained in a recessed portion.

Next, a brush holder 55 according to a second embodiment will be described with reference to FIG. 6. FIG. 6 is a side cross-sectional view showing the brush holder 55 according to the second embodiment, wherein like parts and components are designated by the same reference numerals to avoid duplicating description.

In the brush holder 55 shown in FIG. 6, the base part 116 of the lower frame 511 is not provided with the second slanted part 106. Accordingly, the recessed portion 101 shown in FIG. 2 is not formed in the lower frame 511, and the base part 116 serves as the first holding portion for holding one of the mounting portions 58 of the base member 57. The brush 54 is supported as described below.

First, one of the mounting portions 5B of the base member 57 is placed in contact with the top surface of the base part 116. Next, while this mounting portion 58 is in contact with the top surface of the base part 116, the upper frame 512 is assembled on the lower frame 511, causing the contact parts 109 formed in the ribs 102 to contact the other mounting portion 58 of the base member 57 almost simultaneously so that the ribs 102 press the other mounting portion 58 toward the lower frame 511. Accordingly, the base member 57 is interposed between the base part 116 and the ribs 102; the free end of the brush member 53 contacts the surface 27S of the photosensitive drum 27; and the brush 54 is supported from three directions by the base part 116, ribs 102, and photosensitive drum 27.

Even when supported from three directions in this way, the brush 54 can be supported in a stable state by the base part 116, ribs 102, and photosensitive drum 27 and can therefore achieve the same effects as the brush holder 55 shown in FIG. 4.

Moreover, by eliminating the second slanted part 106, it is possible to achieve reliable support of the brush 54 through an even simpler construction.

Next, a brush holder 55 according to a third embodiment of the present invention will be described with reference to FIGS. 7 to 9(*b*), wherein like parts and components are designated by the same reference numerals to avoid duplicating description.

Figure 7:
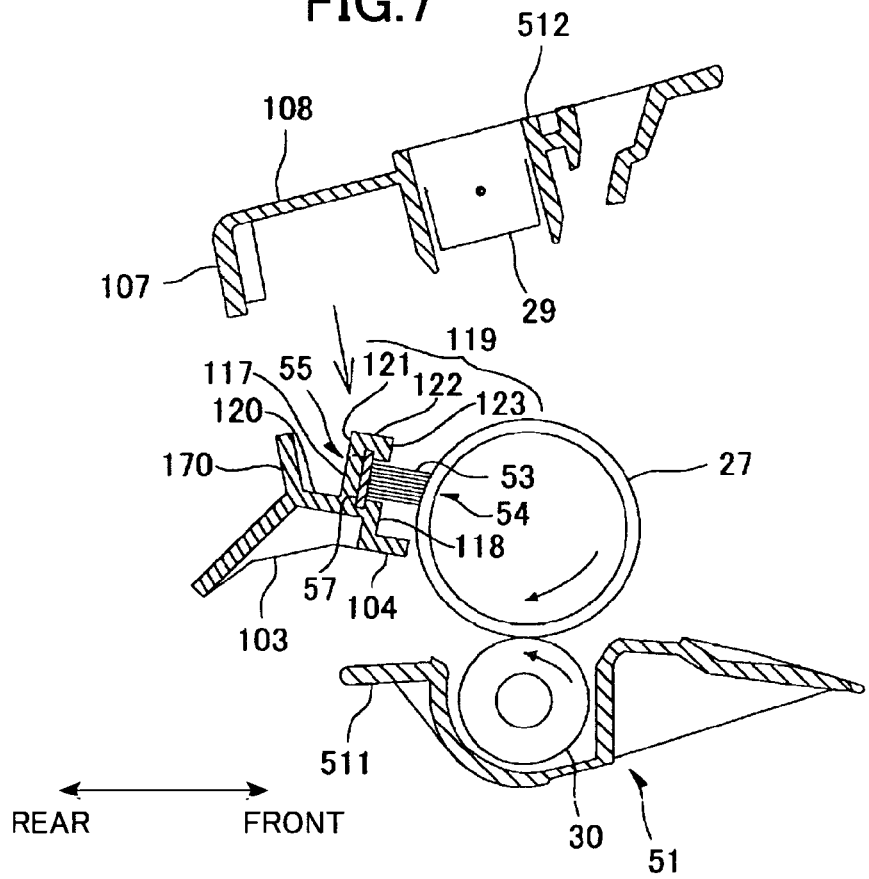
FIG. 7 is an exploded side cross-sectional view showing a brush holder according to a third embodiment of the present invention, wherein the brush holder is integrally provided on the lower frame.
Figure 8:
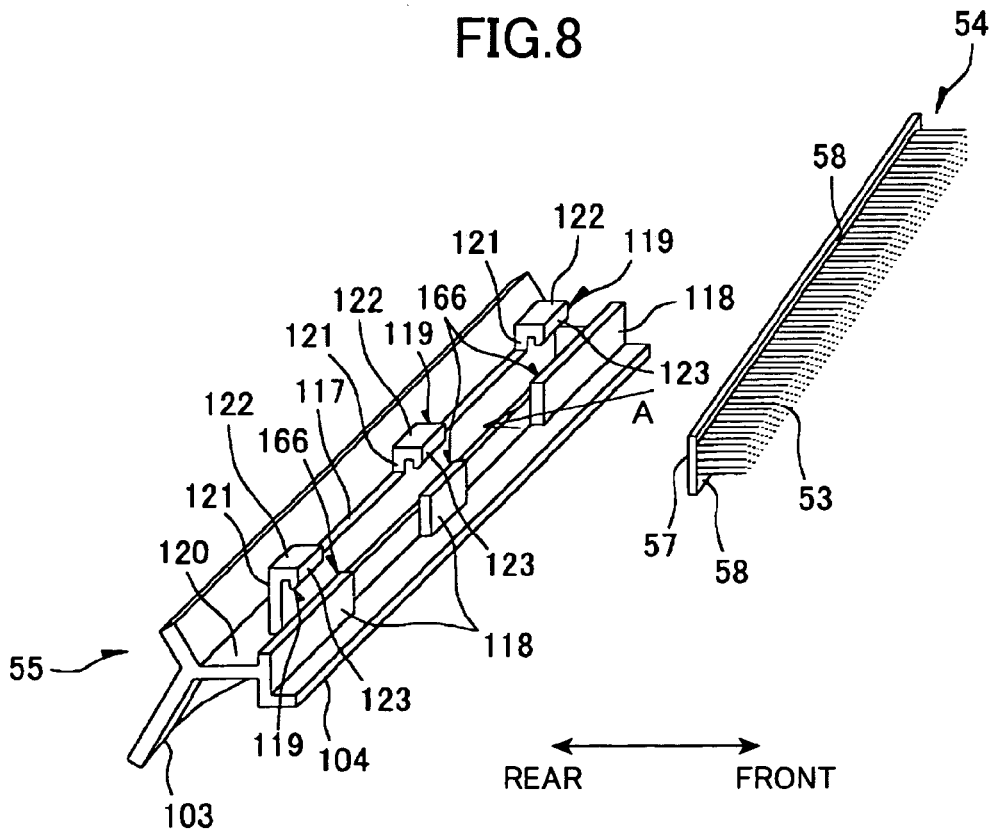
FIG. 8 is a perspective view showing the relevant parts of the brush holder in FIG. 7.

The brush holder 55 shown in FIGS. 7 and 8 is integrally formed with the frame end 103 of the lower frame 511 and includes a support plate 117, three front surface confronting plates 118, and three pawls 119. As shown in FIGS. 7 and 8, the ribs 102 are not formed on the upper frame 512.

The support plate 117 is substantially rectangular in shape and elongated in the longitudinal direction of the tongue part 104. An upper step part 120 is formed a level higher than the tongue part 104. The support plate 117 is provided along the length of the upper step part 120 protruding upward therefrom.

The three front surface confronting plates 118 are disposed along the base end of the tongue part 104, protruding upward and separated at predetermined intervals from each other in the longitudinal direction of the tongue part 104. The centrally disposed front surface confronting plate 118 is shorter in the longitudinal direction than the front surface confronting plates 118 disposed on either side. Further, each of the front surface confronting plates 118 protrudes higher than the upper step part 120 and is separated from the support plate 117 at a predetermined distance. With this construction, a recessed part 166 is formed between the support plate 117 and the front surface confronting plates 118 for fitting over one of the mounting portions 58.

The three pawls 119 are provided on the top edge of the support plate 117 at predetermined intervals in the longitudinal direction of the support plate 117 and at positions corresponding to the three front surface confronting plates 118.

Each of the pawls 119 has a cross-section forming three sides of a box and integrally configured of a support part 121 extending upward from the top edge of the support plate 117; a connecting part 122 extending forward from the top edge of the support part 121; and a pawl part 123 disposed on the front edge of the connecting part 122 and confronting the top edge of the front surface confronting plate 118. A predetermined gap is formed between the bottom edge of the pawl part 123 and the top edge of the front surface confronting plate 118. Further, each pawl 119 is elastic or resilient and can deform to expand the gap between the bottom edge of the pawl part 123 and the top edge of the front surface confronting plate 118.

The tip of the pawl part 123 tapers to form a substantially triangular cross-section.

Figure 9A:
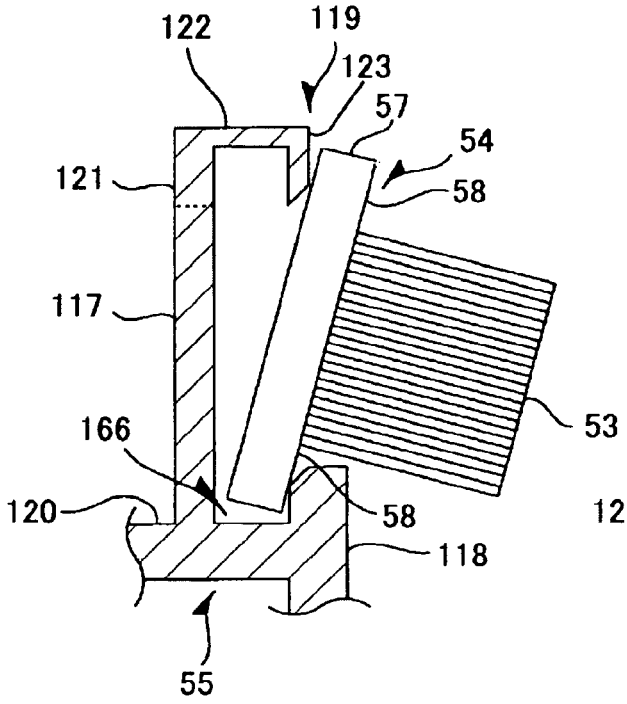
FIG. 9(*a*) is a cross-sectional view of the brush holder in FIG. 7 as the brush is being mounted therein.
Figure 9B:
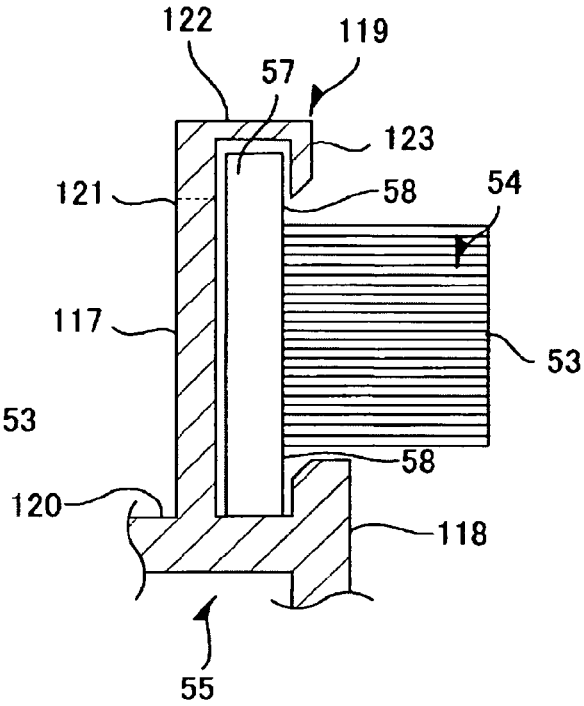

With the brush holder 55 having this construction, as shown in FIG. 9(*a*), one of the mounting portions 58 on the base member 57 is fitted into the recessed part 166 (between the support plate 117 and front surface confronting plates 118) so that the base member 57 contacts the pawl part 123 of the pawl 119. By pressing the base member 57 on the side nearest the photosensitive drum 27 against the pawl part 123 rearward toward the support plate 117 (a direction A in FIG. 8), the pawl 119 elastically deforms so that the other mounting portion 58 on the base member 57 is guided along the tip of the pawl part 123 and received between the support part 121 and pawl part 123 of the pawl 119.

As shown in FIG. 9(*b*), when the other mounting portion 58 is received between the support part 121 and pawl part 123, the pawl 119 is restored to its original form and thus retains the mounting portion 58 in an engaged state in the pawl 119. Accordingly, the other mounting portion 58 is held by the three pawls 119.

In this way, the first mounting portion 58 can be held reliably by the recessed part 166, while the other mounting portion 58 can be held by the three pawls 119. Hence, reliable support of the brush 54 can be achieved through a simple construction of the recessed part 166 and the three pawls 119.

Moreover, when the first mounting portion 58 is engaged in the recessed part 166, the brush 54 can be mounted in the brush holder 55 through a simple operation of pressing the base member 57 on the side facing the photosensitive drum 27 toward the pawls 119 to fit the other mounting portion 58 in the pawls 119. Hence, the operation of mounting the brush 54 in the brush holder 55 can be simplified through a simple construction of the recessed part 166 and the three pawls 119. Hence, the present embodiment can further facilitate replacement operations for the brush 54 and the like.

Further, the brush holder 55 is integrally provided with the lower frame 511 that supports the photosensitive drum 27, and the brush 54 is supported on the brush holder 55. Hence, this construction reduces the number of required parts and can more accurately dispose the brush 54 in relation to the photosensitive drum 27. As a result, the brush 54 can more efficiently recover paper dust and the like that has been deposited on the surface 27S of the photosensitive drum 27.

While the brush holder 55 in the present embodiment includes three front surface confronting plates 118 and three pawls 119, the number of these components is not limited to three. An appropriate number may be selected based on the length of the base member 57 and the like.

Figure 10:
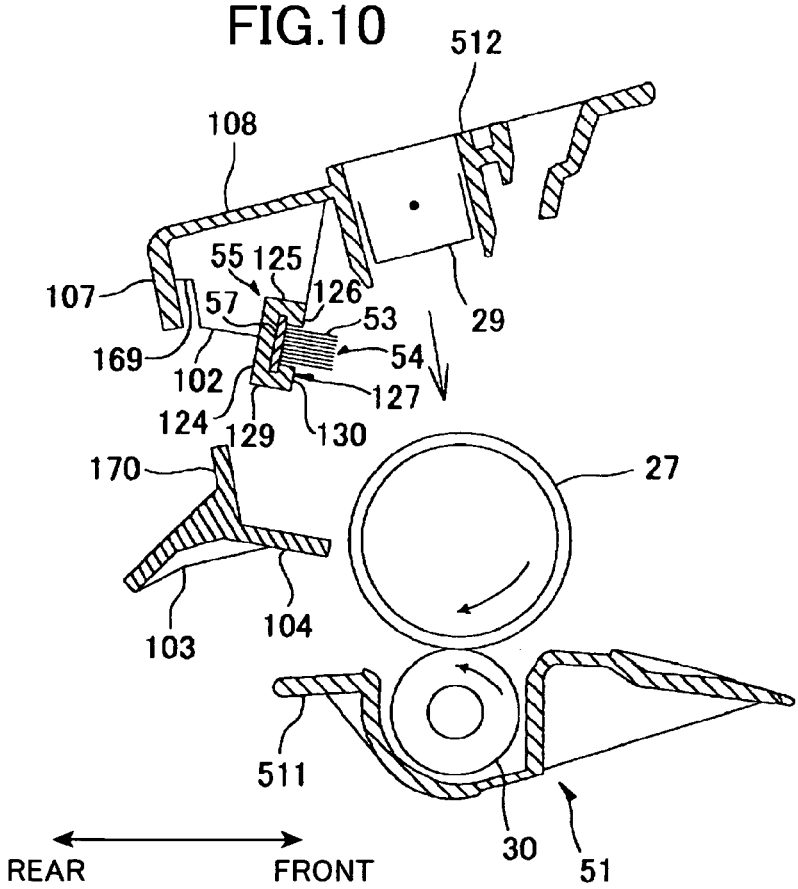
FIG. 10 is an exploded side cross-sectional view showing a brush holder according to a fourth embodiment of the present invention, wherein the brush holder is integrally provided on the upper frame.
Figure 11:
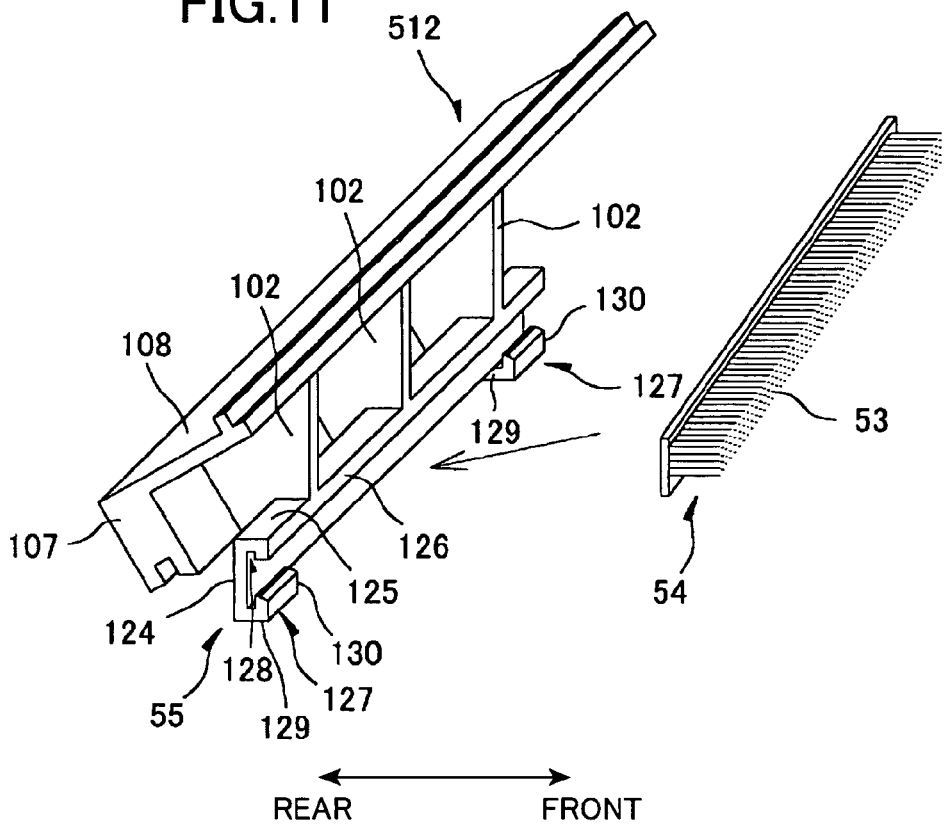
FIG. 11 is a perspective view showing the relevant parts of the brush holder in FIG. 10.

Next, a brush holder 55 according to a fourth embodiment of the present invention will be described with reference to FIGS. 10 and 11, wherein like parts and components are designated with the same reference numerals to avoid duplicating description. FIG. 10 is a side cross-sectional view showing the brush holder 55 according to the fourth embodiment. FIG. 11 is a perspective view of the brush holder 55 shown in FIG. 10.

In FIGS. 10 and 11, the brush holder 55 is integrally provided with the ribs 102 of the upper frame 512. The brush holder 55 includes a support plate 124, and end surface confronting plate 125, a front surface confronting plate 126, and two pawls 127.

The support plate 124 is formed substantially like a long thin rectangular plate extending parallel to the axis (longitudinal direction) of the photosensitive drum 27. The support plate 124 is disposed across the plurality of ribs 102 so as to confront the photosensitive drum 27.

The end surface confronting plate 125 is formed substantially as a long thin rectangular plate that extends parallel to the axis of the photosensitive drum 27. The end surface confronting plate 125 extends forward from the top edge of the support plate 124.

The front surface confronting plate 126 also has a long slender rectangular plate shape that extends parallel to the axis of the photosensitive drum 27. The front surface confronting plate 126 protrudes downward from the front edge of the end surface confronting plate 125.

In a cross-section, the support plate 124, end surface confronting plate 125, and front surface confronting plate 126 form three sides of a box. The front surface confronting plate 126 confronts the support plate 124 and is separated a predetermined distance therefrom so as to form a recessed part 128 between the support plate 124 and front surface confronting plate 126.

The pawls 127 are provided on the lower edge of the support plate 124 at both longitudinal ends.

Each pawl 127 is formed with a substantially L-shaped cross-section and includes a support part 129 confronting the end surface confronting plate 125, and a pawl part 130 confronting the support plate 124. The pawl 127 is elastically deformable, enabling a gap between the pawl part 130 and the top edge of the front surface confronting plate 126 to expand.

The tip of the pawl part 130 is tapered to form a substantially triangular shaped cross-section.

With this brush holder 55, one of the mounting portions 58 on the base member 57 is fitted into the recessed part 128 formed between the support plate 124 and front surface confronting plate 126 so that the base member 57 contacts the pawl parts 130 of the pawls 127. By pressing the base member 57 against the pawl part 130 from the side facing the photosensitive drum 27 toward the support plate 124, the pawls 127 elastically deform, enabling the other mounting portion 58 on the base member 57 to be guided by the tip of the pawl part 130 and received on the support parts 129 between the support plate 124 and the pawl parts 130. After the mounting portion 58 has been received on the support parts 129 between the support plate 124 and the pawl parts 130, the pawls 127 return to their original shape and thus function to engage and hold the other mounting portion 58. In this way, the other mounting portion 58 of the base member 57 is retained by the two pawls 127.

With this construction, the first mounting portion 58 of the base member 57 can be held reliably by the recessed part 128, while the other mounting portion 58 can be held by the pawls 127. Accordingly, reliable support of the brush 54 is achieved through the simple construction of the recessed part 128 and the two pawls 127.

Moreover, when the first mounting portion 58 is fitted into the recessed part 128, the brush 54 can be mounted on the brush holder 55 through a simple operation of pushing the base member 57 against the pawls 127 from the side confronting the photosensitive drum 27 and fitting the other mounting portion 58 into the pawls 127. Hence, the simple construction of the recessed part 128 and pawls 127 can facilitate operations for mounting the brush 54 in the brush holder 55, thereby further simplifying replacement operations for the brush 54 and the like.

While the brush holder 55 in the present embodiment described above includes two pawls 127, the number of pawls 127 is not limited to this number but may be selected to suit the length of the base member 57 and the like.

Figure 12:
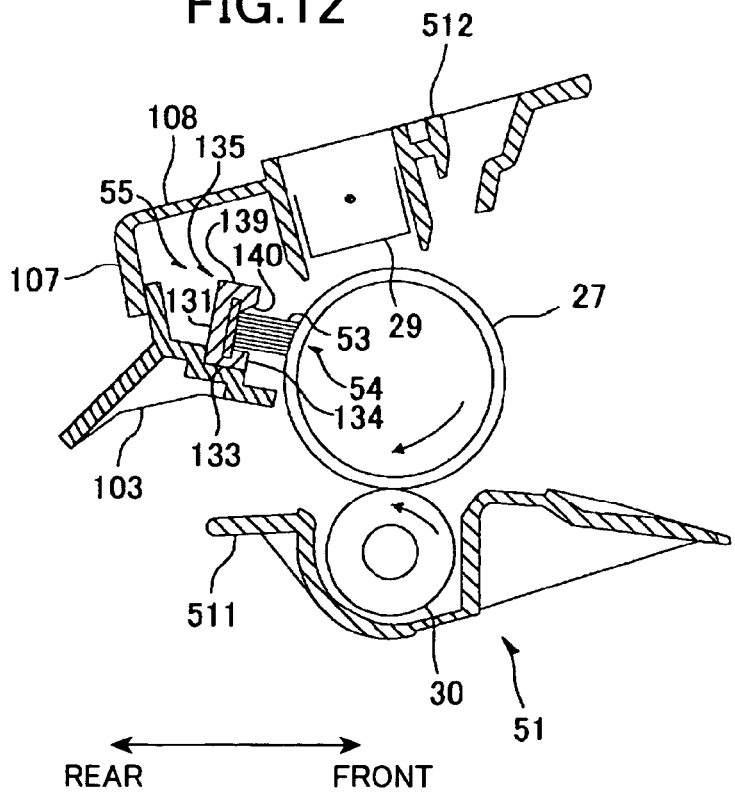
FIG. 12 is an exploded side cross-sectional view showing a brush holder according to a fifth embodiment of the present invention, wherein the brush holder is separately provided from the lower frame.
Figure 13:
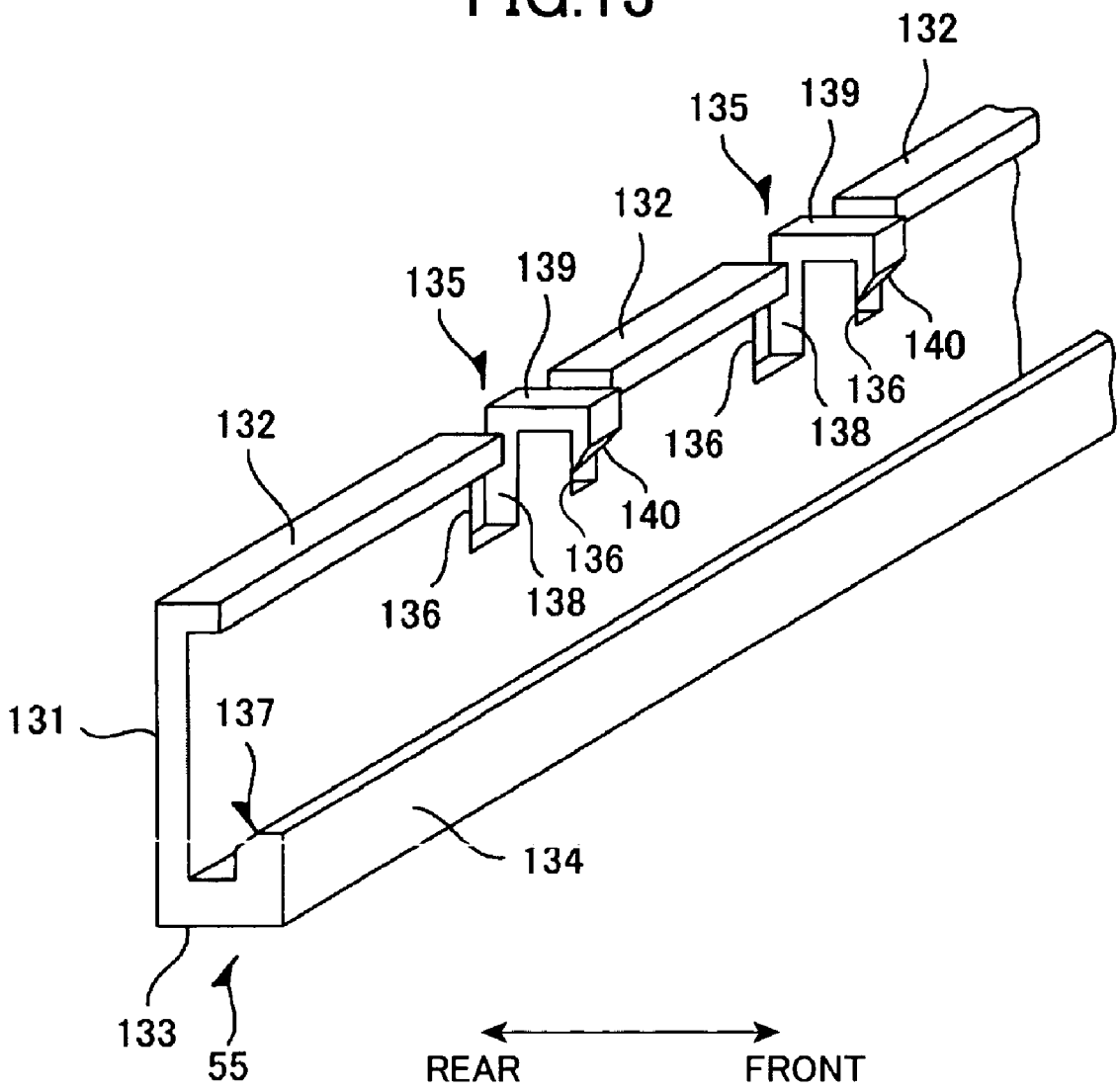
FIG. 13 is a perspective view showing the relevant parts of the brush holder in FIG. 12.

Next, a brush holder 55 according to a fifth embodiment of the present invention will be described with reference to FIGS. 12 and 13, wherein like parts and components are designated with the same reference numerals to avoid duplicating description. FIG. 12 is a side cross-sectional view of the brush holder 55 according to the fifth embodiment. FIG. 13 is a perspective view of the brush holder 55 shown in FIG. 12. In the fifth embodiment shown in FIGS. 12 and 13, the upper frame 512 is not provided with the ribs 102.

As shown in FIGS. 12 and 13, the brush holder 55 is formed separately from the frame 51 (the lower frame 511 and upper frame 512) and is mounted on the lower frame 511 with screws or the like (not shown).

The brush holder 55 according to the fifth embodiment includes a support plate 131, a plurality of top surface confronting plates 132, a bottom surface confronting plate 133, a front surface confronting plate 134, and a plurality of pawls 135.

The support plate 131 is formed substantially in the shape of a long slender rectangular plate that extends parallel to the axis of the photosensitive drum 27. A plurality of cutout parts 136 are formed in the support plate 131 by cutting out rectangular shaped sections in the top edge of the support plate 131 at predetermined intervals in the longitudinal direction.

The top surface confronting plates 132 are disposed on the top edge of the support plate 131 that has been divided by the cutout parts 136 and protrude forward at a right angle to the support plate 131.

The bottom surface confronting plate 133 is disposed on the lower edge of the support plate 131 and protrudes forward at a right angle to the support plate 131 so as to confront the top surface confronting plates 132.

The front surface confronting plate 134 is formed substantially in the shape of a long slender rectangular plate that extends parallel to the axis of the photosensitive drum 27 and is disposed on the front edge of the bottom surface confronting plate 133 protruding upward at a right angle to the bottom surface confronting plate 133. As a result, the front surface confronting plate 134 confronts and is separated a predetermined distance from the support plate 131. A recessed part 137 is formed between the support plate 131 and front surface confronting plate 134 for fitting onto one of the mounting portions 58 of the base member 57.

The pawls 135 are disposed one in the middle of each cutout part 136.

Each pawl 135 has a cross-section forming three sides of a rectangle and include a support unit 138 extending upward from the top edge of the support plate 131 within the cutout part 136 to the height of the top surface confronting plates 132; a connecting part 139 extending from the top edge of the support unit 138 in the same direction as the top surface confronting plates 132; and a pawl part 140 extending from the front edge of the connecting part 139 toward the bottom surface confronting plate 133 so as to confront the support plate 131. The pawls 135 are elastically deformable, allowing the gap between the tip of the pawl part 140 and the front surface confronting plate 134 to expand.

The tip of the pawl part 140 tapers to form a substantially triangular shape in the cross-section.

With the brush holder 55 of the present embodiment, one of the mounting portions 58 on the base member 57 is fitted into the recessed part 137 formed between the support plate 131 and front surface confronting plate 134, and the base member 57 is pressed against the pawl parts 140 of the pawls 135 to push the pawl parts 140 from the side confronting the photosensitive drum 27 toward the support plate 131. At this time, the pawls 135 elastically deform, enabling the other mounting portion 58 to be guided along the tips of the pawl parts 140 and received between the support units 138 and pawl parts 140 of the pawls 15. When the other mounting portion 58 is received between the support units 138 and pawl parts 140, the pawls 135 return to their original shape, thereby engaging with the other mounting portion 58. Accordingly, the other mounting portion 58 of the base member 57 is held by the pawls 135.

With this construction, the first mounting portion 58 of the base member 57 can be reliably held by the recessed part 137, while the other mounting portion 58 can be retained by the pawls 135. Hence, reliable support of the brush 54 can be achieved through a simple construction of the recessed part 128 and pawls 135.

Further, the brush 54 can be mounted in the brush holder 55 by pushing the base member 57 from the side confronting the photosensitive drum 27 toward the pawls 135 while one mounting portion 58 of the base member 57 is fitted into the recessed part 137 and fitting the other mounting portion 58 into the pawls 135. Accordingly, the simple construction of the recessed part 137 and pawls 135 can facilitate the operation of mounting the brush 54 in the brush holder 55.

Further, since the brush holder 55 has been formed separately from the frame 51, the brush holder 55 can be removed from the frame 51 when replacing the brush 54, thereby facilitating replacement operations for the brush 54.

Further, the brush holder 55 is mounted on the lower frame 511, which supports the photosensitive drum 27. Therefore, the brush 54 can be more accurately disposed with respect to the photosensitive drum 27, enabling the brush 54 to recover paper dust and the like deposited on the surface 27S of the photosensitive drum 27 more efficiently.

Figure 14:
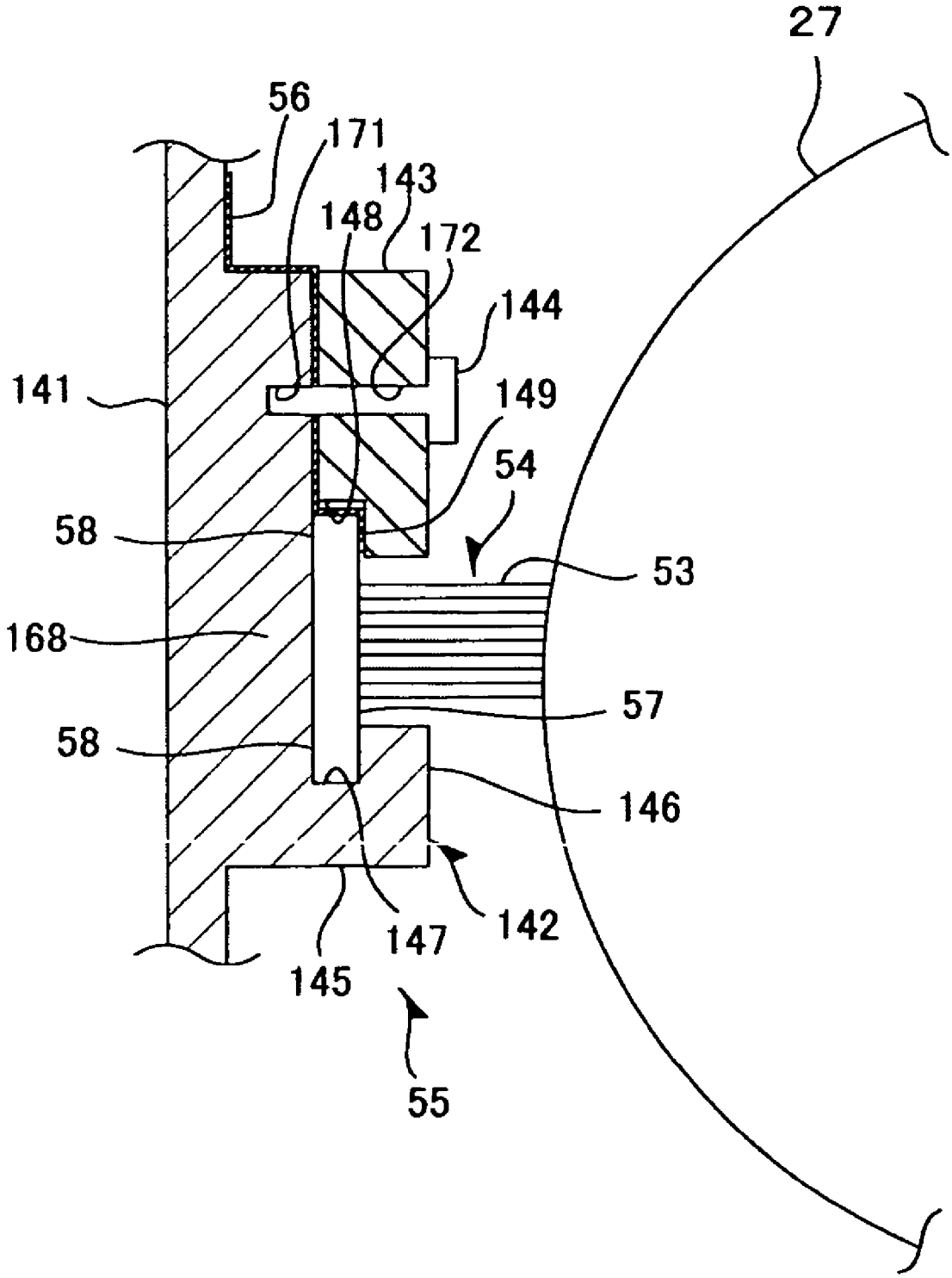
FIG. 14 is a side cross-sectional view showing the relevant parts of a brush holder according to a sixth embodiment of the present invention, wherein the brush holder includes a receiving member provided integrally with the frame and a pressing member.

Next, a brush holder 55 according to a sixth embodiment of the present invention will be described with reference to FIG. 14, wherein like parts and components are designated with the same reference numerals to avoid duplicating description. FIG. 14 is a side cross-sectional view of the brush holder 55 according to the sixth embodiment.

As shown in FIG. 14, the brush holder 55 according to the sixth embodiment includes a frame plate 141 facing the photosensitive drum 27 and formed integrally with the section connecting the lower frame 511 and upper frame 512; a receiving member 142 provided integrally with the frame plate 141; a pressing member 143 formed separately from the receiving member 142; and a screw 144 for fixing the pressing member 143 to the receiving member 142.

The receiving member 142 is formed on the surface of the frame plate 141 confronting the photosensitive drum 27 and extends parallel to the axis of the photosensitive drum 27. The receiving member 142 is integrally configured of a support plate 168 formed substantially in the shape of rectangular plate that extends parallel to the axis of the photosensitive drum 27 on the surface of the frame plate 141 confronting the photosensitive drum 27; an end surface confronting part 145 extending forward from the bottom edge of the support plate 168; and a front surface confronting part 146 extending upward from the front edge of the end surface confronting part 145 at a right angle to the end surface confronting part 145. As a result, a recessed part 147 is formed between the front surface confronting part 146 and the support plate 168 for fitting on one of the mounting portions 58 of the base member 57. A threaded hole 171 for anchoring the screw 144 is formed in the top end of the support plate 168.

The pressing member 143 is formed substantially in the shape of a rectangular plate and extends parallel to the axis of the photosensitive drum 27. The pressing member 143 includes a step part 148 for fitting over the other mounting portion 5B on the base member 57, and a through-hole 172 penetrating the thickness of the pressing member 143 for inserting the screw 144.

With the brush holder 55 according to the sixth embodiment, one of the mounting portions 58 on the base member 57 is fitted into the recessed part 147 of the receiving member 142. After the rear surface of the base member 57 is placed in contact with the support plate 168, the pressing member 143 is pushed against the base member 57 so that the other mounting portion 58 is fitted into the step part 148 and the through-hole 172 is aligned with the threaded hole 171. While the base member 57 is pressed against the support plate 168 with the pressing member 143, the screw 144 is inserted into the through-hole 172 and screwed into the threaded hole 171 to fix the pressing member 143 to the frame plate 141, thereby fixing the brush 54 to the brush holder 55.

With the brush holder 55 having this construction, the brush 54 is fixed in the brush holder 55 by fixing the pressing member 143 to the support plate 168 with the screw 144 while the pressing member 143 presses the base member 57 against the support plate 168. Hence, the brush 54 can be reliably supported. Further, since the frame plate 141 and receiving member 142 are integrally formed, the number of required parts can be reduced.

In the brush holder 55 according to the sixth embodiment, the electrode 56 for applying a cleaning bias to the brush 54 is interposed between the pressing member 143 and the other mounting portion 58 on the base member 57.

The electrode 56 is formed of a thin metal plate having on one longitudinal end a contact part 149 for contacting the front surface and latitudinal end surface of the other mounting portion 58. The other longitudinal end of the electrode 56 is led out between the pressing member 143 and support plate 168 and connected to the main casing terminal unit (not shown), which in turn is connected to the cleaning bias power source (not shown).

By disposing the electrode 56 in this way, the electrode 56 interposed between the pressing member 143 and mounting portion 58 can make reliable contact with the base member 57 to form an electrical connection when the pressing member 143 is pressed against the mounting portion 58. Accordingly, a cleaning bias can be applied to the brush 54 through a simple construction.

Figure 15:
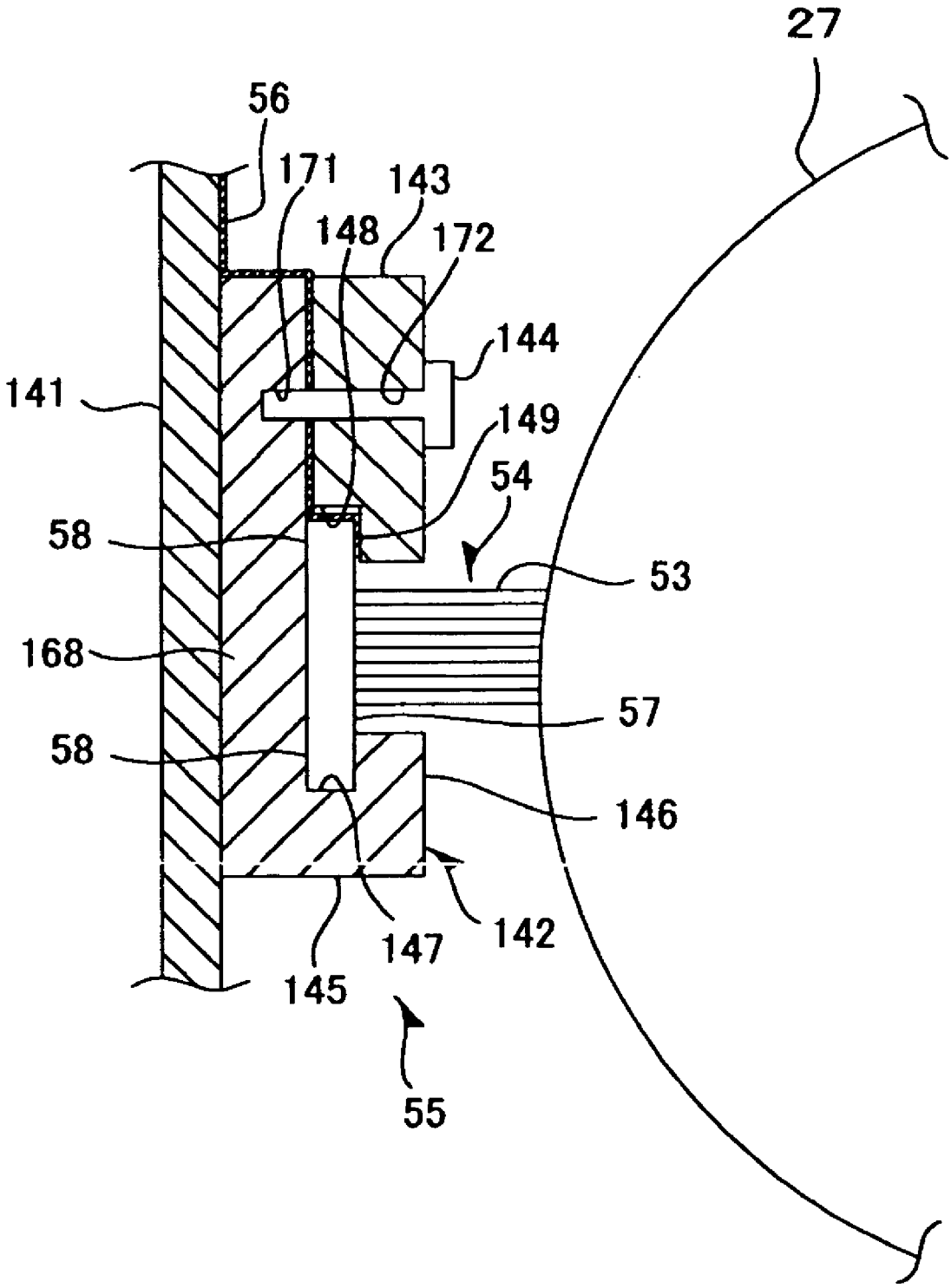
FIG. 15 is a side cross-sectional view showing the relevant parts of a brush holder according to a seventh embodiment of the present invention, wherein the brush holder includes a receiving member and a pressing member provided separately from the frame.

Next, a brush holder 55 according to a seventh embodiment of the present invention will be described with reference to FIG. 15, wherein like parts and components are designated with the same reference numerals to avoid duplicating description. FIG. 15 is a side cross-sectional view of the brush holder 55 according to the seventh embodiment.

As shown in FIG. 15, the brush holder 55 is formed separately from the frame plate 141. Specifically, the receiving member 142 is formed separately from the frame plate 141, and the support plate 168 of the receiving member 142 is mounted on the frame plate 141 using screws or the like (not shown).

With this brush holder 55, as in the above description, one of the mounting portions 58 on the base member 57 is fitted into the recessed part 147 of the receiving member 142. After the rear surface of the base member 57 is placed in contact with the support plate 168, the pressing member 143 is pushed against the base member 57 so that the other mounting portion 58 is fitted into the step part 148 and the through-hole 172 is aligned with the threaded hole 171. While the pressing member 143 pushes the base member 57 against the support plate 168, the screw 144 is inserted through the through-hole 172 and screwed into the threaded hole 171 to fix the pressing member 143 to the support plate 168. In this way, the brush 54 can be reliably supported.

Since the brush holder 55 is formed separately from the frame plate 141 (frame 51) in the brush holder 55 of the seventh embodiment, the brush holder 55 can be removed from the frame plate 141 in order to replace the brush 54 on the brush holder 55, thereby facilitating operations for replacing the brush 54.

Next, a brush holder 55 according to an eighth embodiment of the present invention will be described with reference to FIGS. 16(*a*) to 17, wherein like parts and components are designated with the same reference numerals to avoid duplicating description.

Figure 16A:
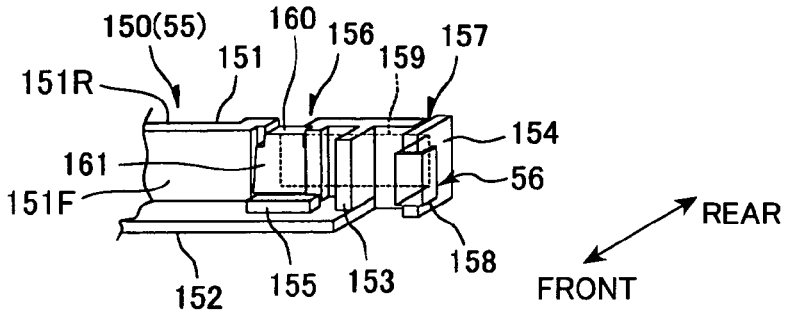
FIG. 16(*a*) is a perspective view showing the relevant parts of a brush holder and electrode having a planar shape according to an eighth embodiment of the present invention.
Figure 16B:
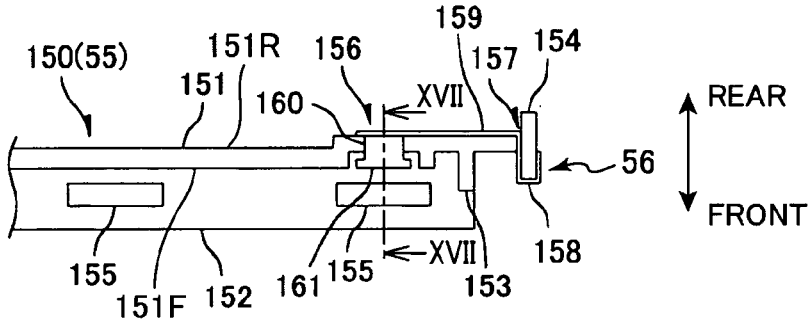
Figure 16C:
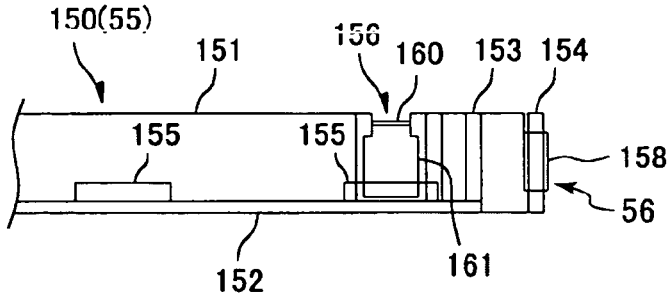

The brush holder 55 shown in FIGS. 16(*a*) to 16(*c*) includes a lower holder 150 provided on the frame end 103 (FIG. 2) of the lower frame 511 for holding one of the mounting portions 58 on the base member 57.

The lower holder 150 includes a support plate 151, a side plate 152, a contact wall 153, a confronting wall 154, and a plurality of pawls 155.

The support plate 151 supports the base member 57 from the rear surface 57R of the base member 57. The support plate 151 has a front surface 151F that confronts the rear surface 57R of the base member 57 and a rear surface 151R opposite to the front surface 151F.

The support plate 151 is disposed in opposition to the photosensitive drum 27 and is formed substantially in the shape of a long slender rectangular plate extending parallel to the axis of the photosensitive drum 27. One longitudinal end of the support plate 151 is depressed in a rectangular shape in the rear direction (the direction away from the photosensitive drum 27). A cutout part 156 is formed in the support plate 151 by cutting out a rectangular shape in the top edge thereof on one longitudinal end. A bridge part 160 described later is disposed in the cutout part 156. A slit 157 is formed in the support plate 151 for inserting the electrode 56 between the support plate 151 and the confronting wall 154 described later.

The side plate 152 is disposed across the entire lower edge of the support plate 151 and extends forward from this lower edge at a right angle to the support plate 151.

The contact wall 153 is disposed on one longitudinal end of the support plate 151 in a plane orthogonal to the support plate 151 and side plate 152 and confronting and separated a predetermined distance from the confronting wall 154 described below. When the base member 57 is supported on the support plate 151, one longitudinal end surface 57A of the base member 57 contacts the contact wall 153.

The confronting wall 154 is formed on one edge of the support plate 151 further outside than the contact wall 153 in the longitudinal direction of the support plate 151 in a plane orthogonal to the support plate 151.

The pawls 155 are arranged on the surface of the side plate 152 facing the support plate 151 at predetermined intervals in the longitudinal direction of the side plate 152.

Each of the pawls 155 is formed substantially in the shape of a rectangular parallelepiped and confronts the support plate 151 at a predetermined distance.

The electrode 56 is formed from a thin metal plate and is integrally configured of a fixed part 158 fixed to the confronting wall 154, a relay part 159 disposed on the rear surface 151R of the support plate 151, the bridge part 160 spanning the cutout part 156 in the support plate 151, and a leaf spring shaped contact part 161 provided on the front surface 151F of the support plate 151.

One end of the fixed part 158 is disposed on the outer surface of the confronting wall 154 in the longitudinal direction of the support plate 151. From this outer surface, the fixed part 158 is bent to follow the front surface of the confronting wall 154 and is subsequently bent to follow the inner surface of the confronting wall 154, completing three sides of a rectangular shape. The other end of the fixed part 158 is guided to the rear surface 151R of the support plate 151 via the slit 157.

The relay part 159 is formed continuously with the fixed part 158, extending along the rear surface 151R of the support plate 151 from the slit 157 to the cutout part 156.

The bridge part 160 is formed continuously from the relay part 159, spanning the cutout part 156 and connecting with the leaf spring shaped contact part 161.

The leaf spring shaped contact part 161 is shaped substantially like a rectangular plate and can be elastically deformed in a direction toward the photosensitive drum 27.

Figure 17:
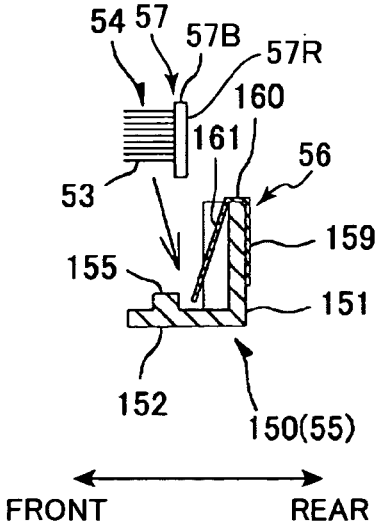
FIG. 17 is a cross-sectional view indicated by line XVII-XVII in FIG. 16(*b*)

As shown in FIG. 17, when one of the mounting portions 58 on the base member 57 is inserted between the support plate 151 and the pawls 155 from above, this mounting portion 58 is held between the support plate 151 and the pawls 155 while the rear surface 57R of the base member 57 is supported by the support plate 151. When the upper frame 512 is assembled on the lower frame 511, the ribs 102 (see FIG. 4) of the upper frame 512 contact the latitudinal end surface 57B of the base member 57 at which the other mounting portion 58 is formed, pressing the other mounting portion 58 toward the lower holder 150. In this way, support of the brush 54 is achieved.

Since the leaf spring shaped contact part 161 of the electrode 56 is provided on the front surface 151F of the support plate 151, the leaf spring shaped contact part 161 elastically contacts the rear surface 57R of the base member 57 when the mounting portion 58 is inserted between the support plate 151 and pawls 155 during assembly. Accordingly, a cleaning bias can be applied to the brush member 53 through a simple construction that does not require a separate connection between the electrode 56 and brush member 53.

By fixing the fixed part 158 of this electrode 56 to the confronting wall 154 of the brush holder 55, the relay part 159 of the electrode 56 can be provided over the rear surface 151R of the support plate 151, while the leaf spring shaped contact part 161 of the electrode 56 can be provided on the front surface 151F of the support plate 151. Accordingly, the electrode 56 can be reliably fixed while achieving reliable contact between the electrode 56 and the base member 57 through a simple construction.

Further, since the leaf spring shaped contact part 161 of the electrode 56 is provided on the front surface 151F of the support plate 151 while the bridge part 160 of the electrode 56 spans the cutout part 156 of the support plate 151, the electrode 56 can be fixed and reliably positioned in the longitudinal direction of the support plate 151.

Figure 18A:
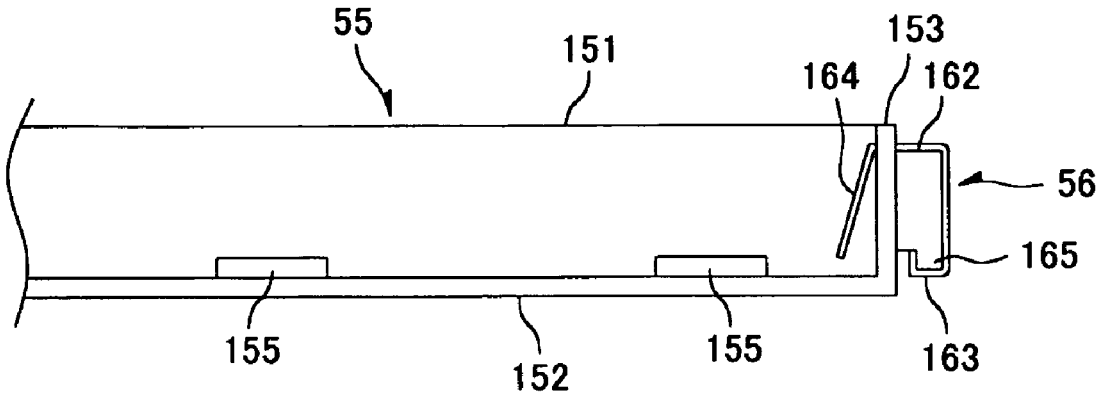
FIG. 18(*a*) is a front view showing the relevant parts of a brush holder and electrode, provided with a leaf spring shaped contact part, according to a ninth embodiment of the present invention.
Figure 18B:
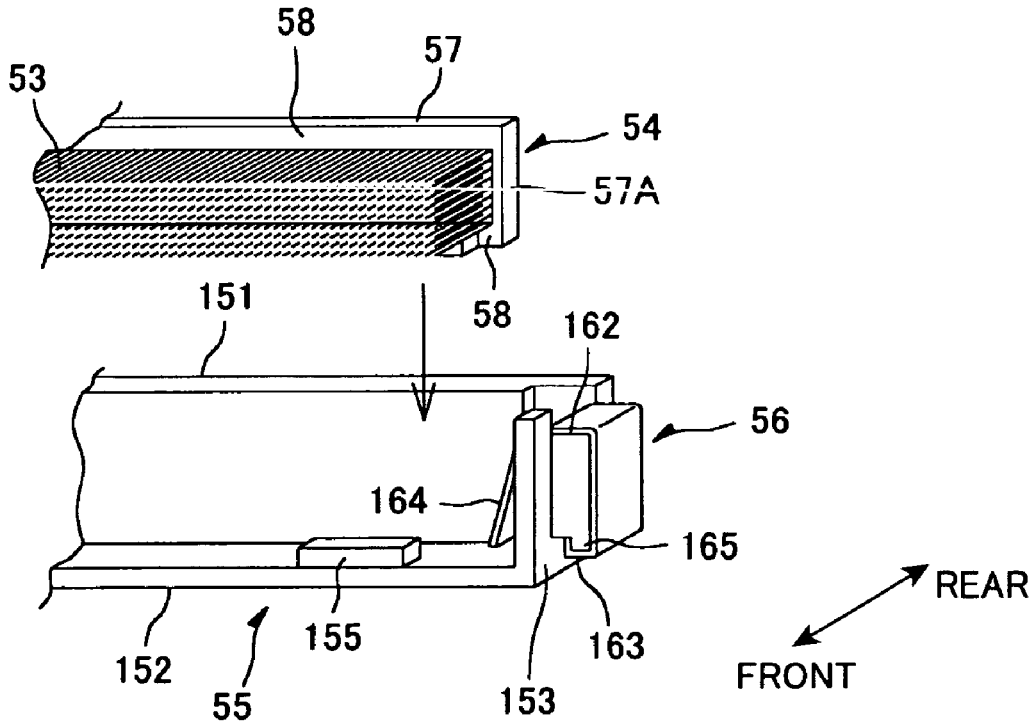

Next, a brush holder 55 according to a ninth embodiment of the present invention will be described with reference to FIGS. 18(*a*) and 18(*b*), wherein like parts and components are designated with the same reference numerals to avoid duplicating description. FIGS. 18(*a*) and 18(*b*) show the brush holder 55 according to the ninth embodiment that is provided with the electrode 56.

As shown in FIG. 18(*b*), the electrode 56 has a substantially rectangular plate shape and is configured of an engaging part 163 having a cross-section that forms three sides of a rectangle for engaging with a support part 162 described later; and a contact part 164 shaped like a leaf spring that continues from the engaging part 163 over the inner surface of the contact wall 153.

Further, the confronting wall 154 described above is not formed on the brush holder 55, but the support part 162 protruding in a substantially rectangular shape is formed on the outer surface of the contact wall 153. An engaging part 165 is formed on the bottom surface of the support part 162 for engaging with the engaging part 163 of the electrode 56.

As shown in FIG. 18(*a*), the electrode 56 is formed so that the contact part 164 bends in the longitudinal direction of the support plate 151 over the inner surface of the contact wall 153. The electrode 56 is mounted on the brush holder 55 by fitting the engaging part 163 of the electrode 56 over the support part 162 so that the free end of the engaging part 163 engages with the engaging part 165.

When the electrode 56 is mounted on the brush holder 55 in this way, the contact part 164 elastically contacts one longitudinal end surface 57A of the base member 57. Hence, reliable contact can be formed between the electrode 56 and base member 57 through a simple construction.

Figure 19:
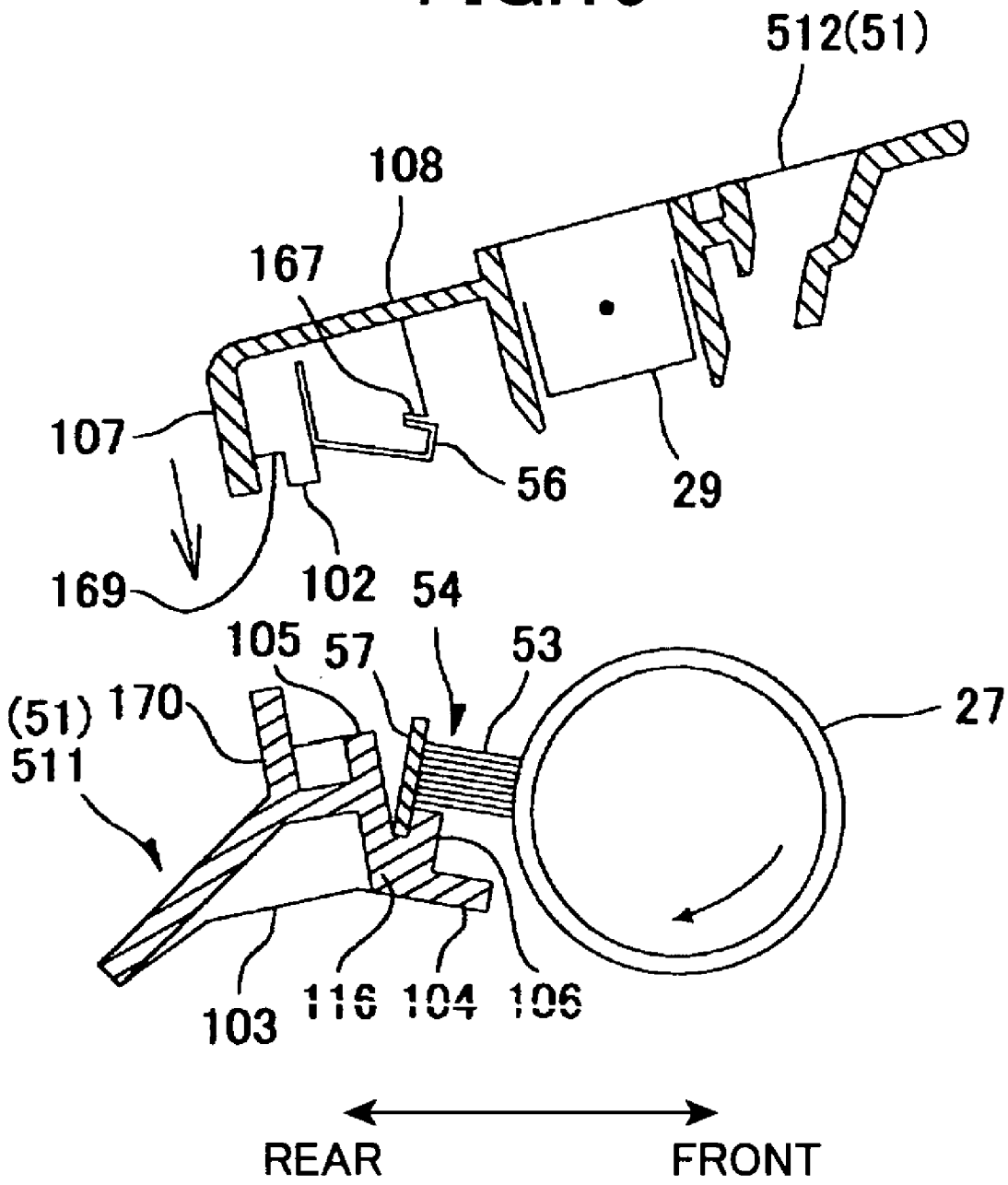
FIG. 19 is an exploded side cross-sectional view showing a brush holder and electrode, provided on a rib, according to a tenth embodiment of the present invention.

Next, a brush holder 55 according to a tenth embodiment of the present invention will be described with reference to FIGS. 19 and 20, wherein like parts and components are designated with the same reference numerals to avoid duplicating description. FIG. 19 is a side cross-sectional view and FIG. 20 a perspective view illustrating the electrode 56 employed in the brush holder 55 according to the tenth embodiment.

Figure 20:
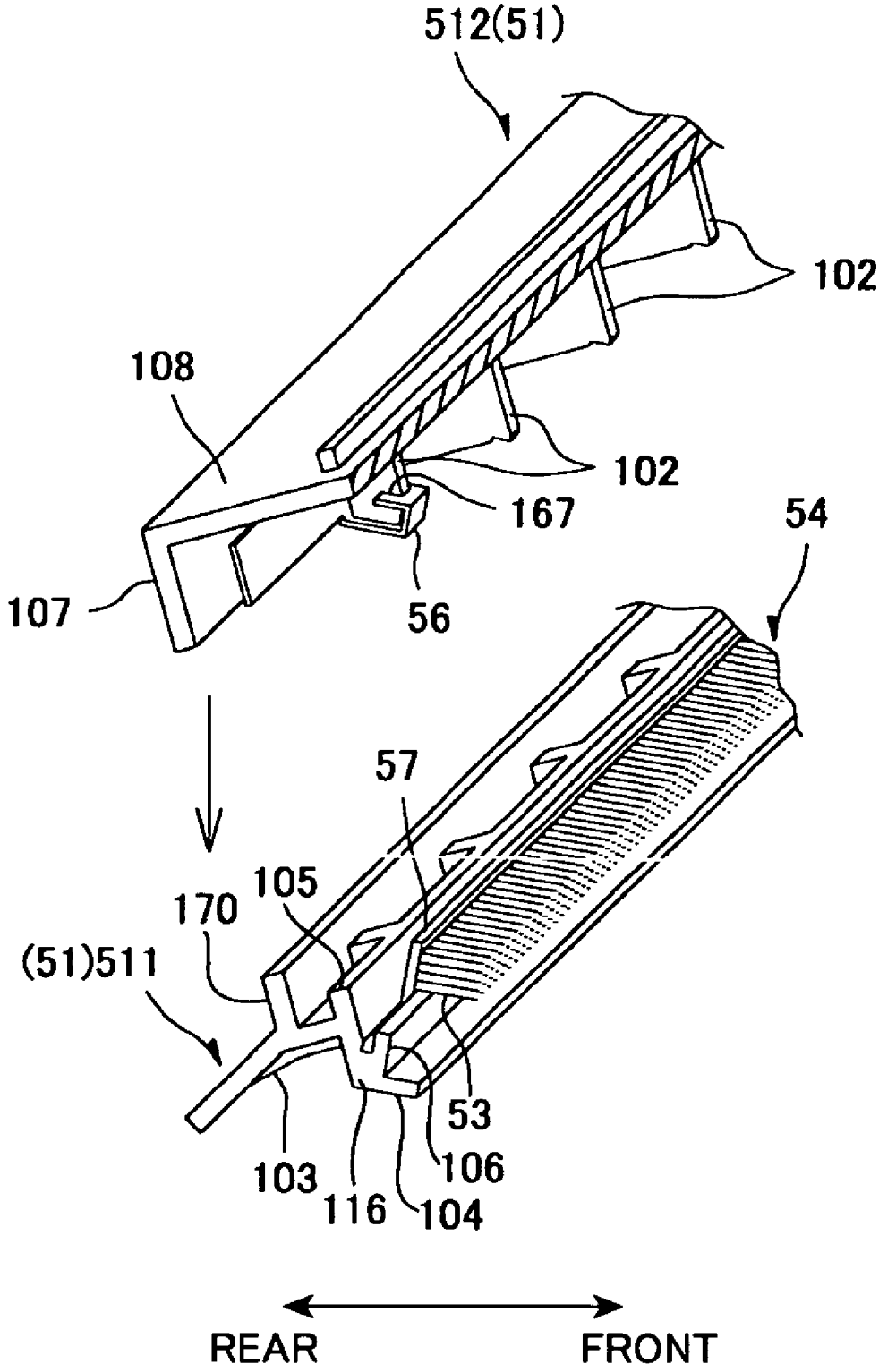
FIG. 20 is a perspective view showing the relevant parts of the brush holder and electrode of FIG. 19.

As shown in FIGS. 19 and 20, the electrode 56 is disposed on one of the plurality of ribs 102 disposed on the upper frame 512 (the outermost rib 102 in the axial direction of the photosensitive drum 27).

A notch 167 is formed in the front edge of this outermost rib 102. The electrode 56 is engaged with the rib 102 by inserting one end of the electrode 56 into the notch 167. The electrode 56 is then bent to follow the front edge and lower edge of the rib 102.

By mounting the electrode 56 in this way, the electrode 56 can contact the base member 57 when the upper frame 512 is assembled onto the lower frame 511 and the ribs 102 press against the base member 57. Accordingly, a cleaning bias can be applied to the brush 54 through a simple construction without forming a separate connection between the electrode 56 and the brush 54, enabling a cleaning bias to be applied to the brush 54 easily and reliably.

Figure 21:
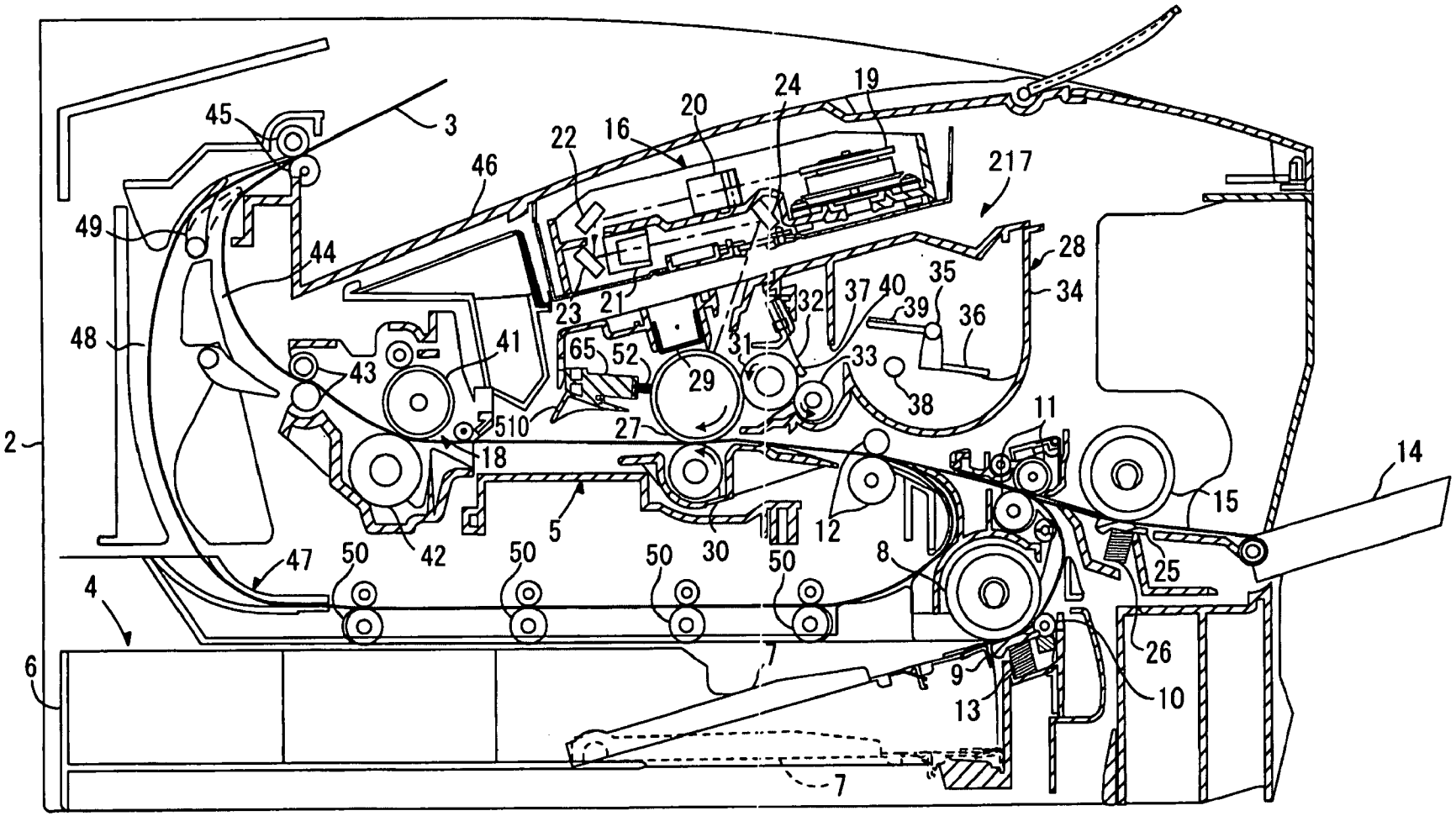
FIG. 21 is a side cross-sectional view showing the relevant parts of a laser printer according to an eleventh embodiment of the present invention.
Figure 22:
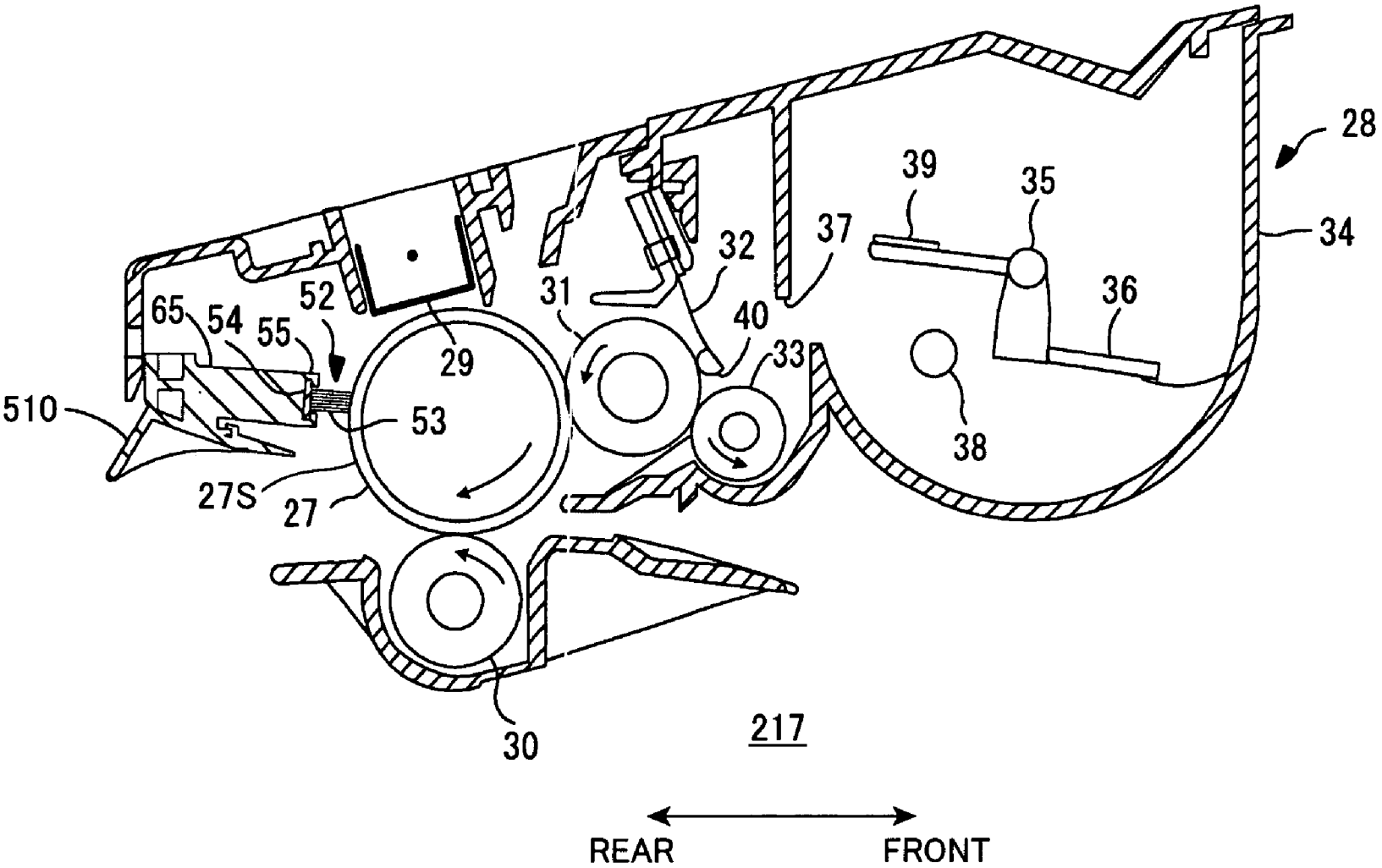
FIG. 22 is a side cross-sectional view showing the relevant parts of a process cartridge in the laser printer of FIG. 21.

A process cartridge and laser printer according to an eleventh embodiment of the present invention will be described with reference to FIGS. 21 to 25, wherein like parts and components are designated with the same reference numerals to avoid duplicating description. As shown in FIGS. 21 and 22, a laser printer 201 and a process cartridge 217 have constructions similar to the laser printer 1 and the process cartridge 17 of the first embodiment, respectively. However, the laser printer 201 includes a frame 510 instead of the frame 51. Also, the brush holder 55 has different constructions. The brush holder 55 is for supporting the brush 54 and is integrally provided with the mounting base 65 of the frame 510.

Figure 23:
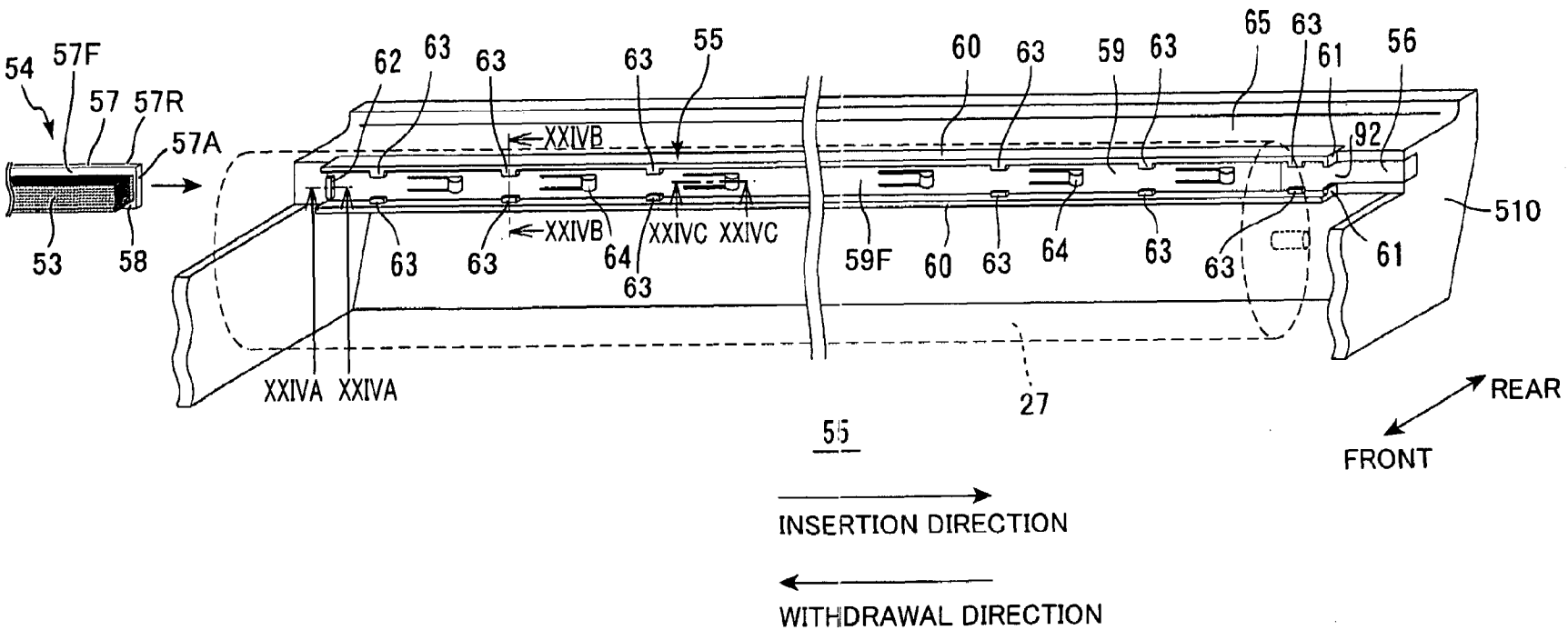
FIG. 23 is a perspective view showing the cartridge and brush holder of FIG. 22, wherein a brush is being inserted.

As shown in FIG. 23, the brush holder 55 is formed of a synthetic resin and is integrally configured of a support plate 59, two side walls 60, two contact walls 61, a plurality of pawls 63, a stopper 62, and a plurality of elastic (resilient) pieces 64.

The support plate 59 is formed substantially in the shape of a long slender rectangular plate having a length nearly equal to the base member 57. The support plate 59 is integrally formed with the frame 510 so that the rear surface 59R of the support plate 59 is integrally mounted on the mounting base 65 of the frame 510. When the brush 54 is mounted on the brush holder 55, the support plate 59 supports the base member 57 from the rear surface 57R thereof.

As shown in FIG. 22, the mounting base 65 is positioned to the side of the photosensitive drum 27 (opposite the side of the developing roller 31) and is separated a predetermined distance therefrom. The front surface 59F of the support plate 59 confronts the surface 27S of the photosensitive drum 27 from a predetermined distance.

Figure 24A:
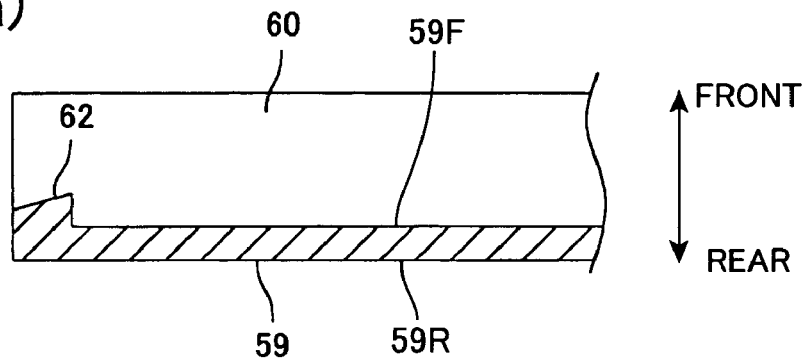
FIG. 24(*a*) is a cross-sectional view of the brush holder in FIG. 23 indicated by line XXIVA-XXIVA.
Figure 24B:
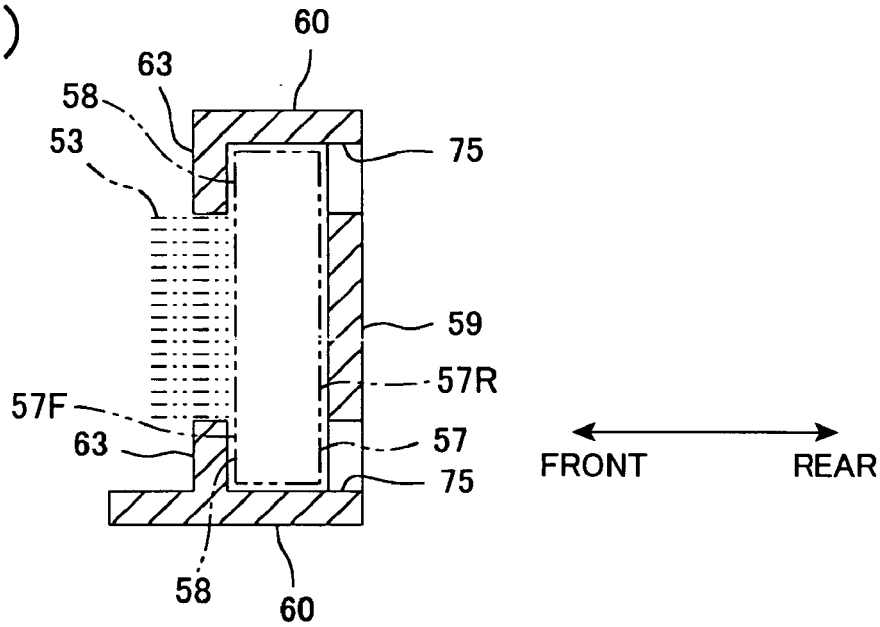
Figure 24C:
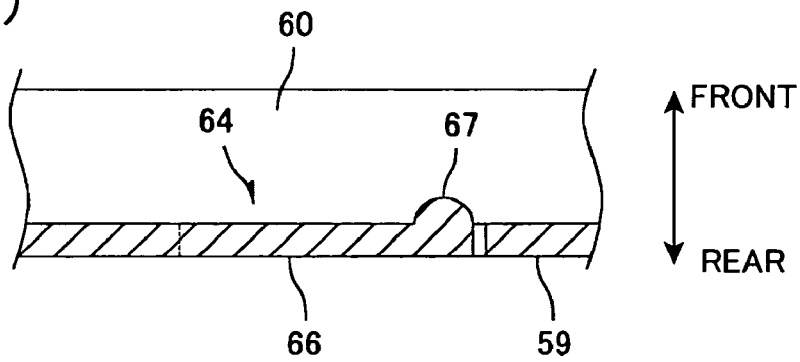

As shown in FIG. 24(*b*), openings 75 having a substantially rectangular shape penetrate the thickness of the support plate 59 in an area confronting the plurality of pawls 63.

As shown in FIG. 24(*b*), each of the side walls 60 is disposed on both latitudinal edges of the support plate 59 extending substantially at a right angle to the support plate 59 toward the photosensitive drum 27. As shown in FIG. 23, the side walls 60 extend in the longitudinal direction of the support plate 59 and confront one another with the support plate 59 interposed therebetween. The lower side wall 60 is formed longer in the direction toward the photosensitive drum 27 than the upper side wall 60 (FIG. 24(*b*)).

Pairs of the pawls 63 are disposed at predetermined intervals along the longitudinal direction of the support plate 59 so that one member of each pair confronts the other member across the support plate 59.

As shown in FIG. 24(*b*), the pawls 63 are formed from the free end of the upper side wall 60 and from a corresponding point in the middle of the lower side wall 60 and extend inward along the latitudinal direction of the support plate 59 substantially at right angles to the side walls 60 so that the free ends of the pawls 63 in each pair are separated at a predetermined distance. When the brush 54 is mounted in the brush holder 55, the pawls 63 confront the front surface 57F of the base member 57 and press against the mounting portions 58 thereon.

Figure 25A:
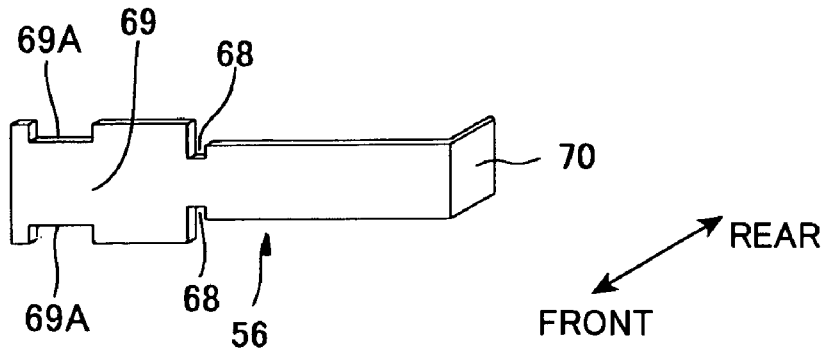
FIG. 25(*a*) is a perspective view of an electrode provided in the brush holder of FIG. 23.
Figure 25B:
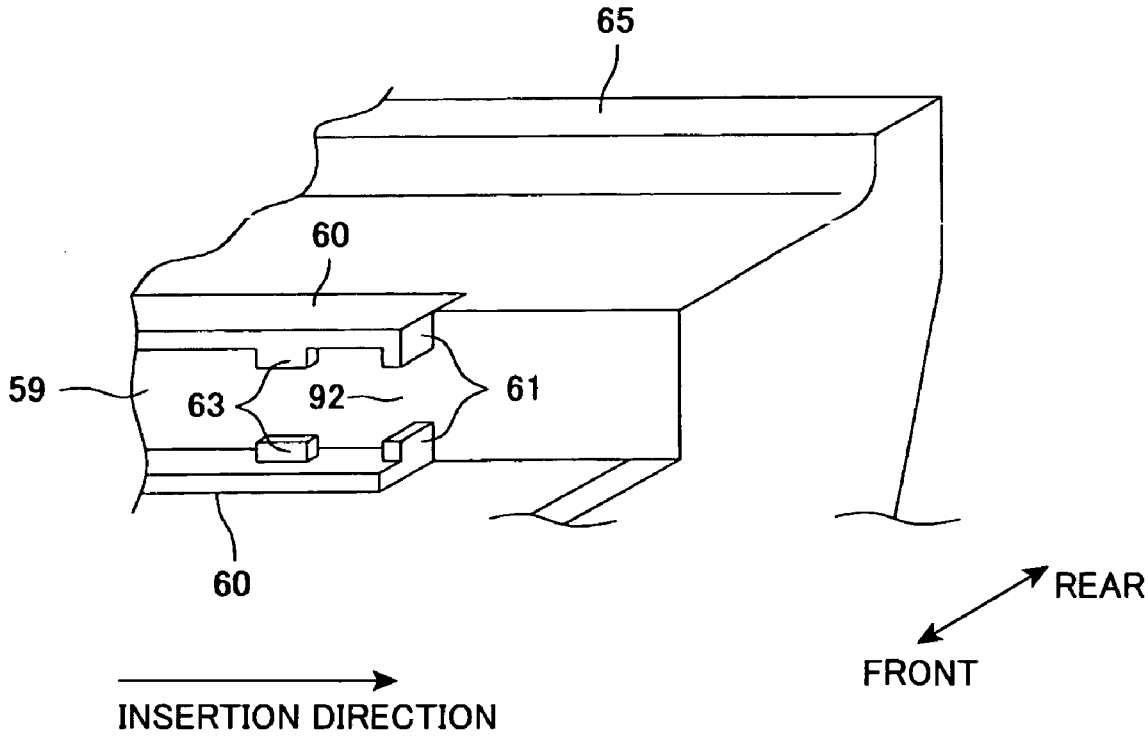

As shown in FIG. 25(*b*), the contact walls 61 extend from the ends of the confronting side walls 60 on one side thereof (the downstream side with respect to the direction in which the brush 54 is inserted or mounted in the brush holder 55 which is referred to as insertion direction) inward along the latitudinal direction of the support plate 59 and substantially at right angles to the side walls 60 so that the free ends of the contact walls 61 confront one another at a predetermined distance. Here, the area between the free ends of the contact walls 61 forms an electrode insertion area 92 for inserting the electrode 56 described later.

When the brush 54 is mounted in the brush holder 55, the longitudinal end surface 57A on one side of the base member 57 contacts the contact walls 61, restricting movement of the base member 57 in the insertion direction.

As shown in FIG. 23, the stopper 62 has a substantially long narrow rectangular shape and is formed at the edge of the support plate 59 on the other side (upstream side with respect to the insertion direction), extending in the latitudinal direction of the support plate 59. As shown in FIG. 24(*a*), the stopper 62 is formed integrally with the edge of the support plate 59 on the upstream end and protrudes to form a latch shape on the front surface 59F of the support plate 59 for preventing the brush 54 supported in the brush holder 55 from moving in the direction that the brush 54 is pulled out from the brush holder 55 (withdrawal direction).

The upstream end of the support plate 59 is formed continuously with the two side walls 60 disposed on the latitudinal sides so that this end cannot bend substantively in the thickness direction of the support plate 59 (front-to-rear direction). In other words, the upstream end of the support plate 59, on which the stopper 62 is provided, has rigidity that substantially prevents bending in the thickness direction of the support plate 59.

As shown in FIG. 23, the elastic pieces 64 are disposed along the longitudinal direction of the support plate 59 at predetermined intervals.

As shown in FIG. 24(*c*), the elastic pieces 64 is integrally configured of a rod-shaped elastic piece 66 formed by cutting out three sides of a rectangular shape in the support plate 59 so that the fourth side is continuously formed with the support plate 59; and a contact part 67 that protrudes from the surface of the elastic piece 66 on one end thereof.

When the brush 54 is mounted in the brush holder 55, the elastic piece 66 elastically deforms in the thickness direction of the support plate 59, while the contact part 67 is in contact with the rear surface 57R of the base member 57. Accordingly, the brush material 53 is elastically urged toward the photosensitive drum 27 from the rear surface 57R of the base member 57.

As shown in FIG. 23, the electrode 56 is provided in the brush holder 55. When the brush 54 is supported on the brush holder 55, the electrode 56 contacts the base member 57 for applying a cleaning bias to the brush material 53.

As shown in FIG. 25(*a*), the electrode 56 has an elongated planar shape and is integrally configured of engaging parts 68 for engaging with the contact walls 61, a contact part 69 that is positioned on the front surface 59F of the support plate 59, and a terminal part 70 for connecting to a main casing terminal part (not shown) disposed within the main casing 2.

The engaging parts 68 are formed one on either latitudinal edge of the electrode 56 in the middle of the electrode 56 with respect to the longitudinal direction and are aligned with one another in the latitudinal direction.

The contact part 69 is formed on the other side of the engaging parts 68 from the terminal part 70. Recessed parts 69A are formed in the latitudinal edges of the contact part 69 at areas corresponding to the pair of pawls 63.

The terminal part 70 is formed on the end of the electrode 56 opposite the contact part 69 and is bent substantially at a right angle to the rear surface 59R of the support plate 59.

As shown in FIG. 23, the electrode 56 is inserted through the electrode insertion area 92 and mounted in the brush holder 55 by engaging the engaging parts 68 with the contact walls 61 so that the contact part 69 is disposed on the front surface 59F of the support plate 59.

Figure 28A:
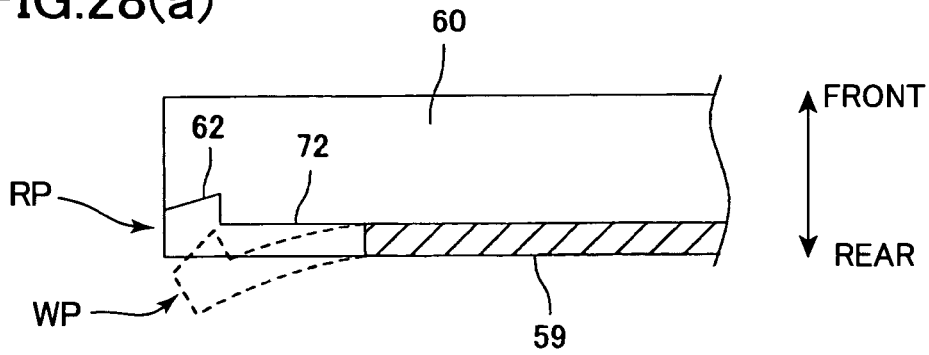
FIG. 28(*a*) is a cross-sectional view of the brush holder in FIG. 27 indicated by line XXVIIIA-XXVIIIA.
Figure 28B:
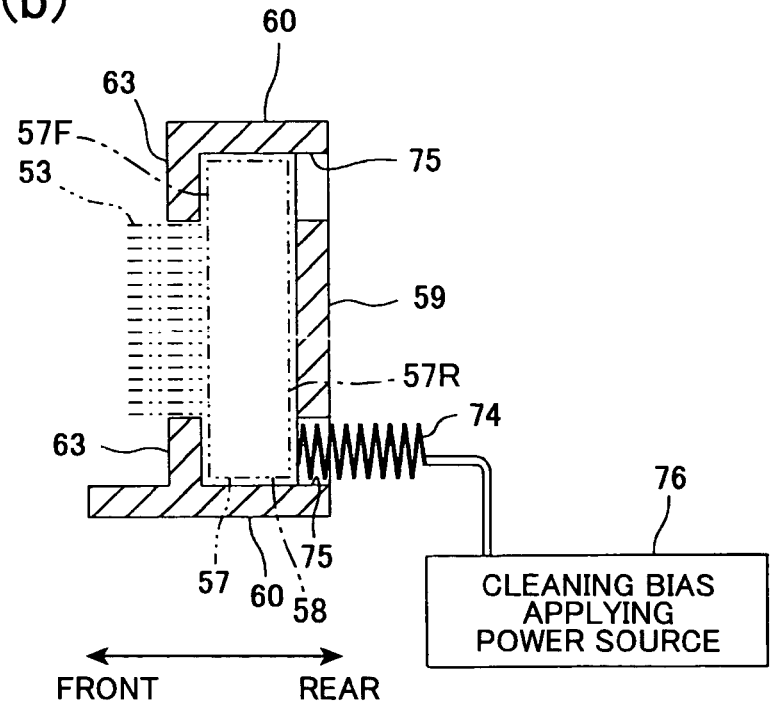
Figure 28C:
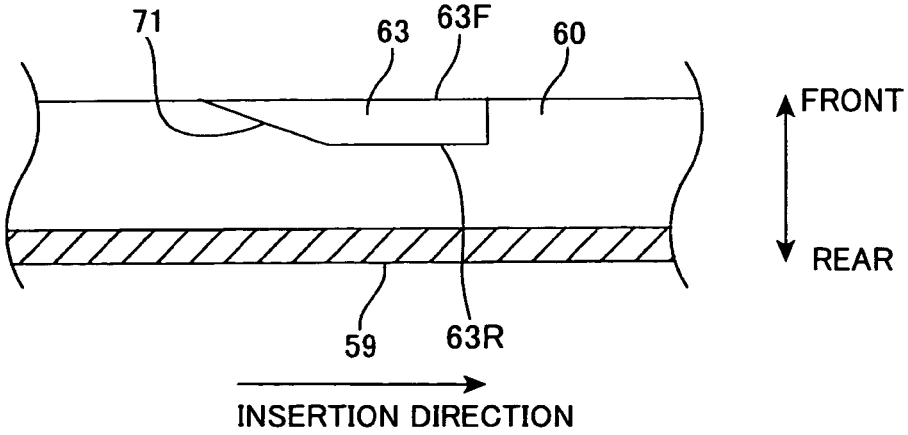

When the process cartridge 17 is mounted in the main casing 2, the main casing terminal part (not shown), which is connected to a cleaning bias applying power source 76 (see FIG. 28(*b*)), contacts the terminal part 70 of the electrode 56.

With this brush unit 52, the brush 54 is mounted in the brush holder 55 in the following way.

As shown in FIG. 23, first, the downstream end 57A of the brush 54 is aligned with the upstream end of the brush holder 55, and the brush 54 is inserted through the upstream end of the brush holder 55 so that the mounting portions 58 of the base member 57 are interposed between the pawls 63 and the support plate 59. Next, the brush 54 is slid into the brush holder 55 in the insertion direction until the downstream end 57A of the base member 57 contacts the contact walls 61.

When the downstream end 57A of the base member 57 has contacted the contact walls 61, the upstream end of the base member 57 is engaged with the stopper 62. In this way, the brush 54 is mounted in the brush holder 55.

With this brush unit 52, when the brush 54 is slid into the brush holder 55 in the insertion direction, that is, the longitudinal direction of the base member 57, the brush holder 55 receives the brush 54 and the brush 54 becomes mounted in the brush holder 55.

When the brush 54 is mounted in the brush holder 55, the pawls 63 apply pressure to and hold the mounting portions 58 provided on the latitudinal ends 57B of the base member 57. Since the pawls 63 hold the mounting portions 58 without increasing the size of the base member 57, the brush 54 can be securely mounted in the brush holder 55.

As a result, the brush 54 can be formed in a compact size, reducing the overall size of the device, and the time and effort to replace the brush 54 can be reduced. Further, since the pawls 63 hold the mounting portions 58 on both latitudinal ends 573 of the base member 57, the base member 57 can be accurately positioned, thereby positioning the brush 54 appropriately with respect to the photosensitive drum 27.

Further, since the brush holder 55 is formed integrally with the frame 510, it is possible to reduce the number of required parts in this brush unit 52 and eliminate the inconvenience of attaching the brush holder 55 to the frame 510.

The pawls 63 provided in the brush unit 52 can reliably support the base member 57 by pressing against the surface of the mounting portions 58. Accordingly, through a simple construction the base member 57 can be reliably supported while minimizing resistance on the base member 57 in the insertion direction. This construction also minimizes resistance on the base member 57 in the direction that the base member 57 is slidingly removed.

When mounting the brush 54 on the brush holder 55 in this brush unit 52, the base member 57 is slid over the support plate 59 in the insertion direction until the longitudinal end surface 57A of the base member 57 contacts the contact wall 61, thereby restricting movement of the base member 57 in the insertion direction and ensuring that the base member 57 is mounted in the correct position. In other words, the base member 57 is mounted in the correct position when slid in the insertion direction until the longitudinal end surface 57A of the base member 57 contacts the contact wall 61. As a result, the mounting operation for the brush 54 can be simplified.

Once the brush 54 is supported in the brush holder 55, movement of the brush 54 is restricted even if an attempt is made to pull the brush 54 out in a withdrawal direction because the stopper 62 protruding from the surface of the support plate 59 at the end opposite the contact walls 61 contacts the other longitudinal end surface 57A of the base member 57. Hence, once the brush 54 is supported in the brush holder 55, the brush 54 cannot be removed from the brush holder 55 by moving the brush 54 in the withdrawal direction. Accordingly, a simple construction can reliably prevent the brush 54 from being removed from the brush holder 55, enabling the brush holder 55 to reliably support the brush 54.

Further, since the stopper 62 is integrally formed with the end of the support plate 59 that cannot bend substantively in the thickness direction, the present embodiment facilitates formation of the stopper 62 that can reliably prevent the brush 54 from being removed.

To remove the brush 54 from the brush holder 55, the end of the base member 57 near the stopper 62 must be raised slightly off the front surface 59F of the support plate 59 to disengage this end of the base member 57 from the stopper 62. Subsequently, the base member 57 may be pulled in the withdrawal direction.

Further, since the elastic piece 66 of the elastic pieces 64 is elastically deformed, the contact part 67 on the elastic piece 66 contacts the rear surface 57R of the base member 57 and elastically urges the mounting portions 58 toward the pawls 63. Therefore, the brush material 53 can be reliably positioned on the support plate 59 and placed in contact with the surface 27S of the photosensitive drum 27, enabling the brush material 53 to remove paper dust from the surface 27S of the photosensitive drum 27 reliably.

Further, when the electrode 56 is provided in the brush holder 55, and the brush 54 is supported on the brush holder 55, the electrode 56 can apply a cleaning bias to the brush material 53 via the base member 57. Accordingly, a cleaning bias can be applied to the brush material 53 through a simple construction that does not require a separate connection between the electrode 56 and the brush material 53.

Moreover, since the contact part 69 of the electrode 56 is positioned on the surface of the support plate 59, the contact part 69 contacts the rear surface 57R of the base member 57 when the brush 54 is supported in the brush holder 55. Hence, a cleaning bias can be applied to the brush material 53 easily and reliably.

By providing the laser printer 201 with the process cartridge 217 of the present embodiment that is capable of being made more compact and reducing the inconvenience in such operations as replacing the brush 54, a more compact laser printer 201 can be manufactured that facilitates maintenance.

Figure 26:
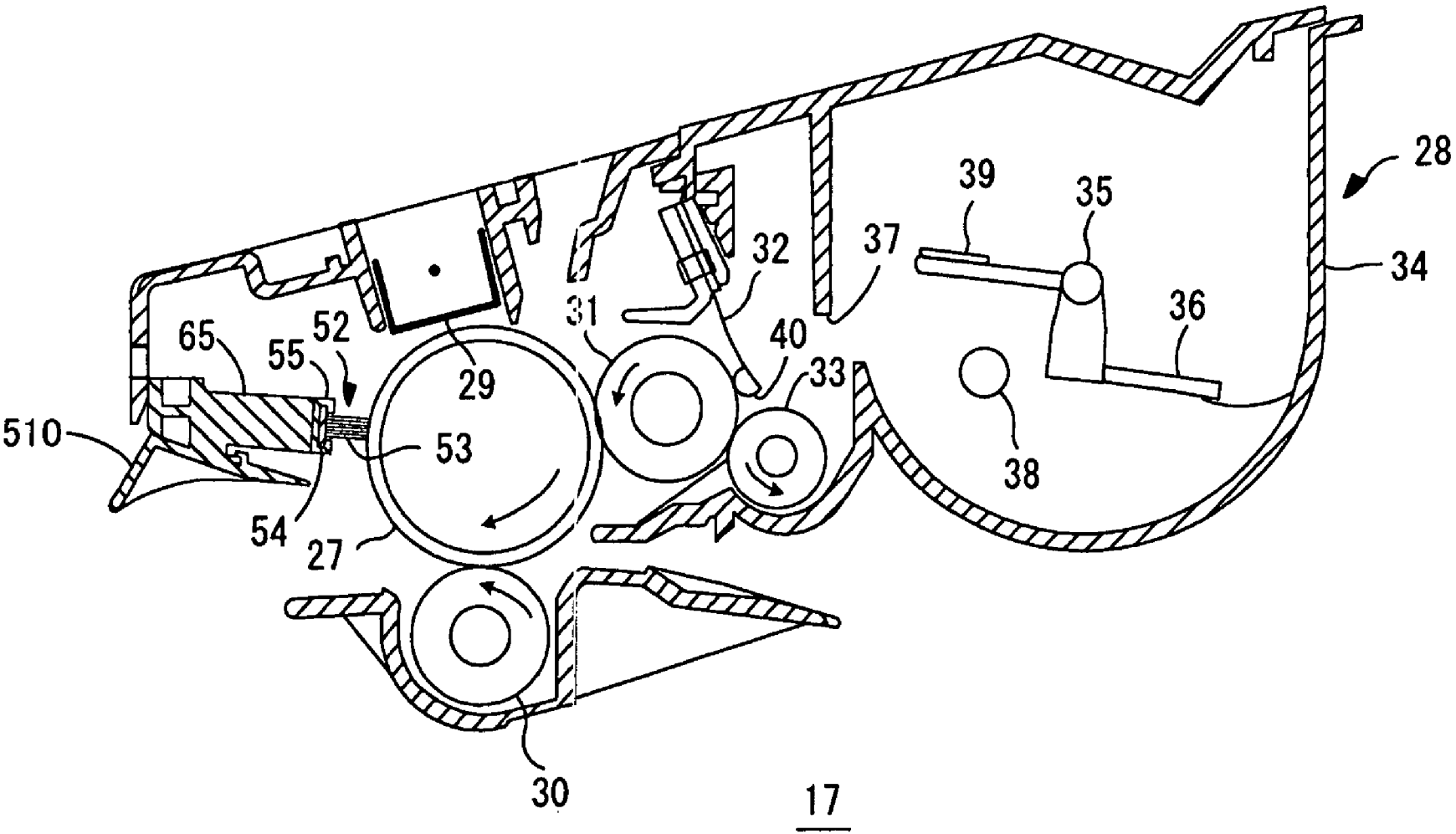
FIG. 26 is a side cross-sectional view showing the relevant parts of a process cartridge according to a twelfth embodiment and employed in the laser printer of FIG. 21, wherein the brush holder is formed separately from the frame.

Next, a brush holder 55 according to a twelfth embodiment of the present invention will be described with reference to FIG. 26, wherein like parts and components are designated with the same reference numerals to avoid duplicating description. In the eleventh embodiment described above, the brush holder 55 is formed integrally with the frame 510. However, in the present embodiment shown in FIG. 26, the brush holder 55 is formed separately from the frame 510 and is mounted on the frame 510 using screws or the like (not shown).

Since the brush holder 55 is formed separately from and later attached to the frame 510, the brush holder 55 can be removed from the frame 510 when replacing the brush 54, thereby facilitating replacement operations for the brush 54.

Figure 27:
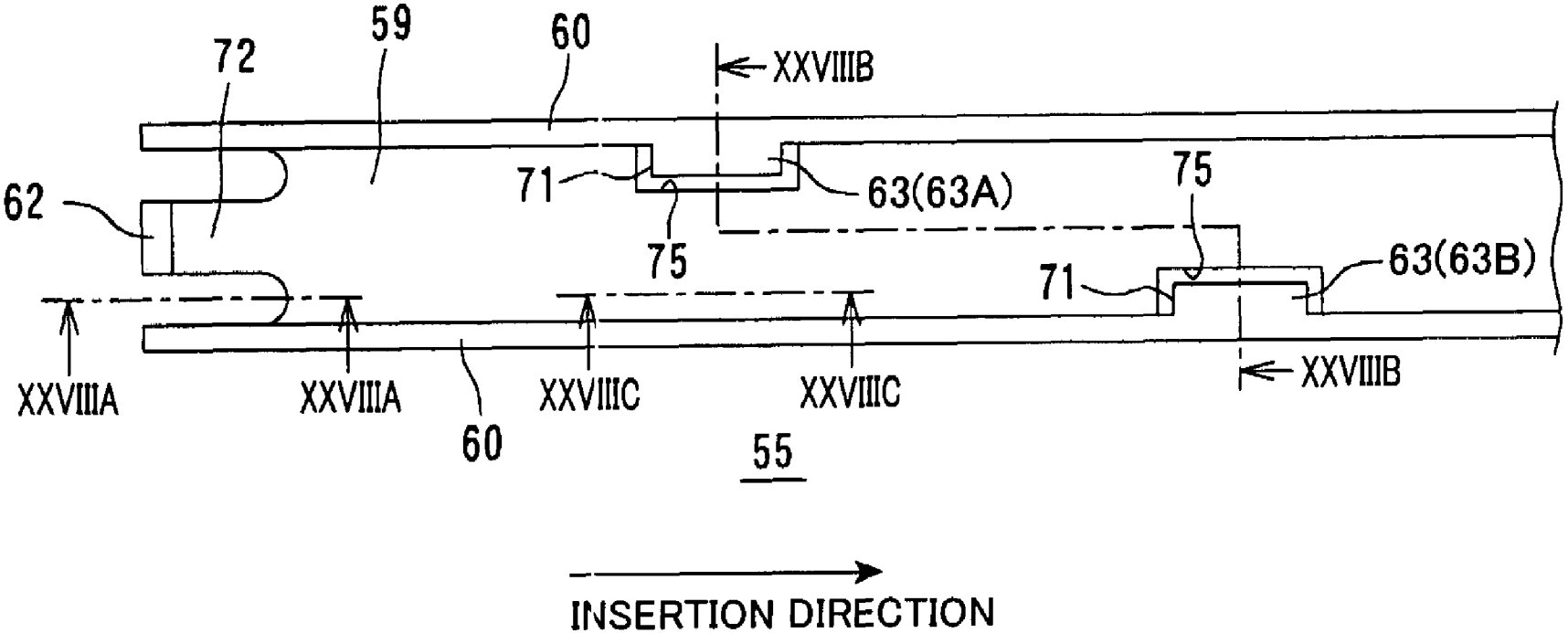
FIG. 27 is a front view showing the relevant parts of a brush holder according to a thirteenth embodiment having a plurality of pawls arranged in a staggered formation.

FIG. 27 is a front view showing a brush holder 55 according to a thirteenth embodiment of the present invention, wherein like parts and components are designated with the same reference numerals to avoid duplicating description.

In the brush holder 55 shown in FIG. 27, the pawls 63 include pawls 63A confronting the upper mounting portion 58 and pawls 63B confronting the lower mounting portion 58 that alternate in a staggered formation so as not to face one another across the support plate 59 (or the brush material 53 when the brush 54 is mounted). In other words, no two pawls 63 are disposed at the same position in the insertion direction.

By staggering the pawls 63 on either side of the support plate 59 in this way, the base member 57 can slide more smoothly when inserted into the brush holder 55. Therefore, this configuration ensures that the base member 57 can be smoothly mounted in and removed from the brush holder 55.

As shown in FIG. 28(*c*), each pawl 63 has a sloped surface 71 that slopes from a front surface 63F of the pawl 63 to a rear surface 63R in the insertion direction for guiding the brush 54 in the insertion direction. The rear surface 63R of the pawl 63 confronts the front surface 57F of the base member 57, when the base member 57 is mounted in the brush holder 55.

With the pawls 63 having this construction, the base member 57 can be smoothly guided in the insertion direction when inserting the base member 57 into the brush holder 55, even when the longitudinal end surface 57A of the base member 57 contacts the sloped surface 71 of the pawl 63. This construction ensures that the base member 57 can be smoothly mounted in and removed from the brush holder 55.

Further, a resilient part 72 having a substantially rectangular shape that extends in the longitudinal direction of the support plate 59 is formed in the latitudinal (widthwise) center region of the support plate 59 on the stopper 62 end by cutting out portions of the support plate 59 adjacent to the side wall 60 on this end, which portions are elongated in the longitudinal direction. As shown in FIG. 28(*a*), the stopper 62 is integrally formed on the free end of the resilient part 72 and protrudes from the front surface of the resilient part 72.

The stopper 62 is in a restricting position RP when the resilient part 72 is not bent for preventing removal of the brush 54 and is withdrawn from the restricting position RP when the resilient part 72 is bent toward the rear surface 59R of the support plate 59, as indicated by the dotted line in FIG. 28(*a*). At this time, the stopper 62 is in a withdrawal position WP for allowing removal of the brush 54.

With this construction, the stopper 62 is easy to form and can be moved from the restricting position RP to the withdrawal position WP by bending the resilient part 72 in the thickness direction. Hence, while the stopper 62 is normally in the restricting position RP and can reliably prevent removal of the brush 54 from the brush holder 55, the brush 54 can easily be removed from the brush holder 55 by bending the resilient part 72 and moving the stopper 62 to the withdrawal position WP when replacing the brush 54.

Further, in the brush holder 55 of FIG. 27, a plurality of compressed springs 74 are provided in place of the elastic pieces 64, as shown in FIG. 28(*b*). One end of each compressed spring 74 is fixed to the frame 510, while the other end passes through the opening 75 in the support plate 59 and presses against the rear surface 57R of the base member 57.

In addition, the cleaning bias applying power source 76 disposed in the main casing 2 is connected to one end of each compressed spring 74.

By inserting the compressed springs 74 through the openings 75 in place of the elastic pieces 64, the compressed springs 74 are arranged on the rear surface of the mounting portions 5B at positions corresponding to each pawl 63 when the brush 54 is mounted in the brush holder 55. Hence, the mounting portions 58 are firmly pushed against the pawls 63, enabling the brush holder 55 to reliably hold the brush 54.

By connecting the cleaning bias applying power source 76 to one end of each compressed spring 74, the compressed spring 74 also functions as the electrode 56, thereby eliminating the need to provide the electrode 56 in the brush holder 55. As a result, it is possible to reliably place the brush material 53 in contact with the surface 27S of the photosensitive drum 27 and to apply a cleaning bias, while reducing the number of required parts.

Figure 29:
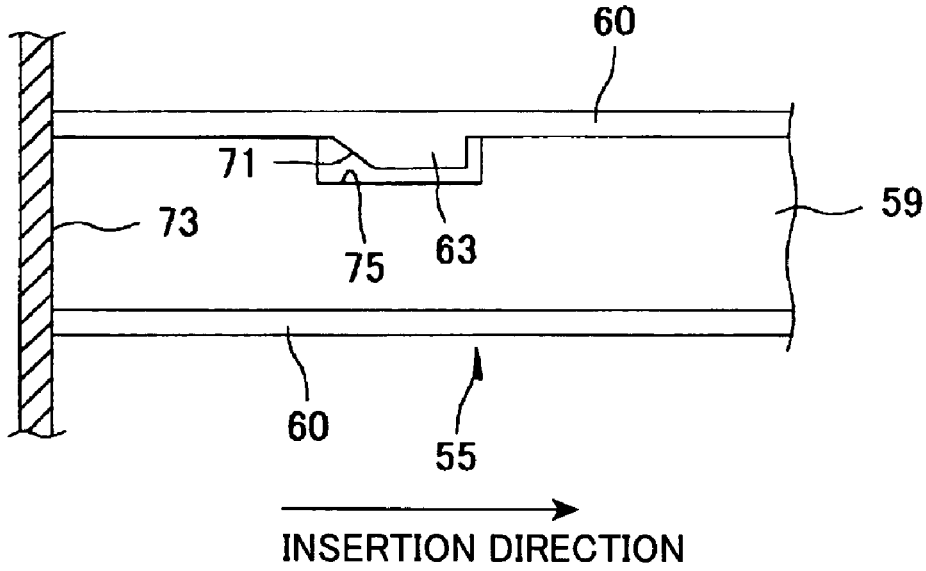
FIG. 29 is a front cross-sectional view showing the relevant parts of a stopper, which also functions as a side wall of the frame, provided on a brush holder according to a fourteenth embodiment.

FIG. 29 shows a portion of a brush holder 55 according to a fourteenth embodiment of the present invention, wherein like parts and components are designated with the same reference numerals to avoid duplicating description. As shown in FIG. 29, a side wall 73 of the frame 510 may also serve as a restricting wall in place of the stopper 62 of the thirteenth embodiment. In other words, the stopper 62 is not formed on the end of the brush holder 55. When the brush holder 55 is mounted on the mounting base 65 of the frame 510, the side wall 73 of the frame 510 contacts and closes the end of the brush holder 55, thereby restricting movement of the brush 54 in the withdrawal direction.

With this construction, the function of the stopper 62 in the thirteenth embodiment is performed by the side wall 73, which is separate from the brush holder 55. The side wall 73 is fitted against the end of the brush holder 55 when the brush holder 55 is mounted on the frame 510. Therefore, movement of the brush 54 in the withdrawal direction can be restricted without needing to provide the stopper 62 on the brush holder 55, thereby simplifying formation of the brush holder 55.

FIGS. 30 through 33(*b*) show other embodiments of the electrode 56 and the brush holder 55 provided with the electrode 56. Next, these embodiments of the electrode 56 and brush holder 55 will be described with reference to the drawings, wherein like parts and components are designated with the same reference numerals to avoid duplicating description.

Figure 30:
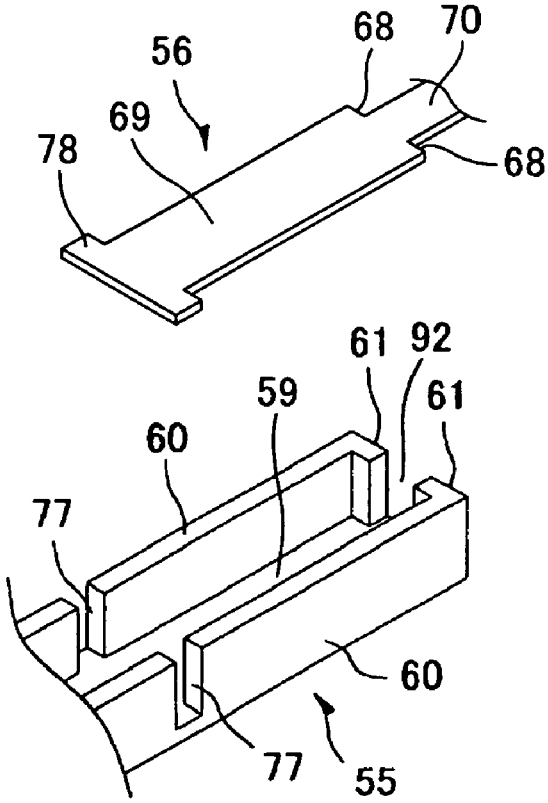
FIG. 30 is a perspective view showing a brush holder and electrode according to a fifteenth embodiment, wherein an engaging part of the electrode is engaged with an engaging part in side walls of the brush holder.

FIG. 30 shows an electrode 56 and a brush holder 55 provided with the electrode 56 according to a fifteenth embodiment of the present invention. The electrode 56 is integrally configured of a terminal part 70 formed in an elongated planar shape and connected to a main casing terminal part (not shown) that is provided inside the main casing 2; an engaging part 68 formed continuously with the terminal part 70 for engaging with the contact walls 61; a contact part 69 formed continuously with the engaging part 68 for being placed on the surface of the support plate 59; and an engaging part 78 formed continuously with the contact part 69 for engaging with engaging parts 77, described below, that are provided in the brush holder 55.

The terminal part 70 is formed in a belt shape extending longitudinally on one end of the electrode 56.

The engaging part 68 is formed continuously with an end of the terminal part 70 as a step part that expands outward from both latitudinal edges of the electrode 56 in the latitudinal direction at corresponding positions on either side of the electrode 56.

The contact part 69 continues from the engaging part 68 forming a belt shape that is wider than the terminal part 70.

The engaging part 78 is formed continuously with the contact part 69 as a step part that expands outward from both latitudinal edges of the electrode 56 at corresponding positions.

The engaging parts 77 are formed in the brush holder 55 by cutting out substantially rectangular shapes from the side walls 60 at corresponding positions in the latitudinal direction.

The electrode 56 is mounted in the brush holder 55 by engaging the engaging part 78 in the engaging parts 77, engaging the engaging part 68 with the contact walls 61, and inserting the terminal part 70 in the electrode insertion area 92 so that the contact part 69 is disposed on the front surface 59F of the support plate 59.

By mounting the electrode 56 in the brush holder 55 in this way, the engaging part 78 of the electrode 56 is engaged in the engaging parts 77 of the brush holder 55, enabling the electrode 56 to be positioned accurately on the support plate 59. Accordingly, the electrode 56 can be placed reliably in contact with the support plate 59 through a simple construction.

Figure 31A:
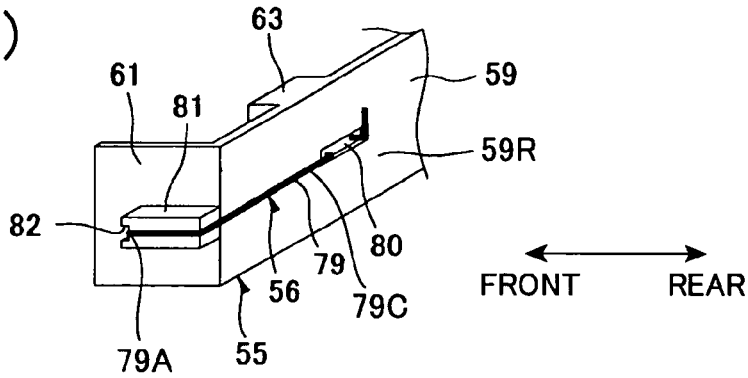
FIG. 31(*a*) is a perspective view showing the front side of a brush holder and electrode according to a sixteenth embodiment, wherein the electrode is configured of a wire.
Figure 31B:
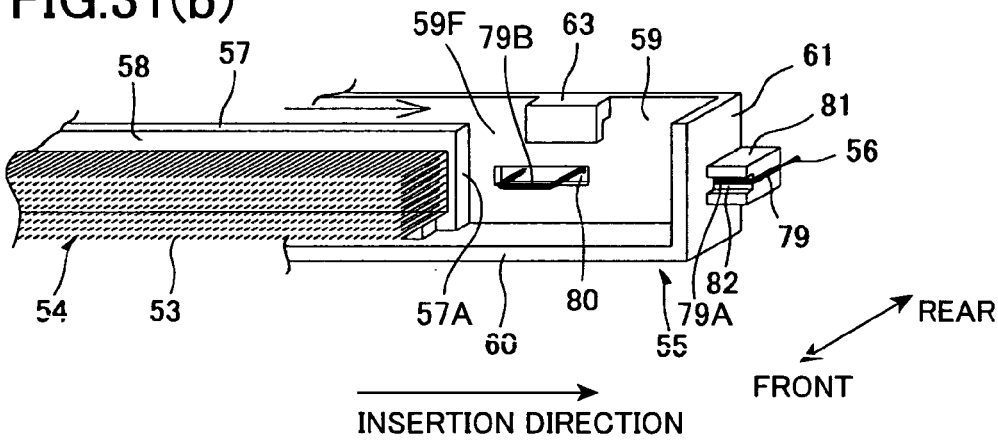

FIGS. 31(*a*) and 31(*b*) show a brush holder 55 and an electrode 56 according to a sixteenth embodiment of the present invention. In FIGS. 31(*a*) and 31(*b*), the electrode 56 is formed from a wire 79.

In the brush holder 55 shown in FIG. 31(*b*), the upper side wall 60 has been eliminated, while the contact wall 61 is substantially shaped like a rectangular plate formed continuously with the support plate 59 and the lower side wall 60, and is disposed so as to block the base member 57 in the insertion direction. A slender substantially rectangular shaped opening 80 is formed in the end of the support plate 59 near the contact walls 61, penetrating the thickness of the support plate 59. A fixing part 81 protruding in a rectangular shape is formed on the outer surface of the contact walls 61 for fixing the wire 79. An engaging groove 82 is formed in the fixing part 81 along the longitudinal direction of the same for engaging the wire 79. The upper pawls 63 are formed substantially in the shape of an L, extending from the upper edge of the support plate 59 toward the photosensitive drum 27 and subsequently bending inward in the latitudinal direction of the support plate 59.

Although the upper side wall 60 is not provided in this brush holder 55, a plurality of the pawls 63 are formed on the upper side of the support plate 59 at predetermined intervals in the longitudinal direction of the support plate 59 for holding the mounting portion 58.

As shown in FIG. 31(*a*), the electrode 56 is mounted in the brush holder 55 by engaging one end of the wire 79 in the engaging groove 82 of the fixing part 81 and drawing the wire 79 along the rear surface 59R of the support plate 59 and through the opening 80, with the other end of the wire 79 disposed on the front surface 59F of the support plate 59.

By mounting the electrode 56 in the brush holder 55 in this way, the electrode 56 can be firmly fixed and reliably placed in contact with the base member 57 through a simple construction.

Figure 32:
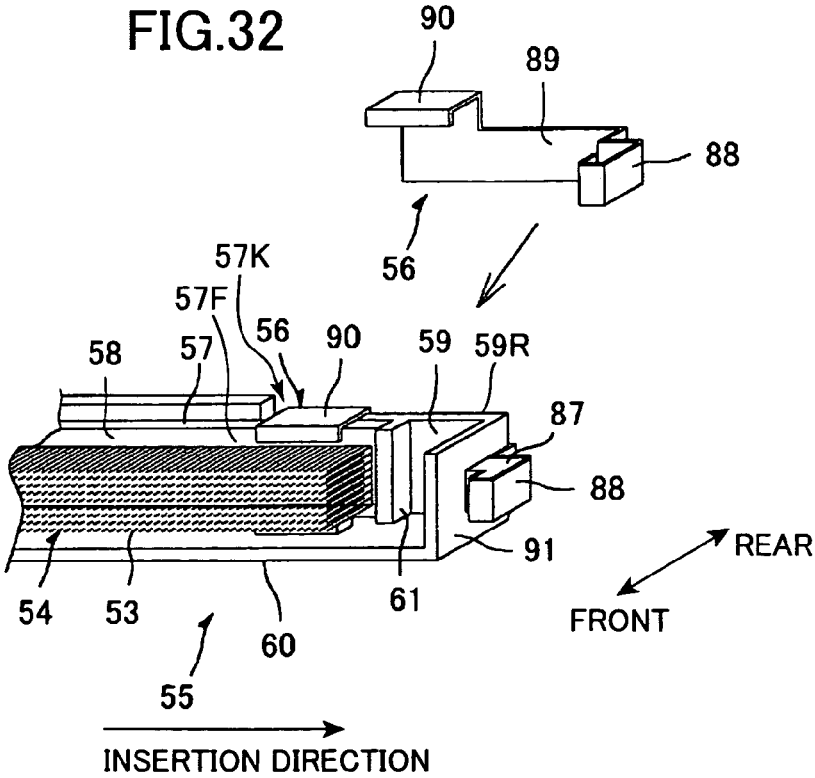
FIG. 32 is a perspective view showing a brush holder and electrode according to a seventeenth embodiment, wherein the electrode is disposed on the front surface of a base member.

FIG. 32 shows a brush holder 55 and an electrode 56 according to a seventeenth embodiment of the present invention. As shown in FIG. 32, the electrode 56 is formed in a planar shape having elasticity. The electrode 56 is configured of an engaging part 88 on one end that has a cross-section forming three sides of a rectangle for engaging with a fixing piece 87 described later; a belt-shaped middle part 89 formed continuously with the engaging part 88 and positioned on the rear surface 59R of the support plate 59 for connecting the end of the electrode 56 having the engaging part 88 to the other end; and a contact part 90 provided on the other end of the electrode 56 and formed continuously from the middle part 89 that runs from the rear surface 59R of the support plate 59 across the support plate 59 and the base member 57 to the front surface 57F of the base member 57.

The brush holder 55 of the present embodiment is not provided with the upper side wall 60, and the upper edge of the support plate 59 has a cutout 57K on one end. The contact wall 61 has a substantially rectangular plate shape and is connected to the support plate 59 and the lower side wall 60. The contact walls 61 is disposed near the longitudinal end of the support plate 59 having the cutout edge but separated from this end for blocking the base member 57 in the insertion direction. A confronting wall 91 shaped substantially like a rectangular plate is disposed on the support plate 59 downstream of the contact wall 61 in the insertion direction and facing the same. The confronting wall 91 is formed continuously with the support plate 59 and the side wall 60. The fixing piece 87 protrudes from the outside of the confronting wall 91 in a hook shape for fixing the engaging part 88 of the electrode 56. While the pawls 63 have been omitted from the drawing in FIG. 32, a plurality of the pawls 63 are formed on the upper and lower sides of the support plate 59 at predetermined intervals along the longitudinal direction of the support plate 59 for holding the mounting portion 58.

The electrode 56 is mounted in the brush holder 55 by engaging the engaging part 88 in the fixing piece 87 on the confronting wall 91. The middle part 89 connected between the engaging part 88 and contact part 90 is positioned on the rear surface 59R of the support plate 59, while the contact part 90 extends from the rear surface 59R of the support plate 59 across the upper edges of the support plate 59 and the base member 57 in the thickness direction and bends over the front surface 57F of the base member 57.

Hence, when mounted in the brush holder 55 in this way, the electrode 56 extends from the support plate 59 side to contact the front surface 57F of the base member 57. Accordingly, the electrode 56 also functions to hold the support plate 59 and base member 57 in contact with each other.

By mounting the base member 57 on the brush holder 55 in this way, it is possible to reliably fix the electrode 56 through a simple construction that allows the base member 57 to be received smoothly between the front surface 59F of the support plate 59 and the contact part 90 and that ensures contact between the contact part 90 and the received base member 57.

Further, when the electrode 56 is mounted on the brush holder 55, the portion of the electrode 56 extending from the rear surface 59R of the support plate 59 to the front surface 57F of the base member 57 has elasticity that can reliably hold the base member 57.

Figure 33A:
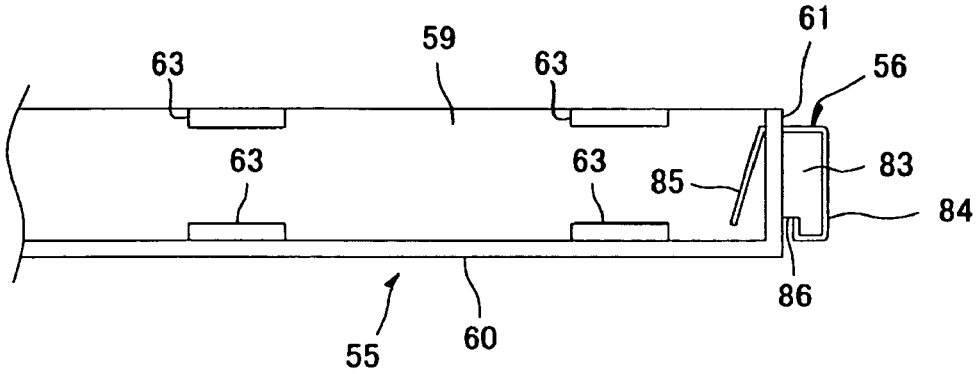
FIG. 33(*a*) is a front view showing a brush holder and electrode according to an eighteenth embodiment, wherein the electrode is formed with a leaf spring shaped contact part.
Figure 33B:
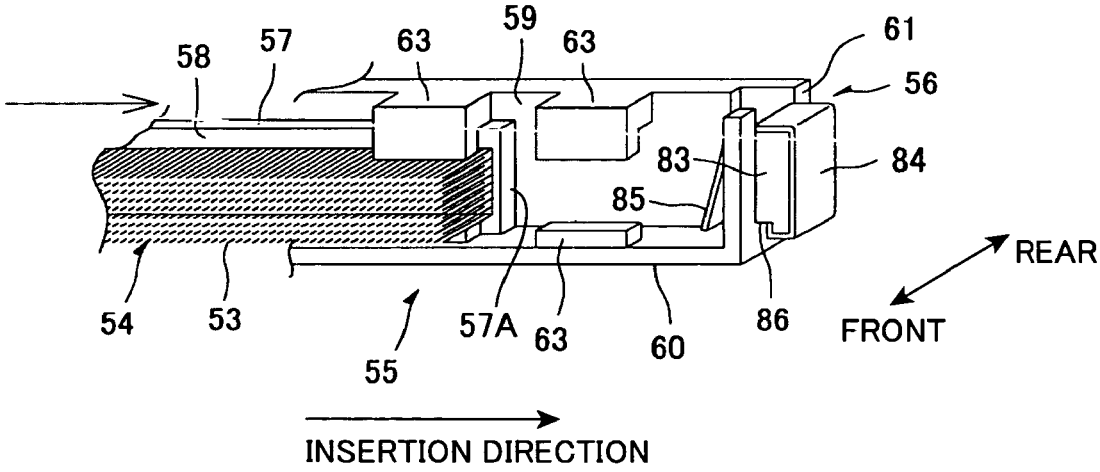

FIGS. 33(*a*) and 33(*b*) show a brush holder 55 and an electrode 56 according to an eighteenth embodiment of the present invention. As shown in FIG. 33(*b*), the electrode 56 has a planar shape and is integrally configured of an engaging part 84 having a cross section that forms three sides of a rectangle for engaging with a support part 83 described later; and a contact part 85 shaped like a leaf spring that is formed continuously from the engaging part 84 and is disposed along the inside surface of the contact wall 61 in the longitudinal direction of the same.

The brush holder 55 of the eighteenth embodiment is not provided with the upper side wall 60. Further, the contact wall 61 is shaped substantially like a rectangular plate formed continuously with the support plate 59 and the side wall 60 and is disposed in a position for blocking the base member 57 in the insertion direction. A recessed part is formed in the center region on the upper edge of the contact walls 61 for inserting the engaging part 84. The support part 83 protrudes in a substantially rectangular shape on the outer surface of the contact wall 61 in the longitudinal direction for supporting the engaging part 84. An engaging part 86 is formed on the bottom surface of the support part 83 for engaging the engaging part 84 of the electrode 56.

While the brush holder 55 of the present embodiment is not provided with the upper side wall 60, the plurality of pawls 63 are formed on the upper side of the support plate 59 at predetermined intervals along the longitudinal direction of the same for holding the mounting portion 58. A plurality of pawls 63 are also formed on the bottom side of the support plate 59 at predetermined intervals along the longitudinal direction.

As shown in FIG. 33(*a*), the electrode 56 is mounted in the brush holder 55 by fitting the engaging part 84 of the electrode 56 over the support part 83 and engaging the free end of the engaging part 84 with the engaging part 86 so that the contact part 85 can bend in the longitudinal direction over the inner surface of the contact wall 61.

By mounting the electrode 56 on the brush holder 55 in this way, the contact part 85 can elastically contact the longitudinal end surface 57A of the base member 57. Hence, the electrode 56 can be reliably placed in contact with the base member 57 through a simple construction.

While the invention has been described in detail with reference to the specific embodiment thereof, it would be apparent to those skilled in the art that various changes and modifications may be made therein without departing from the spirit of the invention.

For example, in the embodiments described above, the pair of mounting portions 58 is formed continuously along the longitudinal direction of the base member 57. However, the mounting portions 58 may also be formed in sections along the longitudinal direction of the base member 57. In such a case, a plurality of the mounting portions 58 may be disposed so as to confront each other across the brush material 53 or in a staggered formation so as not to confront each other across the brush material 53. Further, the mounting portions 58 may be formed separately from the base member 57 and bonded to the base member 57.

What is claimed is:

1. A process cartridge comprising:

an image bearing member having a surface that extends in a longitudinal direction for bearing a developer image on the surface;

a brush removing foreign matter deposited on the surface of the image bearing member, the brush including:

a base member having an elongated plate shape that extends in the longitudinal direction, the base member having a front surface that extends in the longitudinal direction and confronts the image bearing member;

a brush member including bristles provided on the front surface of the base member, the bristles extending in another direction substantially perpendicular to the front surface; and mounting portions formed at both latitudinal ends of the base member, the both latitudinal ends being both ends in a latitudinal direction perpendicular both to the longitudinal direction and to the another direction;

a supporting portion including holding portions that hold the mounting portions formed at the both latitudinal ends of the base member, thereby supporting the brush with respect to the image bearing member; and a frame that accommodates the brush and the supporting portion, the frame including:

a first frame; and a second frame formed separately from the first frame and assembled with the first frame, wherein at least one holding portion is provided on the first frame, and another holding portion is provided on the second frame.

2. The process cartridge as claimed in claim 1, wherein the mounting portions include:

a first mounting portion formed on one latitudinal end of the base member; and a second mounting portion formed on another latitudinal end of the base member; and wherein the holding portions include:

a first holding portion holding the first mounting portion; and a second holding portion holding the second mounting portion.

3. The process cartridge as claimed in claim 2, wherein the first holding portion simultaneously holds the first mounting portion across an entire length of the base member in the longitudinal direction; and wherein the second holding portion simultaneously holds the second mounting portion across the entire length of the base member in the longitudinal direction.

4. The process cartridge as claimed in claim 2, wherein at least one of the first holding portion and the second holding portion has a recessed portion capable of receiving at least one of the first mounting portion and the second mounting portion.

5. The process cartridge as claimed in claim 2, wherein at least one of the first holding portion and the second holding portion has a plurality of pawls for holding at least one of the first mounting portion and the second mounting portion, the plurality of pawls being spaced at predetermined intervals along the longitudinal direction.

6. The process cartridge as claimed in claim 2, wherein the first holding portion holds the first mounting portion, the second holding portion holds the second mounting portion, and the image bearing member contacts the brush member, allowing the supporting portion and the image bearing member to support the brush from three directions.

7. The process cartridge as claimed in claim 2, wherein the frame accommodates the image bearing member, the brush, and the supporting portion, the first frame supporting the image bearing member; and the supporting portion being provided on the first frame.

8. The process cartridge as claimed in claim 2, wherein the first holding portion is provided on the first frame, and the second holding portion is provided on the second frame.

9. The process cartridge as claimed in claim 8, wherein the first holding portion includes a recessed portion capable of receiving the first mounting portion; and wherein the second holding portion includes at least one rib that presses the second mounting portion toward the first holding portion when the first frame and the second frame are assembled together.

10. The process cartridge as claimed in claim 8, wherein the base member is electrically conductive, further comprising an electrode disposed in the second frame and contacting the base member when the first frame and the second frame are assembled together, the electrode applying a bias to the brush.

11. The process cartridge as claimed in claim 2, wherein the supporting portion is disposed in confrontation with the image bearing member, receives the brush that is mounted into the supporting portion in a direction from the image bearing member, and holds the first and second mounting portions with the first and second holding portions, respectively.

12. The process cartridge as claimed in claim 2, further comprising a frame that accommodates the brush and the supporting portion, wherein the supporting portion is a holder member formed separately from the frame and including the first holding portion and the second holding portion; and wherein the holder member is fixed to the frame so as to confront the image bearing member, the first and second holding portions holding the first and second mounting portions, respectively.

13. The process cartridge as claimed in claim 12, wherein the holder member includes:

a recessed portion receiving the first mounting portion; and at least one pawl that is elastically deformable and engagable with the second mounting portion, wherein, when the brush is pressed against the holder member in a direction from the image bearing member toward the holder member, the at least one pawl elastically deforms to receive the second mounting portion with the first mounting portion fitted into the recessed portion, and returns to its original shape after receiving the second mounting portion to engage with the second mounting portion.

14. The process cartridge as claimed in claim 12, wherein the holder member includes:

a receiving member having a recessed portion receiving the first mounting portion;

a pressing member formed separately from the receiving member and pressing the second mounting portion in a direction from the image bearing member toward the holder member after the first mounting portion has been fitted into the recessed portion; and a fixing member formed separately from the receiving member and fixing the pressing member to the receiving member.

15. The process cartridge as claimed in claim 14, wherein the base member is electrically conductive, further comprising an electrode interposed between the pressing member and the second mounting portion, the electrode being in contact with the second mounting portion for applying a bias to the brush.

16. The process cartridge as claimed in claim 2, wherein the supporting portion is integrally formed with the frame and includes:

a recessed portion receiving the first mounting portion; and at least one pawl that is elastically deformable and engagable with the second mounting portion; and wherein, when the brush is pressed against the supporting portion in a direction from the image bearing member toward the supporting portion, the at least one pawl elastically deforms to receive the second mounting portion, with the first mounting portion fitted into the recessed portion, and the at least one pawl returns to its original shape after receiving the second mounting portion to engage with the second mounting portion.

17. The process cartridge as claimed in claim 2, wherein the supporting portion is integrally formed with the frame and includes:

a receiving member formed integrally with the frame and having a recessed portion that receives the first mounting portion;

a pressing member formed separately from the receiving member for pressing the second mounting portion in a direction from the image bearing member toward the holder member after the first mounting portion has been received by the recessed portion; and a fixing member formed separately from the receiving member and fixing the pressing member to the receiving member.

18. The process cartridge as claimed in claim 2, wherein the base member is electrically conductive, further comprising an electrode that contacts the base member when the brush is supported by the supporting portion, the electrode applying a bias to the brush.

19. The process cartridge as claimed in claim 18, wherein the base member further includes a rear surface opposite to the front surface and a longitudinal end surface at an end in the longitudinal direction;

wherein the supporting portion further includes a contact wall disposed at an end in the longitudinal direction of the supporting portion; and wherein the electrode includes:

an engaging part that engages with the contact wall; and a contact part formed continuously from the engaging part and elastically contacting the longitudinal end surface of the base member.

20. The process cartridge according to claim 18, wherein the base member further includes a rear surface opposite to the front surface and a longitudinal end surface at an end in the longitudinal direction;

wherein the supporting portion includes:

a support plate supporting the base member from the rear surface of the base member, the support plate having a front surface that confronts the rear surface of the base member and a rear surface opposite to the front surface of the support plate; and an confronting wall confronting the longitudinal end surface of the base member; and wherein the electrode includes:

a fixing part fixed to the confronting wall;

a relay part formed continuously from the fixing part and disposed on the rear surface of the support plate; and a contact part formed continuously from the relay part and disposed on the front surface of the support plate.

21. The process cartridge as claimed in claim 20, wherein the support plate further includes a latitudinal end which is an end in a latitudinal direction perpendicular to the longitudinal direction of the support plate; and wherein the electrode is formed in a plate shape and further includes a bridge part between the relay part and the contact part for spanning the latitudinal end of the support plate.

22. The process cartridge as claimed in claim 2, wherein the base member is electrically conductive, further comprising an electrode having a mounting part for mounting the electrode onto the base member for applying a bias to the brush.

23. The process cartridge as claimed in claim 1, wherein the holding portions receive the brush that is slidingly inserted along an insertion direction parallel to the longitudinal direction, thereby holding the mounting portions formed at both latitudinal ends of the base member.

24. The process cartridge as claimed in claim 23, wherein the frame accommodates the image bearing member, and wherein the supporting portion is formed integrally with the frame.

25. The process cartridge as claimed in claim 23, wherein the frame accommodates the image bearing member, wherein the supporting portion is formed separately from the frame and is fixed to the frame.

26. The process cartridge as claimed in claim 23, wherein the holding portions include a plurality of pawls spaced at predetermined intervals along the insertion direction and confronting the front surface of the mounting portions.

27. The process cartridge as claimed in claim 26, wherein the both latitudinal ends of the base member includes a first latitudinal end and a second latitudinal end; and wherein the plurality of pawls include:

at least one first pawl confronting the mounting portion formed on the first latitudinal end of the base member; and at least one second pawl confronting the mounting portion formed on the second latitudinal end of the base member, the brush member being interposed between the at least one first pawl and the at least one second pawl; and wherein the at least one first pawl is disposed at a position different from a position of the at least one second pawl in the insertion direction.

28. The process cartridge as claimed in claim 26, wherein each pawl has a front surface confronting the image bearing member and a rear surface opposite to the front surface of the pawl; and wherein the rear surface of each pawl is formed with a sloped surface which slopes from the front surface toward the rear surface in the insertion direction, thereby guiding movement of the brush that is inserted in the insertion direction.

29. The process cartridge as claimed in claim 23, wherein the base member further includes a rear surface opposite to the front surface and a longitudinal end surface at an end in the longitudinal direction; and wherein the supporting portion includes a contact wall provided at a downstream end in the insertion direction, the contact wall contacting the longitudinal end surface of the base member when the brush is inserted in the supporting portion, thereby restricting further movement of the base member in the insertion direction.

30. The process cartridge as claimed in claim 23, further comprising a stopper preventing the brush supported by the supporting portion from moving in a withdrawal direction which is a direction opposite the insertion direction, thereby preventing the brush from dropping out of the supporting portion.

31. The process cartridge as claimed in claim 30, wherein the supporting portion includes a support plate supporting the base member from the rear surface of the base member, the support plate having a front surface that confronts the rear surface of the base member and a rear surface opposite to the front surface of the support plate; and wherein the stopper protrudes from the front surface of the support plate at an upstream end with respect to the insertion direction.

32. The process cartridge as claimed in claim 31, wherein the upstream end of the support plate, on which the stopper is provided, has rigidity that substantially prevents bending in a thickness direction of the support plate; and wherein the stopper is a protrusion integrally formed at the upstream end of the support plate.

33. The process cartridge as claimed in claim 31, wherein the stopper is a protrusion integrally provided at the upstream end of the support plate, the stopper being deformable from a restricting position at which the stopper prevents the brush from moving in the withdrawal direction to a withdrawal position at which the stopper allows the brush to move in the withdrawal direction.

34. The process cartridge as claimed in claim 30, wherein the stopper is a restricting wall provided separately from the supporting portion and fixed to the upstream end in the insertion direction, thereby restricting movement of the base member in the withdrawal direction.

35. The process cartridge as claimed in claim 23, wherein the base member is electrically conductive; and wherein the supporting portion includes an electrode that contacts the base member when the brush is supported by the supporting portion, the electrode applying a bias to the brush.

36. The process cartridge as claimed in claim 35, wherein the supporting portion includes a support plate supporting the base member from the rear surface of the base member, the support plate having a front surface that confronts the rear surface of the base member and a rear surface opposite to the front surface of the support plate; and wherein the electrode is disposed on the front surface of the support plate and is in contact with the rear surface of the base member.

37. The process cartridge as claimed in claim 35, wherein the electrode includes an engaging part engaging with the supporting portion; and wherein the supporting portion includes:

a support plate supporting the base member from the rear surface thereof; and a side wall erected in the another direction from at least one latitudinal end of the support plate, the side wall having an engaging part that engages with the engaging part of the electrode.

38. The process cartridge as claimed in claim 35, wherein the base member further includes a rear surface opposite to the front surface and a longitudinal end surface at an end in the longitudinal direction;

wherein the supporting portion includes:

a support plate supporting the base member from the rear surface of the base member, the support plate having a front surface that confronts the rear surface of the base member and a rear surface opposite to the front surface of the support plate;

a contact wall contacting the longitudinal end surface of the base member; and an open part penetrating the support plate in a thickness direction; and wherein the electrode includes:

a first end fixed to the contact wall;

a relay part formed continuously from the first end and disposed on the rear surface of the support plate; and a second end formed continuously from the relay part and disposed from the rear surface to the front surface of the support plate through the open part.

39. The process cartridge as claimed in claim 35, wherein the base member further includes a rear surface opposite to the front surface and a longitudinal end surface at an end in the longitudinal direction;

wherein the supporting portion includes a support plate supporting the base member from the rear surface thereof, the support plate having a front surface that confronts the rear surface of the base member and a rear surface opposite to the front surface of the support plate; and wherein the electrode includes a contact part that runs from the rear surface of the support plate across the support plate and the base member to the front surface of the base member.

40. The process cartridge as claimed in claim 39, wherein the base member further includes a latitudinal end at an end in the latitudinal direction;

wherein the support plate further includes a latitudinal end at an end in the latitudinal direction;

wherein the supporting portion further includes an confronting wall confronting the longitudinal end surface of the base member; and wherein the electrode includes:

a first end fixed to the confronting wall;

a relay part formed continuously from the first end and disposed on the rear surface of the support plate; and a second end formed continuously from the relay part and disposed from the rear surface of the support plate across both the latitudinal end of the support plate and the latitudinal end of the base member to the front surface of the base member.

41. The process cartridge as claimed in claim 40, wherein the second end of the electrode has elasticity.

42. The process cartridge as claimed in claim 35, wherein the base member further includes a rear surface opposite to the front surface and a longitudinal end surface at an end in the longitudinal direction;

wherein the supporting portion includes a contact wall contacting the longitudinal end surface of the base member; and wherein the electrode includes:

an engaging part engaging with the contact wall; and a contact part formed continuously from the engaging part for elastically contacting the longitudinal end surface of the base member.

43. The process cartridge as claimed in claim 23, wherein the base member further includes a rear surface opposite to the front surface, further comprising elastic members that elastically urge the brush toward the image bearing member from the rear surface of the base member.

44. The process cartridge as claimed in claim 43, wherein the elastic members are disposed on the rear surface of the base member at positions confronting the holding portions.

45. The process cartridge as claimed in claim 43, wherein the supporting portion includes a support plate supporting the base member from the rear surface thereof; and wherein the elastic members are integrally formed with the support plate, each elastic member including:

an elastic piece elastically deformable in a thickness direction of the support plate; and a contact part provided on the elastic piece and contactable with the rear surface of the base member.

46. The process cartridge as claimed in claim 43, wherein the base member is electrically conductive; and wherein the elastic members are electrically conductive and function as electrodes for applying a bias to the brush.

47. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction;

a supporting portion supporting the brush with respect to the image bearing member; and an electrode that contacts the brush when the brush is supported by the supporting portion for applying a bias to the brush, wherein the brush is electrically conductive;

wherein the supporting portion includes:

a support plate supporting the brush from an opposite side of the image bearing member with the brush interposed therebetween, the support plate having a front surface that confronts the rear surface of the brush, a rear surface opposite to the front surface of the support plate, and a latitudinal end which is an end in a latitudinal direction perpendicular to the longitudinal direction; and an confronting wall confronting the longitudinal end surface of the brush; and wherein the electrode is formed in a plate shape and includes:

a fixing part fixed to the confronting wall;

a relay part formed continuously from the fixing part and disposed on the rear surface of the support plate;

a bridge part formed continuously from the relay part and spanning the latitudinal end of the support plate; and a contact part formed continuously from the bridge part and disposed on the front surface of the support plate.

48. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member;

a supporting portion supporting the brush with respect to the image bearing member;

an electrode having a mounting part for mounting the electrode onto the brush for applying a bias to the brush; and a frame that accommodates the brush and the supporting portion, the frame including:

a first frame; and a second frame formed separately from the first frame and assembled with the first frame, wherein at least one holding portion is provided on the first frame, and another holding portion is provided on the second frame.

49. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member;

a supporting portion supporting the brush with respect to the image bearing member;

an electrode applying a bias to the brush; and a frame accommodating the image bearing member, the brush, and the supporting portion, wherein the frame includes:

a first frame; and a second frame formed separately from the first frame and assembled with the first frame;

wherein the brush is electrically conductive;

wherein the electrode is disposed in the second frame and contacts the brush when the first frame and the second frame are assembled together; and wherein the brush is supported by both the first frame and the second frame when the first frame and the second frame are assembled together.

50. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction;

a supporting portion supporting the brush with respect to the image bearing member; and an electrode that contacts the brush when the brush is supported by the supporting portion for applying a bias to the brush, wherein the brush is electrically conductive;

wherein the supporting portion includes:

a support plate supporting the brush from an opposite side of the image bearing member with the brush interposed therebetween, the support plate having a front surface that confronts the rear surface of the brush, a rear surface opposite to the front surface of the support plate, and latitudinal ends with regard to a latitudinal direction perpendicular to the longitudinal direction; and a side wall erected in a direction toward the image bearing member and erecting from at least one latitudinal end of the support plate, the side wall having an engaging part; and wherein the electrode is disposed on the front surface of the support plate for contacting the rear surface of the brush, the electrode having an engaging part engaging with the engaging part of the side wall.

51. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member, the brush having a front surface confronting the image bearing member, a rear surface opposite to the front surface, and a longitudinal end surface at an end in the longitudinal direction;

a supporting portion supporting the brush with respect to the image bearing member; and an electrode that contacts the brush when the brush is supported by the supporting portion for applying a bias to the brush, wherein the brush is electrically conductive;

wherein the supporting portion includes:

a support plate supporting the brush from the rear surface of the brush, the support plate having a front surface that confronts the rear surface of the brush and a rear surface opposite to the front surface of the support plate;

a contact wall contacting the longitudinal end surface of the brush; and an open part penetrating the support plate in a thickness direction; and wherein the electrode is configured of a wire and includes:

a first end fixed to the contact wall;

a relay part formed continuously from the first end and disposed on the rear surface of the support plate; and a second end formed continuously from the relay part and disposed from the rear surface to the front surface of the support plate through the open part.

52. A process cartridge comprising:

an image bearing member having a surface that extends in a longitudinal direction for bearing a developer image on the surface;

a brush disposed in confrontation with the image bearing member and extending in the longitudinal direction for removing foreign matter deposited on the surface of the image bearing member, the brush having a front surface confronting the image bearing member, a rear surface opposite to the front surface, a longitudinal end surface at an end in the longitudinal direction, and a latitudinal end at an end in a latitudinal direction perpendicular to the longitudinal direction;

a supporting portion supporting the brush with respect to the image bearing member; and an electrode that contacts the brush when the brush is supported by the supporting portion for applying a bias to the brush, wherein the brush is electrically conductive;

wherein the supporting portion includes:

a support plate supporting the brush from the rear surface of the brush, the support plate having a front surface that confronts the rear surface of the brush and a rear surface opposite to the front surface of the support plate, the support plate further having a latitudinal end at an end in the latitudinal direction; and an confronting wall confronting the longitudinal end surface of the brush; and wherein the electrode is formed in a plate shape and includes:

a first end fixed to the confronting wall;

a relay part formed continuously from the first end and disposed on the rear surface of the support plate; and a second end formed continuously from the relay part and disposed from the rear surface of the support plate across both the latitudinal end of the support plate and the latitudinal end of the brush to the front surface of the brush.

53. An image forming device comprising:

a main casing; and a process cartridge detachably mounted on the main casing, including:

an image bearing member having a surface that extends in a longitudinal direction for bearing a developer image on the surface;

a brush removing foreign matter deposited on the surface of the image bearing member, the brush including:

a base member having an elongated plate shape that extends in the longitudinal direction, the base member having a front surface that extends in the longitudinal direction and confronts the image bearing member;

a brush member including bristles provided on the front surface of the base member and extending in another direction substantially perpendicular to the front surface; and mounting portions formed at both latitudinal ends of the base member and extending in the longitudinal direction, the both latitudinal ends being both ends in a latitudinal direction perpendicular both to the longitudinal direction and to the another direction;

a supporting portion including holding portions that hold the mounting portions formed at the both latitudinal ends of the base member, thereby supporting the brush with respect to the image bearing member; and a frame that accommodates the brush and the supporting portion, the frame including:

a first frame; and a second frame formed separately from the first frame and assembled with the first frame, wherein at least one holding portion is provided on the first frame, and another holding portion is provided on the second frame.

54. The image forming device as claimed in claim 53, wherein the mounting portions include:

a first mounting portion formed on one latitudinal end of the base member; and a second mounting portion formed on another latitudinal end of the base member; and wherein the holding portions include:

a first holding portion holding the first mounting portion; and a second holding portion holding the second mounting portion.

55. The image forming device as claimed in claim 53, wherein the holding portions receive the brush that is slidingly inserted along an insertion direction parallel to the longitudinal direction, thereby holding the mounting portions formed at both latitudinal ends of the base member.

56. A process cartridge comprising:

an image bearing member having a surface that extends in a longitudinal direction for bearing a developer image on the surface;

a brush removing foreign matter deposited on the surface of the image bearing member, the brush including:

a base member having an elongated plate shape that extends in the longitudinal direction, the base member having a front surface that extends in the longitudinal direction and confronts the image bearing member;

a brush member including bristles provided on the front surface of the base member, the bristles extending in another direction substantially perpendicular to the front surface; and mounting portions formed at both latitudinal ends of the base member, the both latitudinal ends being both ends in a latitudinal direction perpendicular both to the longitudinal direction and to the another direction, the mounting portions including:

a first mounting portion formed on one latitudinal end of the base member; and a second mounting portion formed on another latitudinal end of the base member;

a supporting portion including holding portions that hold the mounting portions formed at the both latitudinal ends of the base member, thereby supporting the brush with respect to the image bearing member, the holding portions including:

a first holding portion holding the first mounting portion; and a second holding portion holding the second mounting portion; and a frame that accommodates the brush and the supporting portion, wherein the supporting portion is integrally formed with the frame and includes:

a recessed portion receiving the first mounting portion; and at least one pawl that is elastically deformable and engagable with the second mounting portion; and wherein, when the brush is pressed against the supporting portion in a direction from the image bearing member toward the supporting portion, the at least one pawl elastically deforms to receive the second mounting portion, with the first mounting portion fitted into the recessed portion, and the at least one pawl returns to its original shape after receiving the second mounting portion to engage with the second mounting portion.

57. A process cartridge comprising:

an image bearing member having a surface that extends in a longitudinal direction for bearing a developer image on the surface;

a brush removing foreign matter deposited on the surface of the image bearing member, the brush including:

a base member having an elongated plate shape that extends in the longitudinal direction, the base member having a front surface that extends in the longitudinal direction and confronts the image bearing member;

a brush member including bristles provided on the front surface of the base member, the bristles extending in another direction substantially perpendicular to the front surface; and mounting portions formed at both latitudinal ends of the base member, the both latitudinal ends being both ends in a latitudinal direction perpendicular both to the longitudinal direction and to the another direction, the mounting portions including:

a first mounting portion formed on one latitudinal end of the base member; and a second mounting portion formed on another latitudinal end of the base member;

a supporting portion supporting the brush with respect to the image bearing member; and a frame that accommodates the brush and the supporting portion, wherein the supporting portion is integrally formed with the frame and includes:

an engaging portion being configured to engage with the first mounting portion; and at least one pawl being configured to engage with the second mounting portion; and wherein, when the brush is pressed against the supporting portion in a direction from the image bearing member toward the supporting portion, the at least one pawl elastically deforms to engage with the second mounting portion while the first mounting portion is engaged with the engaging portion.

* * * * *